US005384584A

United States Patent [19]

Yoshida et al.

[11] Patent Number: 5,384,584

[45] Date of Patent: Jan. 24, 1995

[54] THERMAL TRANSFER RECORDING METHOD AND APPARATUS WITH OPPOSITELY CONVEYED INK SHEET AND RECORDING MEDIUM CONTROLLED TO MAINTAIN A SUBSTANTIALLY CONSTANT CONVEYANCE RATIO

[75] Inventors: Takehiro Yoshida, Tokyo; Hisao Terajima, Yokohama; Satoshi Wada, Kawasaki; Takeshi Ono, Yokohama; Makoto Kobayashi, Tama; Yasushi Ishida, Tokyo; Akihiro Tomoda, Yokohama; Minoru Yokoyama, Yokohama; Takashi Awai, Yokohama, all of Japan

[73] Assignee: Canon Kabushiki Kaisha, Tokyo, Japan

[21] Appl. No.: 999,547

[22] Filed: Dec. 31, 1992

Related U.S. Application Data

[63] Continuation of Ser. No. 409,880, Sep. 20, 1989, abandoned.

[30] Foreign Application Priority Data

| | | | |
|---|---|---|---|
| Sep. 22, 1988 | [JP] | Japan | 63-236368 |
| Oct. 4, 1988 | [JP] | Japan | 63-248980 |
| Oct. 28, 1988 | [JP] | Japan | 63-270879 |
| Nov. 4, 1988 | [JP] | Japan | 63-277488 |

[51] Int. Cl.[6] ..... B41J 2/325; B41J 33/22; B41J 33/36

[52] U.S. Cl. ..... 346/76 PH; 400/232; 400/236.2; 347/5; 347/101

[58] Field of Search ..... 358/296; 346/76 PH; 400/120, 225, 232, 234, 236, 236.2

[56] References Cited

U.S. PATENT DOCUMENTS

| | | | |
|---|---|---|---|
| 4,265,410 | 5/1981 | Fanning . | |
| 4,442,460 | 4/1984 | Kurata | 358/296 |
| 4,456,392 | 6/1984 | Nozaki | 400/120 |
| 4,496,117 | 1/1985 | Kashiwagi et al. . | |
| 4,531,135 | 7/1985 | Toshima . | |
| 4,623,902 | 11/1986 | Yamanishi . | |
| 4,703,346 | 10/1987 | Bierhoff . | |
| 4,712,113 | 12/1987 | Brooks et al. . | |
| 4,788,558 | 11/1988 | Caldwell | 346/76 PH |

FOREIGN PATENT DOCUMENTS

| | | | |
|---|---|---|---|
| 58-201686 | 11/1983 | Japan . | |
| 95177 | 6/1984 | Japan . | |
| 60-83864 | 5/1985 | Japan . | |
| 60-236779 | 11/1985 | Japan . | |
| 60-240480 | 11/1985 | Japan . | |
| 61-135773 | 6/1986 | Japan | B41J 17/04 |
| 98480 | 4/1988 | Japan . | |

*Primary Examiner*—Benjamin R. Fuller
*Assistant Examiner*—Eric Frahm
*Attorney, Agent, or Firm*—Fitzpatrick, Cella, Harper & Scinto

[57] ABSTRACT

A thermal transfer recording apparatus for transferring an ink contained in an ink sheet onto a recording medium to record an image on the recording medium, includes a take-up roller for taking up the ink sheet, a driving unit for driving the take-up roller to take up the ink sheet, and a control unit for controlling a drive amount of the driving unit to maintain an almost constant conveyance ratio of the ink sheet to the recording medium in correspondence with a change in take-up amount by the take-up roller.

52 Claims, 28 Drawing Sheets

FIG. 13B

| PHASE A | CURRENT VALUE | PHASE B | CURRENT VALUE | |
|---|---|---|---|---|
| A | 1 | B | 0 | 64 STAGES |
| A | $\cos(\frac{90}{64})$ | B | $\sin(\frac{90}{64})$ | |
| A | $\cos(\frac{90\times 2}{64})$ | B | $\sin(\frac{90}{64}\times 2)$ | |
| A | $\cos(\frac{90\times 3}{64})$ | B | $\sin(\frac{90\times 3}{64})$ | |
| | ⋮ | | ⋮ | |
| A | 0 | B | 1 | 64 STAGES |
| AX | $\sin(\frac{90}{64})$ | B | $\cos(\frac{90}{64})$ | |
| AX | $\sin(\frac{90\times 2}{64})$ | B | $\cos(\frac{90\times 2}{64})$ | |
| | ⋮ | | ⋮ | |
| AX | 1 | B | 0 | 64 STAGES |
| AX | $\cos(\frac{90}{64})$ | BX | $\sin(\frac{90}{64})$ | |
| AX | $\cos(\frac{90\times 2}{64})$ | BX | $\sin(\frac{90\times 2}{64})$ | |
| | ⋮ | | ⋮ | |
| A | 0 | B | 1 | 64 STAGES |
| A | $\sin(\frac{90}{64})$ | BX | $\cos(\frac{90}{64})$ | |
| A | $\sin(\frac{90\times 2}{64})$ | BX | $\cos(\frac{90\times 2}{64})$ | |
| | ⋮ | | ⋮ | |
| A | $\sin(\frac{90\times 63}{64})$ | BX | $\cos(\frac{90\times 63}{64})$ | |

FIG. 19
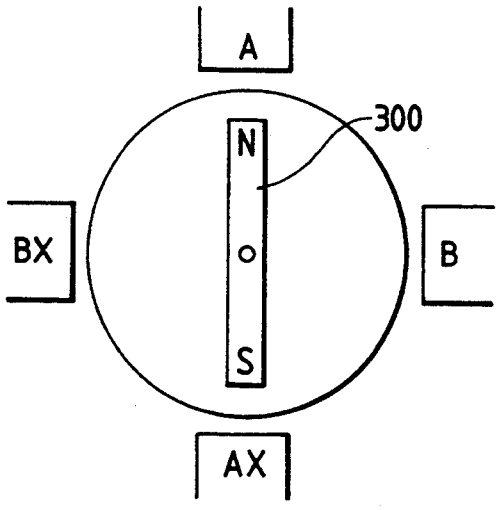
FIG. 20
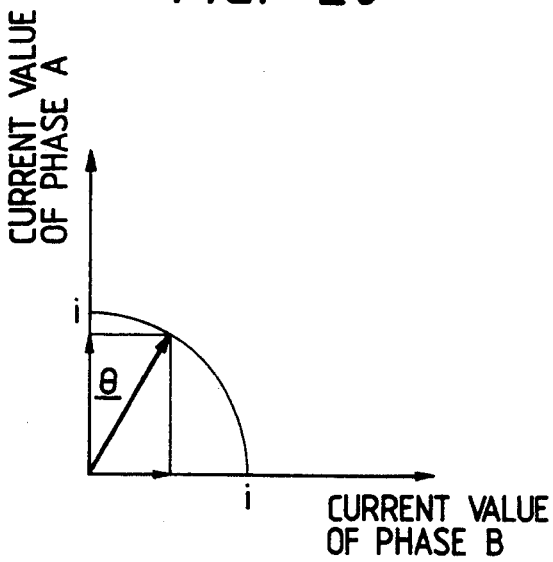
FIG. 21
| NUMBER | CURRENT VALUE OF PHASE A | CURRENT VALUE OF PHASE B |
|---|---|---|
| 0 | $a_0$ | $b_0$ |
| 1 | $a_1$ | $b_1$ |
| 2 | $a_2$ | $b_2$ |
| 3 | $a_3$ | $b_3$ |
| ⋮ | ⋮ | ⋮ |
| 255 | $a_{255}$ | $b_{255}$ |

THERMAL TRANSFER RECORDING METHOD AND APPARATUS WITH OPPOSITELY CONVEYED INK SHEET AND RECORDING MEDIUM CONTROLLED TO MAINTAIN A SUBSTANTIALLY CONSTANT CONVEYANCE RATIO

This application is a continuation of application Ser. No. 07/409,880 filed Sep. 20, 1989, now abandoned.

BACKGROUND OF THE INVENTION

1. Field of the Invention

The present invention relates to a thermal transfer recording apparatus for transferring an ink of an ink sheet to a recording medium to record an image on the recording medium.

The thermal transfer recording apparatuses include facsimile apparatuses, electronic typewriters, copying machines, printers, and the like.

2. Description of the Related Art

In general, a thermal transfer printer employs an ink sheet in which a heat-melt (or heat-sublimate, or the like) ink is coated on a base film. The ink sheet is selectively heated by a thermal head in correspondence with an image signal, the a melted (sublimated) ink is transferred onto recording paper or sheet to perform image recording. Since the ink sheet is one from which an ink is completely transferred to recording paper in single image recording (i.e., a so-called one-time sheet), the ink sheet must be conveyed by a distance corresponding to a recording length after a one-character or one-line image is recorded, so that a nonused portion of the ink sheet must be reliably conveyed to the next recording position. For this reason, the use of the ink sheet is increased, the running cost of a thermal transfer printer tends to be increased as compared to a conventional thermal printer which records an image on a thermal sheet.

In order to solve the above problem, as disclosed in U.S. Pat. No. 4,456,392, Japanese Patent Laid-Open (Kokai) No. 58-201686, and Japanese Patent Publication No. 62-58917, thermal transfer printers each of which conveys recording paper and an ink sheet in the same direction with a speed difference therebetween have been proposed. As described in the above prior art, an ink sheet capable of recording a number of (n) image recording operations (multi-print sheet) is known. If this ink sheet is used, when a recording operation is continuously performed over a recording length L, a conveying length of an ink sheet which is conveyed after every image recording operation or during image recording can a length decreased to be smaller than the length L ($L/n$: $n>1$). Thus, the efficiency of the ink sheet can be increased n times that of the conventional sheet, and a decrease in running cost of the thermal transfer printer can be expected. This recording system will be referred to as a multi-print system.

When the multi-print system is realized by such an ink sheet, the ink sheet must always be conveyed by a constant distance with respect to a conveying operation of a predetermined length of recording paper. In this conveying control, if the conveying operation of the ink sheet is controlled by measured rotation of a support shaft of a take-up roller of an ink sheet, the diameter of the take-up roller for taking up the ink sheet is gradually increased by the accumulated ink sheet. Thus, if the take-up roller is controlled to be rotated by the same amount, the conveying distance of the ink sheet at the end of the take-up operation is changed from one at the beginning of the take-up operation. For this reason, the ink sheet is clamped by a capstan roller, a pinch roller, and the like, and is conveyed upon rotation of these rollers.

However, in order to take up an ink sheet, the ink sheet must be pulled with a large force by the rollers. These rollers are distorted over long-term use, and the ink sheet may be wrinkled, thus disturbing a uniform conveying operation. In addition, these rollers require a mechanical portion complicated drive system, resulting in an increase in cost of the apparatus.

In the conventional thermal transfer printer, when a motor for conveying recording paper is rotated by one step, a platen roller is rotated to convey the recording paper by one line in a subscan direction. At the same time or immediately thereafter, when a motor for conveying an ink sheet is rotated by one step, the ink sheet is taken up by a take-up roller, and is also conveyed by one line. A thermal head is energized to perform transfer recording, so that one-line image data is recorded on recording paper. The conveying operations of the recording paper and the ink sheet and image recording processing by the thermal head are repetitively performed, thereby sequentially transferring and recording image data on the recording paper.

However, in the above-mentioned prior art, the motor for conveying the ink sheet drives the rotating shaft of the take-up roller, and is always rotated at a constant angular velocity. For this reason, when the take-up amount of the ink sheet is increased, the diameter of the take-up roller is increased. Even if the motor for conveying the ink sheet is rotated at the same angular velocity, the moving speed of the ink sheet is undesirably increased. Even when the diameter of the ink sheet take-up roller is minimal if the transmission gears are selected with a ratio suitable for transmitting rotation of the conveying motor to the roll in order to convey an ink sheet by a necessary amount (e.g., by one line), as the take-up amount of the ink sheet is increased, the ink sheet is conveyed more than necessary.

SUMMARY OF THE INVENTION

It is an object of the present invention to provide a thermal transfer recording method with which image quality can be improved, and a recording apparatus using the method.

It is another object of the present invention to provide a thermal transfer recording method with which consumption of an ink sheet can be reduced, and a recording apparatus using the method.

It is still another object of the present invention to provide a thermal transfer recording method with which running cost can be decreased, and a recording apparatus using the method.

It is still another object of the present invention to provide a thermal transfer recording method with which a conveyance amount of an ink sheet can be kept almost uniform, and a recording apparatus using the method.

It is still another object of the present invention to provide a thermal transfer recording method which controls a take-up operation of an ink sheet or rotation of a supply roller to provide an almost uniform conveyance amount of an ink sheet, and a recording apparatus using the method.

It is still another object of the present invention to provide a thermal transfer recording apparatus which can detect a conveyance amount of an ink sheet corresponding to a predetermined conveyance drive amount of the ink sheet, and, when the conveyance amount is different from the drive amount, then adjusts the conveyance drive amount of the ink sheet to maintain a constant conveyance amount of the ink sheet, and a facsimile apparatus using the recording apparatus.

It is still another object of the present invention to provide a thermal transfer recording apparatus which can detect and control a rotating amount of a supply roller with respect to a drive amount of a take-up roller, and can record an image with high quality, and a facsimile apparatus using the recording apparatus.

It is still another object of the present invention to provide a thermal transfer recording apparatus which can detect a rotating amount of a supply roller with respect to a drive amount of a take-up roller, and can obtain a conveying length of an ink sheet based on the drive amount and the rotating amount to change and control the conveyance amount of the ink sheet, and a facsimile apparatus using the recording apparatus.

It is still another object of the present invention to provide a thermal transfer recording apparatus which can detect the remaining amount of an ink sheet using a sensor for detecting a conveyance amount of the ink sheet, and a facsimile apparatus using the recording apparatus.

BRIEF DESCRIPTION OF THE DRAWINGS

FIG. 13B is a table showing current values of microsteps when one revolution of the motor is divided into 256 sections;

FIG. 19 is a schematic view of a two-phase/four-pole stepping motor;

FIG. 20 is a graph for explaining the principle of a microstep driving mode;

FIG. 21 is a table showing current values of phases in the microstep driving mode;

DETAILED DESCRIPTION OF THE PREFERRED EMBODIMENTS

Preferred embodiments of the present invention will be described hereinafter with reference to the accompanying drawings.

(Description of Facsimile Apparatus (FIGS. 1 to 4))

Figure 1:
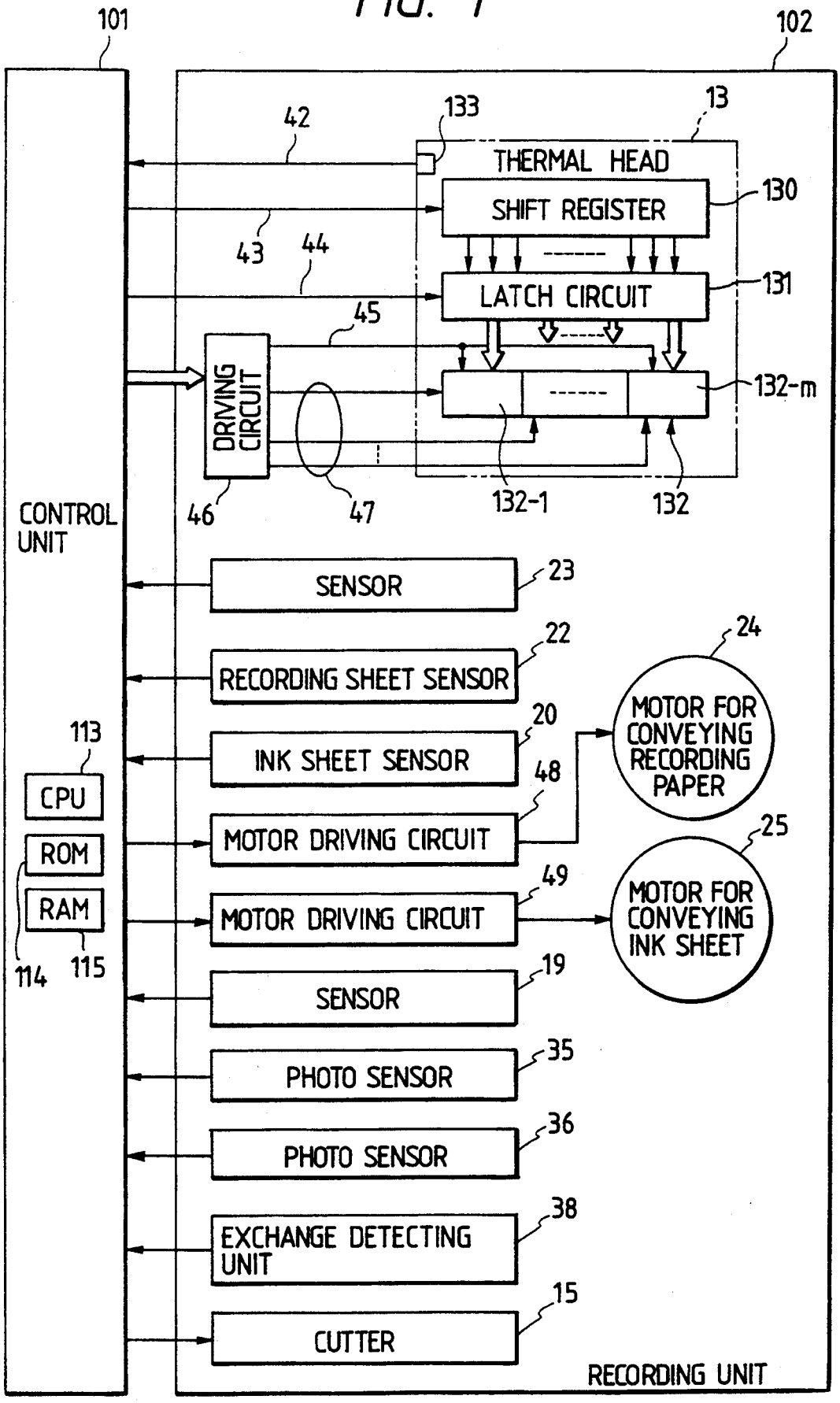
FIG. 1 is a block diagram showing electrical connections between a control unit and a recording unit in a facsimile apparatus according to an embodiment of the present invention.
Figure 2:
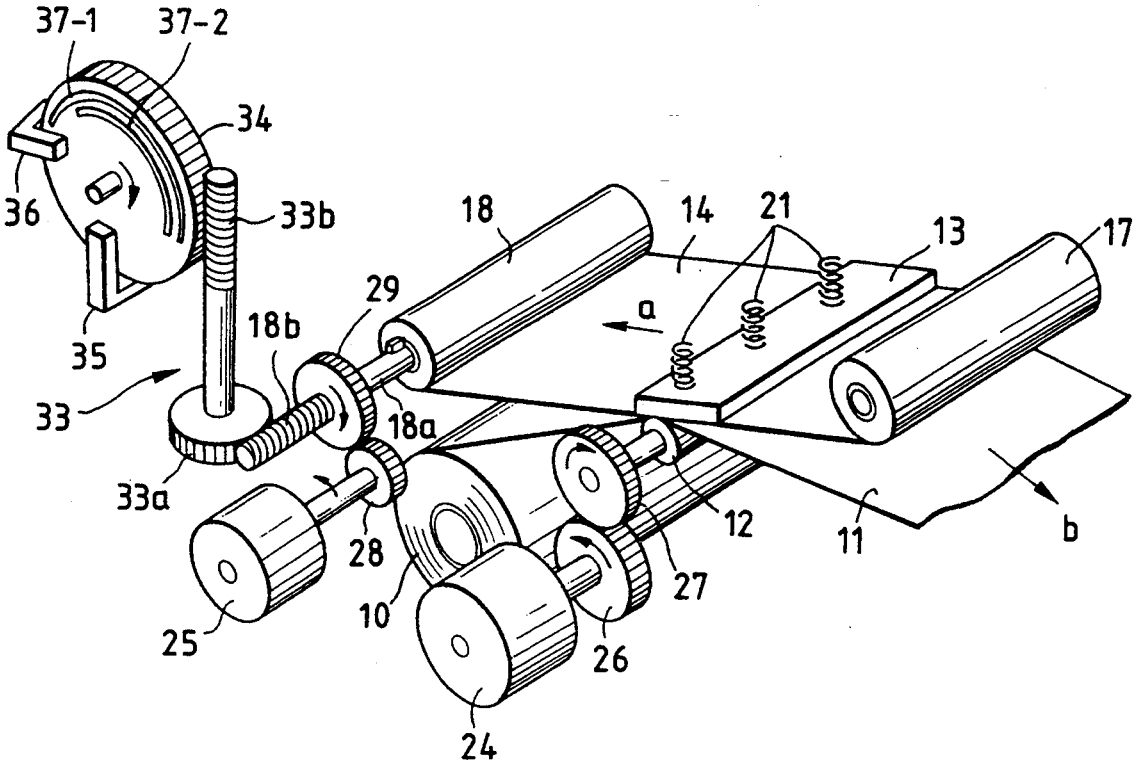
FIG. 2 is a perspective view showing a conveying mechanism of recording paper and an ink sheet of a first embodiment.
Figure 3B:
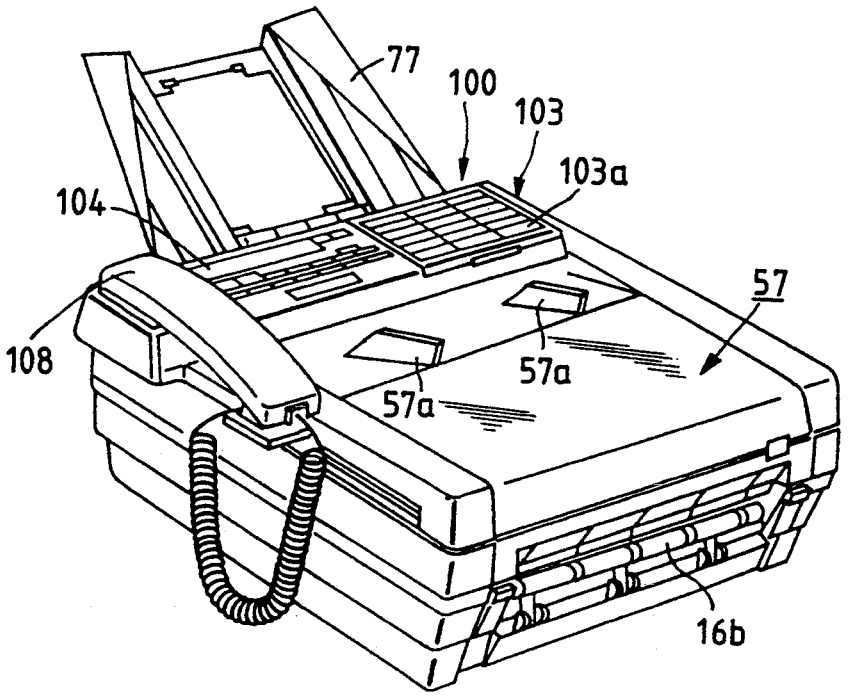
FIG. 3B is a perspective view showing an outer appearance of the apparatus.
Figure 3A:
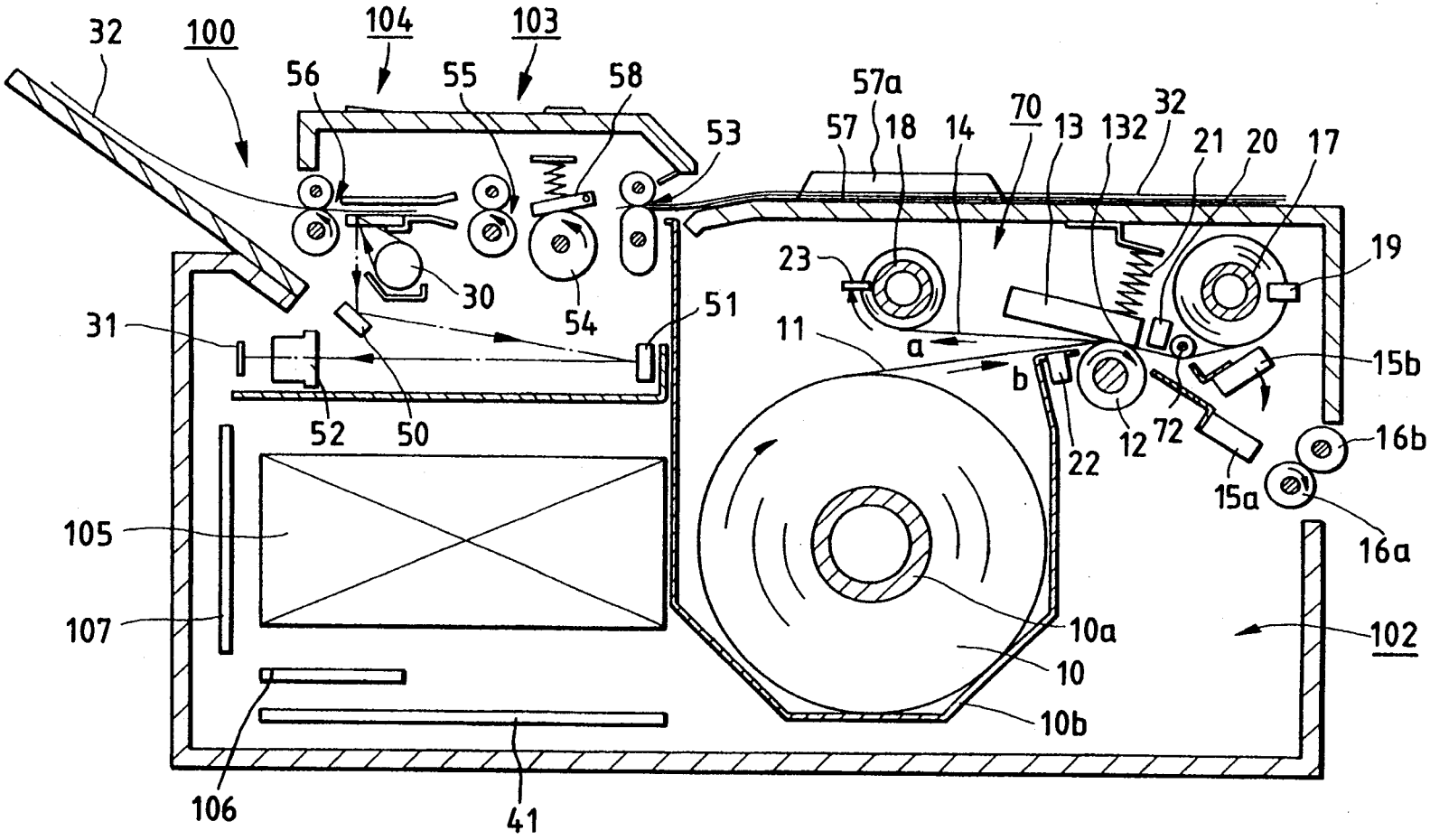
FIG. 3A is a side sectional view showing a mechanism portion of the facsimile apparatus of the embodiment.
Figure 4:
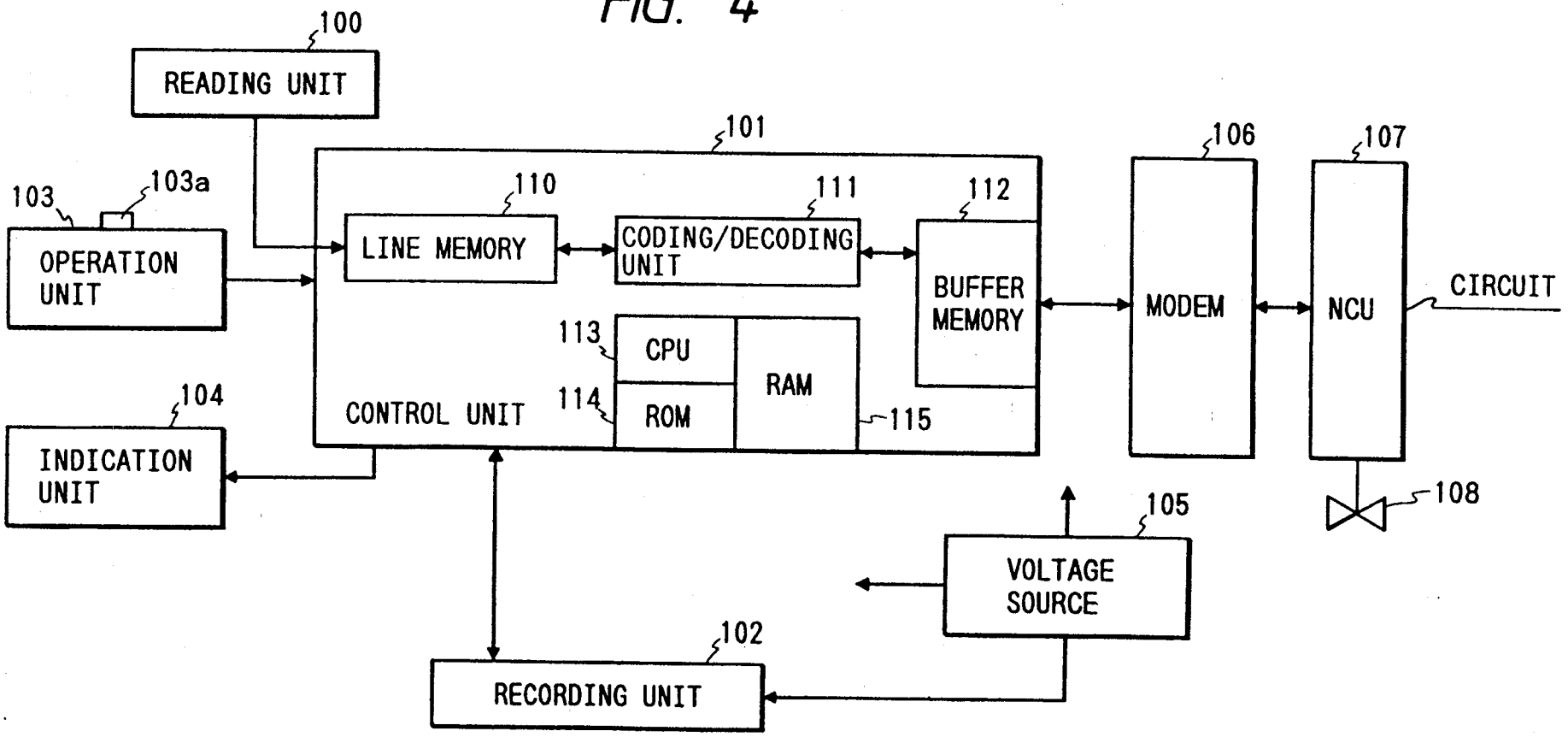
FIG. 4 as a schematic block diagram showing an arrangement of the facsimile apparatus of the embodiment.

FIGS. 1 to 4 show a case wherein a thermal transfer printer using an embodiment of the present invention is applied to a facsimile apparatus. FIG. 1 is a block diagram showing electrical connections between a control unit and a mechanism unit, FIG. 2 is a perspective view showing a conveying mechanism of recording paper and an ink sheet, FIG. 3A is a side sectional view of the facsimile apparatus, FIG. 3B is a perspective view of an outer appearance of the apparatus, and FIG. 4 is a schematic block diagram of the facsimile apparatus.

The schematic arrangement of the facsimile apparatus of this embodiment will be described below with reference to FIG. 4.

In FIG. 4, a reading unit 100 photoelectrically reads an original, and outputs it as a digital image signal to a control unit 101. The reading unit 100 comprises an original conveying motor, a CCD image sensor, and the like. The arrangement of the control unit 101 will be described below. The control unit 101 comprises a line memory 110 for storing image data for each line. The line memory 110 stores one-line image data supplied from the reading unit 100 in an original transmission or copying mode, and stores one-line data of decoded received image data in an image data reception mode. The stored data is output to a recording unit 102 to perform image formation. An encode/decode unit 111 encodes image data to be transmitted by MH coding, and decodes received encoded image data to convert it to image data. A buffer memory 112 stores encoded image data to be transmitted or received encoded image data. These sections of the control unit 101 are controlled by a CPU 113 such as a microprocessor. The control unit 101 also includes a ROM 114 for storing a control program of the CPU 113, and various data, a RAM 115 serving as a work area of the CPU 113 to temporarily store various data, and the like.

The recording unit 102 comprises a thermal line head, and records an image on recording paper by a thermal transfer recording method. The arrangement of the recording unit 102 will be described in detail later with reference to FIGS. 3A and 3B. An operation unit 103 includes various function instruction keys such as a transmission start key, input keys for telephone numbers, a switch 103*a* for indicating the type of ink sheet to be used, and the like. When the switch 103*a* is ON, it indicates that a multi-print ink sheet is loaded; when it is OFF, it indicates that a conventional one-time ink sheet is loaded. An indicating unit 104 is normally arranged in the operation unit 103, and indicates various functions and states of the apparatus. A voltage source 105 supplies power to the entire apparatus. The apparatus also includes a modem (modulator/demodulator) 106, a network control unit (NCU) 107, and a telephone set 108.

The arrangement of the recording unit 102 will be described in detail below with reference to FIG. 2 and FIGS. 3A and 3B. The same reference numerals denote the same parts throughout the drawings.

In FIGS. 3A and 3B, a paper roll 10 is obtained by winding recording paper 11 as normal paper in a cylindrical shape. The paper roll 10 is rotatably housed in the apparatus so that the recording paper 11 can be fed to a thermal head 13 portion upon rotation of a platen roller 12 in a direction of the unmarked arrow. The paper roll 10 is detachably loaded in a paper roll loading portion 10*b*. The platen roller 12 conveys the recording paper 11 in a direction of an arrow b, and presses an ink sheet 13 and the recording paper 11 between itself and heat generating elements 132 of the thermal head 13. The recording paper 11 which is subjected to image recording upon heating of the thermal head 13 is conveyed by further rotation of the platen roller 12 in a direction of discharge rollers 16*a* and 16*b*. When an image recording operation for one page is completed, the recording paper 11 is cut in units of pages upon engagement of cutters 15*a* and 15*b*, and a one-page sheet is discharged.

An ink sheet supply roller 17 winds the ink sheet 14 therearound. An ink sheet take-up roller 18 is driven by a motor 25 (to be described later) for the ink sheet, and takes up the ink sheet in a direction of arrow a. Note that the ink sheet supply roller 17 and the ink sheet take-up roller 18 are detachably loaded in an ink sheet loading portion 70 in the apparatus main body. A sensor 19 is used to detect a remain and a conveying speed of the ink sheet 14. An ink sheet sensor 20 detects the presence/absence of the ink sheet 14. Springs 21 press the thermal head 13 against the platen roller 12 through the recording paper 11 and the ink sheet 14. A recording sheet or paper sensor 22 detects the presence/absence of the recording paper. A sensor 23 detects a diameter of the take-up roller 18. A roller 72 guides the ink sheet 14.

An arrangement of the reading unit 100 will be described below.

In FIGS. 3A and 3B, a light source 30 shines light on an original 32. Light reflected by the original 32 is input to a CCD sensor 31 through an optical system (mirrors 50 and 51 and a lens 52), and is converted to an electrical signal. The original 32 is conveyed by conveying rollers 53, 54, 55, and 56 driven by an original conveying motor (not shown) in correspondence with a reading speed of the original 32. Note that the original 32 is placed on an original table 57. A plurality of originals 32 placed on the original table 57 are separated one by one by cooperation of the conveying roller 54 and a pressing/separating segment 58 while being guided by a slider 57*a*, and each original is conveyed to the reading unit 100. After the reading operation, the original is discharged onto a tray 77.

A control board 41 constitutes a principal part of the control unit 101, and outputs various control signals to respective units of the apparatus. The reading unit 100 also includes the voltage source unit 105, the modem board unit 106, and the NCU board unit 107.

FIG. 2 shows the conveying mechanism of the ink sheet 14 and the recording paper 11 in detail.

In FIG. 2, a motor 24 drives the platen roller 12 to convey the recording paper in a direction of the arrow b opposite to the direction of the arrow a. The motor 25 conveys the ink sheet 14 in the direction of the arrow a. Transmission gears 26 and 27 transmit rotation of the motor 24 to the platen roller 12. Transmission gears 28 and 29 transmit rotation of the motor 25 to the take-up roller 18.

A worm gear 33 reduces a rotating amount of a rotating shaft 18*a* of the take-up roller 18, and transmits its rotation to a disc 34 for indicating a take-up amount of the ink sheet 14. The worm gear 33 has a disc portion 33*a* meshed with a threaded portion 18*b* of the rotating shaft 18*a*, and a column portion 33*b* meshed with the disc 34. Photosensors 35 and 36 detect slits 37-1 and 37-2 to detect the rotational position of the disc 34. Each of the photosensors 35 and 36 comprises a photodiode for outputting light and a sensor for detecting light passing through the slit 37-1 or 37-2, which are arranged to sandwich the disc 34 therebetween.

The recording paper 11 and the ink sheet 14 are conveyed in opposite directions, so that the direction along which images are sequentially recorded relative to in the longitudinal direction of the recording paper 11 (direction of the arrow a, i.e., a direction opposite to the conveying direction of the recording paper 11) coincides with the conveying direction of the ink sheet 14. If a conveying speed $V_P$ of the recording paper 11 is given by $V_P = -n.V_I$ ($V_I$ is the conveying speed of the ink sheet 14, and the negative sign indicates that the conveying directions of the recording paper 11 and the ink sheet 14 are different from each other), a relative speed $V_{PI}$ of the recording paper 11 and the ink sheet 14 with respect to the thermal head 13 is given by $V_{PI} = V_P - V_I = (1+1/n)V_P$. As can be seen from this equation, the relative speed $V_{PI}$ is larger than $V_P$, i.e., a relative speed $V_{PIa}$ $(=(1-1/n)V_P)$ obtained when the sheets 11 and 14 are conveyed in the same direction like in the conventional apparatus.

In addition to the above method, there is a method of conveying the ink sheet 14 in the direction of the arrow a by (l/m) (m is an integer and n>m) every (n/m) lines when a recording operation for n lines is performed by the thermal head 13, and a method of conveying the ink sheet 14 in a direction opposite to that of the recording paper 11 at the same speed during recording and rewinding the ink sheet 14 by L.(n−1)/n before a recording operation by the next predetermined amount (for n>1) when a recording operation by a distance corresponding to a length L is performed. In either method, the relative speed obtained when a recording operation is performed while the ink sheet 14 is stopped is represented by $V_P$, and a relative speed obtained when a recording operation is performed while moving the ink sheet 14 is represented by 2 $V_P$.

FIG. 1 is a block diagram showing electrical connections between the control unit 101 and the recording unit 102 in the facsimile apparatus of this embodiment. The same reference numerals in FIG. 1 denote the same parts as in FIGS. 2, 3A, 3B, and 4.

The thermal head 13 comprises a line head. The thermal head 13 comprises a shift register 130 for receiving one-line serial recording data 43 from the recording unit 101, a latch circuit 131 for latching data of the shift register 130 in response to a latch signal 44, and heat generating elements 132 consisting of heat generating resistors for one line. The heat generating resistors are grouped into m blocks indicated by 132-1 to 132-m to be driven. A temperature sensor 133 for detecting a temperature of the thermal head 13 is attached to the thermal head 13. An output signal 42 of the temperature sensor 133 is A/D-converted in the control unit 101, and the digital data is input to the CPU 133. Thus, the CPU 133 detects the temperature of the thermal head 13, and changes a pulse width of a strobe signal 47 or changes a drive voltage of the thermal head 13 in correspondence with the detected temperature, thereby varying the energy applied to the thermal head 13 in accordance with properties of the ink sheet 14.

The properties (type) of the ink sheet 14 are detected by the switch **103*a* described above. The type or properties of the ink sheet 14 may be automatically discriminated by detecting a mark printed on the ink sheet 14** or by detecting a mark, notch, or projection provided to a cartridge or the like of the ink sheet.

A driving circuit 46 receives the drive signal of the thermal head 13 from the control unit 101, and outputs the strobe signal 47 for driving the thermal head 13 in units of blocks. Note that the driving circuit 46 can change a voltage to be output to a power source line 45 for supplying a current to the heat generating elements 132 of the thermal head 13 so as to change the energy applied to the thermal head 13. Motor driving circuits 48 and 49 drive the motors 24 and 25. Note that the motors 24 and 25, respectively comprise stepping motors in this embodiment. However, the present invention is not limited to this. For example, these motors may comprise DC motors, or the like. An exchange detecting unit 38 detects exchange of the ink sheet 14, and is interlocked with a lever for detaching/attaching the ink sheet 14. When the ink sheet is exchanged, the unit 38 outputs a pulse signal to inform the control unit 101 that the ink sheet 14 is exchanged.

Since the recording paper 11 is driven and conveyed by the platen roller 12 rotated by the motor 24, the conveyance amount of the recording paper 11 obtained when the motor 24 is rotated by a predetermined amount is always constant. Contrary to this, the ink sheet 14 is conveyed by controlling the rotational speed of the take-up roller 18 driven by the motor 25. For this reason, even if the motor 25 is rotated at a predetermined speed, the conveyance amount of the ink sheet 14 is changed depending on an amount of the ink sheet 14 wound around the take-up roller 18 (the diameter of the take-up roller 18).

As a method of regulating the take-up amount of the ink sheet 14 regardless of the change in diameter of the take-up roller 18, the following two methods are proposed.

Assume that the core diameter of the take-up roller 18 of the ink sheet 14 is represented by $r_1$, and the diameter of the take-up roller 18 after a predetermined amount of ink sheet is wound is represented by $r_2$. The conveyance amount of the ink sheet 14 after the take-up roller 18 is rotated through a predetermined angle $\theta$ is given by $r_1\theta$ immediately after the beginning of the take-up operation, and is given by $r_2\theta$ after the predetermined amount of the ink sheet 14 is wound around the take-up roller 18. In a multi-print mode, when the recording paper 11 is conveyed by one line, control is made to convey the ink sheet 14 by a 1/n line. Therefore, the diameter of the take-up roller 18 is checked by the sensor 23 shown in FIG. 3A, and the number of drive steps of the motor 25 can be selected to satisfy the relationship $P_1:P_2=r_2:r_1$. Note that the minimum step angle $\theta$ of the motor 25 in this case is constant.

In another method, a minimum step angle is changed in accordance with a take-up amount of the ink sheet 14 in a microstep drive mode, so that $\theta$ can be set to satisfy the relationship $\theta_1:\theta_2=r_2:r_1$.

In addition to the above methods, as a method of controlling the conveyance amount of the ink sheet 14 to be almost constant, the diameter of the roller 18 is calculated on the basis of the rotational speed of the take-up roller 18 after the ink sheet 14 is loaded. If the thickness of the ink sheet 14 is represented by t and its rotational speed is given by p, its diameter is given by $(r_1+pt)$. The conveyance control of the ink sheet 14 can be performed while calculating the diameter of the take-up roller 18.

According to this method, when the exchange detecting unit 38 detects exchange of the ink sheet 14, the calculation value of the diameter described above can be initialized to $r_1$. However, when an ink sheet having a different diameter is loaded or when an ink sheet in use is temporarily unloaded and then loaded again, a sensor for reading the diameter of the take-up roller 18 such as the sensor 23 shown in FIG. 3A is necessary. Marks printed on the ink sheet at predetermined intervals are read, and a rotational angle of the motor 25 necessary for conveying the ink sheet by a predetermined distance is calculated, so that a conveyance error of the ink sheet caused by a change in diameter of the take-up roller 18 can be prevented.

Three embodiments will be described below wherein the conveyance amount of the ink sheet 14 with respect to the recording paper 11 is controlled to make the conveyance amount of the ink sheet 14 almost constant, in addition to the above-mentioned methods.

(Description of First Embodiment (FIGS. 1 to 7B))

Assume that both the motors 24 and 25 are stepping motors, and are driven by 1–2 phase excitation. In the facsimile apparatus, the ratio of the transmission gears 26 and 27 is determined so that the recording paper 11 is conveyed by 1/15 mm in one step of the motor 24. In a standard mode recording operation of the facsimile apparatus, the same image data is recorded in four lines; in a fine mode recording operation, the same image data is recorded in two lines; and in a superfine mode recording operation, the same image data is recorded in one line.

Figures 5A, 5B:
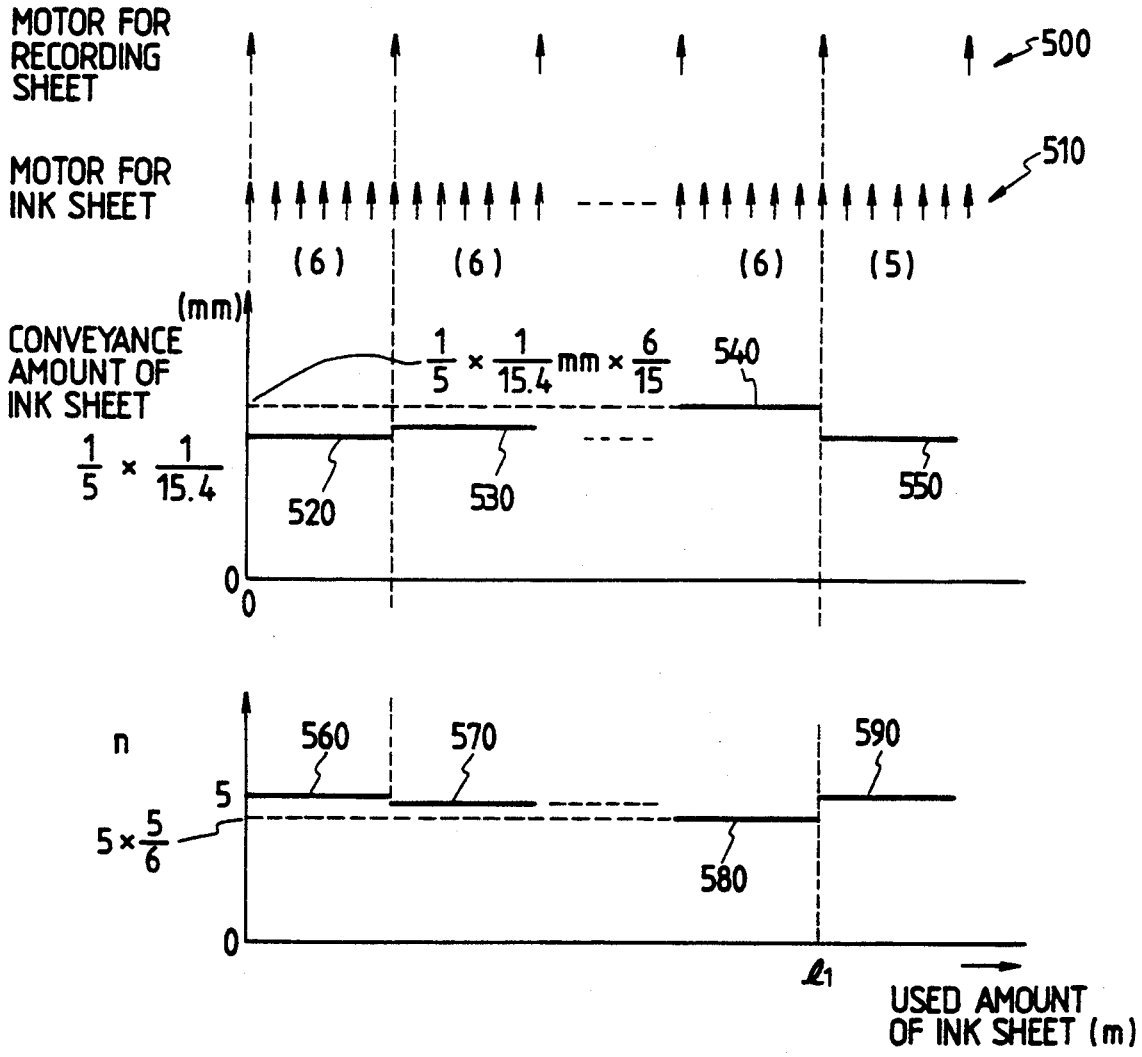
FIGS. 5A and 5B are charts showing a variation in conveyance amount of an ink sheet with respect to a driving step of a motor for an ink sheet.

The gear ratio of the gears 26 and 27 is determined so that the ink sheet 14 is conveyed by 1/n (n=5) of 1/15.4 mm by six steps of the 1–2 phase excitation of the motor 25. FIG. 5A shows the relationship between the conveyance amount of the recording paper 11 and an n value representing the conveyance amount of the ink sheet 14 in this case.

In FIG. 5, 500 designates an excitation timing of the motor 24, and 510 designates an excitation timing of the motor 25. 520 to 550 respectively designate lengths of the ink sheet 14 while the recording paper 11 is conveyed by one line (1/15.4 mm), and 560 to 590 designate variations in n value accordingly. As can be seen from FIG. 5, as the length of the ink sheet 14 used is increased and as the diameter of the take-up roller 18 is increased, the conveyance amount of the ink sheet 14 with respect to the predetermined rotational angle of the motor 25 is increased, and the n value is decreased accordingly. As a result, use efficiency of the ink sheet 14 is decreased.

520 designates a use start point of the ink sheet 14. When the motor 25 is excited six times, the ink sheet 14 is conveyed by the defined amount ((1/5×1.15.4)mm). Thereafter, the conveyance amount of the ink sheet 14 according to the predetermined rotating amount of the motor 25 is gradually increased as the diameter of the take-up roller 18 is increased. When the conveyance amount reaches a value 6/5 times of the defined amount (corresponding to a used amount $l_1$m of the ink sheet), the ink sheet 14 is excited by 5 steps in correspondence with the one-line conveying operation of the recording paper 11. The ink sheet 14 can be conveyed by the defined amount (1/5×1/15.4), as designated by 550.

560 to 590 (FIG. 5B) designate n values (1/n line for one line of the recording paper) in correspondence with the conveyance amount of the ink sheet 14. The n value 580 is smallest (5×5/6) in correspondence with the length 540, i.e., the use efficiency is the lowest. When the used amount of the ink sheet 14 reaches $l_1$m, the excitation count of the motor 25 is set to be 5, so that the n value can be restored to "5". In this manner, the conveying operation of the ink sheet 14 is controlled so that a point where even if the number of steps for driving the motor 25 is decremented by one, the conveying distance of the ink sheet 14 does not become equal to or smaller than 1/5×1/15.4 mm is obtained, and n always becomes "5".

A method of obtaining an excitation switching timing using the disc 34 for indicating the take-up state of the ink sheet 34 will be described below.

Assume that the maximum value of n is represented by N (e.g., 5), and the excitation count of the motor 25 which is excited every time the recording paper is conveyed by one line is represented by S (e.g., 6). In an ith conveying operation of the recording paper 11 (in a conveying operation of the ink sheet 14), if the n value when the excitation count of the motor 25 is decremented by one is represented by $n_i$, $n_i$ is given by:

$$n_i = N \cdot \frac{S - i}{S - r + 1} \quad (1)$$

In this case, if the conveyance amount for one line of the recording paper 11 is represented by $\Delta l_P$, it is given by:

$$\Delta l_P = NSr_0\theta = n_i(S-i+1)r_i\theta$$

where $r_0$ is the core radius of the ink sheet take-up roller 18, and $r_i$ is the radius of the ink sheet take-up roller 18 when the number of steps is changed in an ith operation, and $\theta$ is the rotational angle per step of the ink sheet take-up roller 18. Thus, $r_i$ is given by:

$$r_i = \frac{N}{n_i} \cdot \frac{S}{S - i + 1} \cdot r_0$$

When equation (1) is substituted in this equation, $$r_i = \frac{S \cdot r_0}{S - i}$$

Therefore, a rotational angle R of the disc 34 indicating the take-up amount of the ink sheet 14 is expressed by:

$$R = \frac{r_i - r_0}{te} = \frac{2\pi r_0}{te} \cdot \frac{i}{S - i} \text{ (rad)}$$

where e is the ratio (deceleration ratio) of the rotational speeds of the disc 34 and the shaft 18*a* of the ink sheet take-up roller 18, and t is the thickness of the ink sheet 14.

When the conveying operation of the ink sheet 14 is started with N=5 and S=6 and the number S of steps is changed from 6 to 3, if $r_0$=19 mm, t=11 μm, and e=2,073 in the above equation, (1) if i=1, R≃60°. In this case, S is changed from 6 to 5, and n is changed from 25/6 to 5.

(2) if i=2, R≃150°. In this case, S is changed from 5 to 4, and n is changed from 4 to 5.

(3) if i=3, R≃300°. In this case, S is changed from 4 to 3, and n is changed from 15/4 to 5.

More specifically, when R falls within the range of 0° to 60° the ink sheet 14 is conveyed by six steps per line of the recording paper 11; when R=60° to 150°, five steps per line; when R=150° to 300°, four steps per line; and when R=300° or more, three steps per line, so that the n value can be suppressed between 5 and 15/4.

FIGS. 6A to 6D show the rotational positions of the disc 34 for indicating the take-up amount of the ink sheet 14, and a method of detecting the rotational position.

Figure 6A:
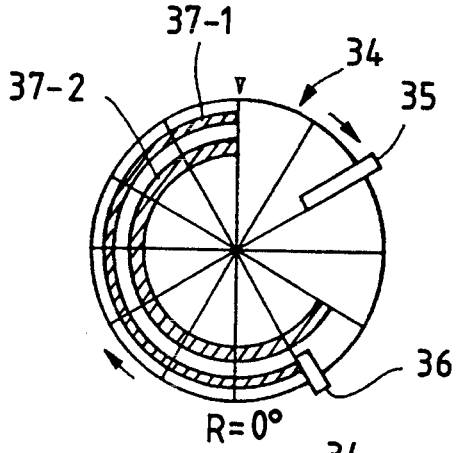
FIGS. 6A to 6D are views showing rotational positions of a disc for indicating a rotating amount of a take-up roller.
Figure 6B:
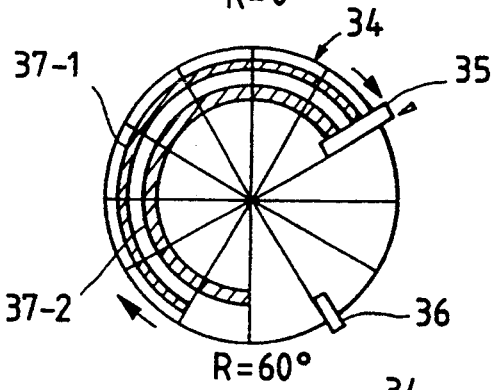

FIG. 6A shows a case wherein the rotational angle R="0°". In this case, neither the sensors 35 nor 36 detect the slits 37-1 and 37-2. FIG. 6B shows a state wherein the rotational angle R="60°". In this case, the sensor 35 detects the slits 37-1 and 37-2. Therefore, it can be determined that an interval from when both the sensors 35 and 36 are OFF until only the sensor 35 is turned on corresponds to the range of the rotational angle R of 0° to 60°. In the case of FIG. 6B, the conveying distance of the ink sheet 14 is $l_1$ from FIG. 5. FIG. 6B shows a state wherein the rotational angle R="150°". In this case, the sensor 35 detects the slits 37-1 and 37-2, and the sensor 36 detects the slit 37-1, so that both the sensors 35 and 36 are ON. Therefore, an interval from when only the sensor 35 is turned on until the sensor 36 is turned on can be detected as the range of the rotational angle R of 60° to 150°.

Figure 6C:
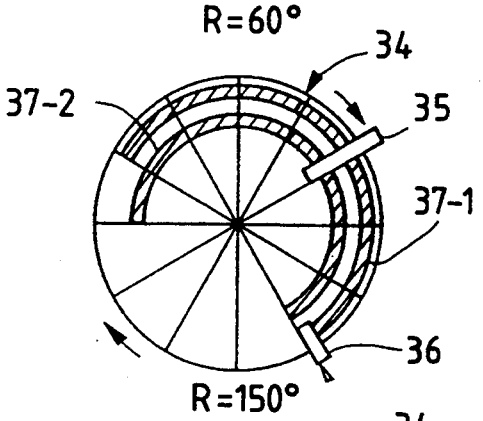
Figure 6D:
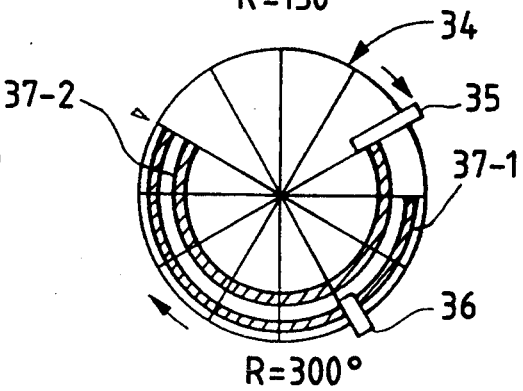

FIG. 6D shows a state wherein the rotational angle R="300°". In this case, only the sensor 36 is ON. Therefore, an interval from when both the sensors 35 and 36 are ON until only the sensor 36 is ON can be detected as the range of the rotational angle R of 150° to 300°. When only the sensor 36 is ON, it can be detected that R=300° or more. Note that the disc 34 is returned to the initial position shown in FIG. 6A when the ink sheet 14 is exchanged. In this manner, the rotational angle=60°, 150°, and 300° of the disc 34 is detected on the basis of the above-mentioned equations, and the number of steps of the motor 25 is updated based on the calculation result, so that the conveyance amount of the ink sheet 14 with respect to one-line conveying operation of the recording paper 11 can be kept almost constant (n=5 or less).

Conveying processing of the ink sheet 14 by the control unit 101 on the basis of the rotational angle R of the disc 34 will be described below with reference to FIGS. 7A and 7B.

Figure 7A:
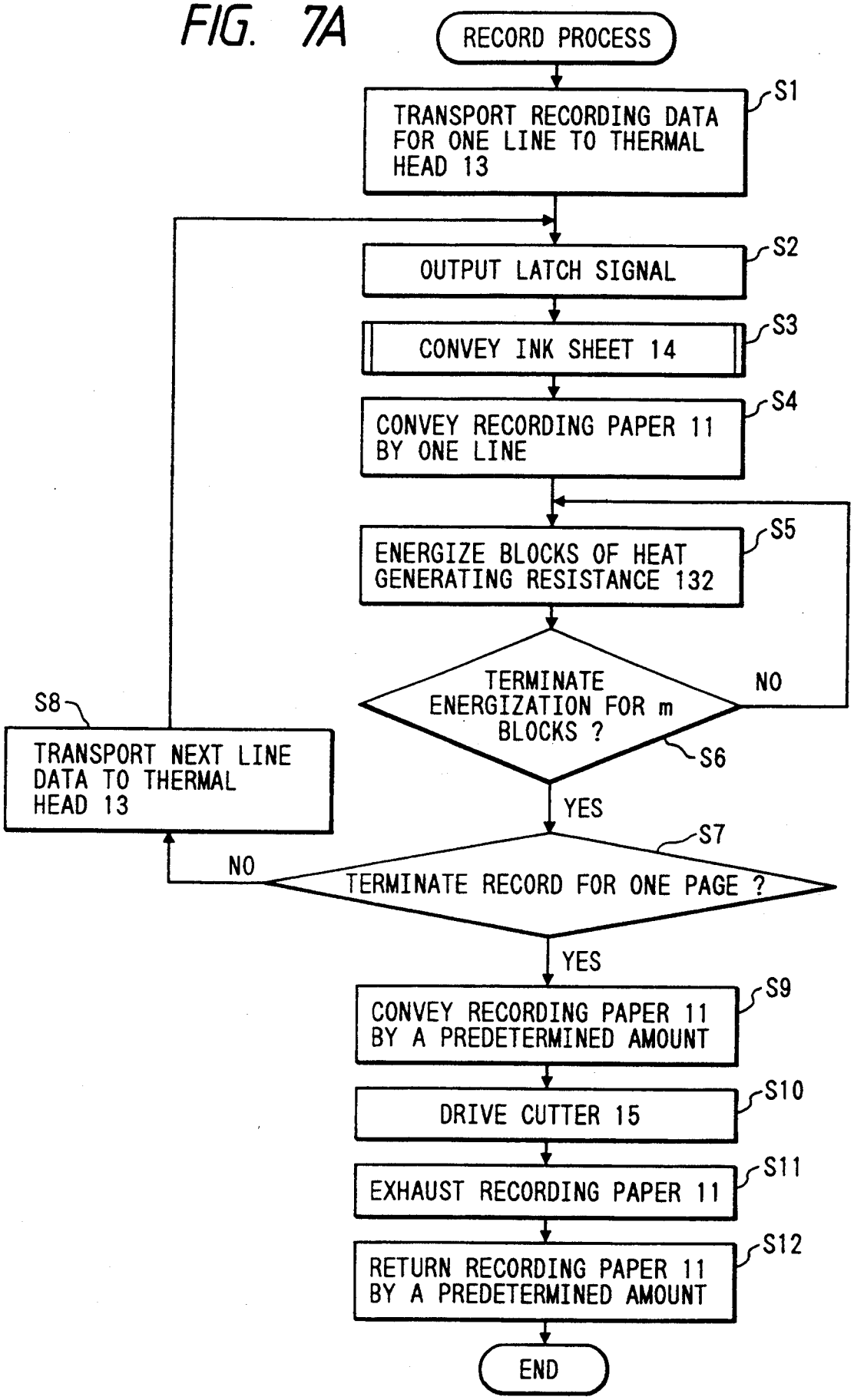
FIGS. 7A and 7B are flow charts showing recording processing of the embodiment.
Figure 7B:
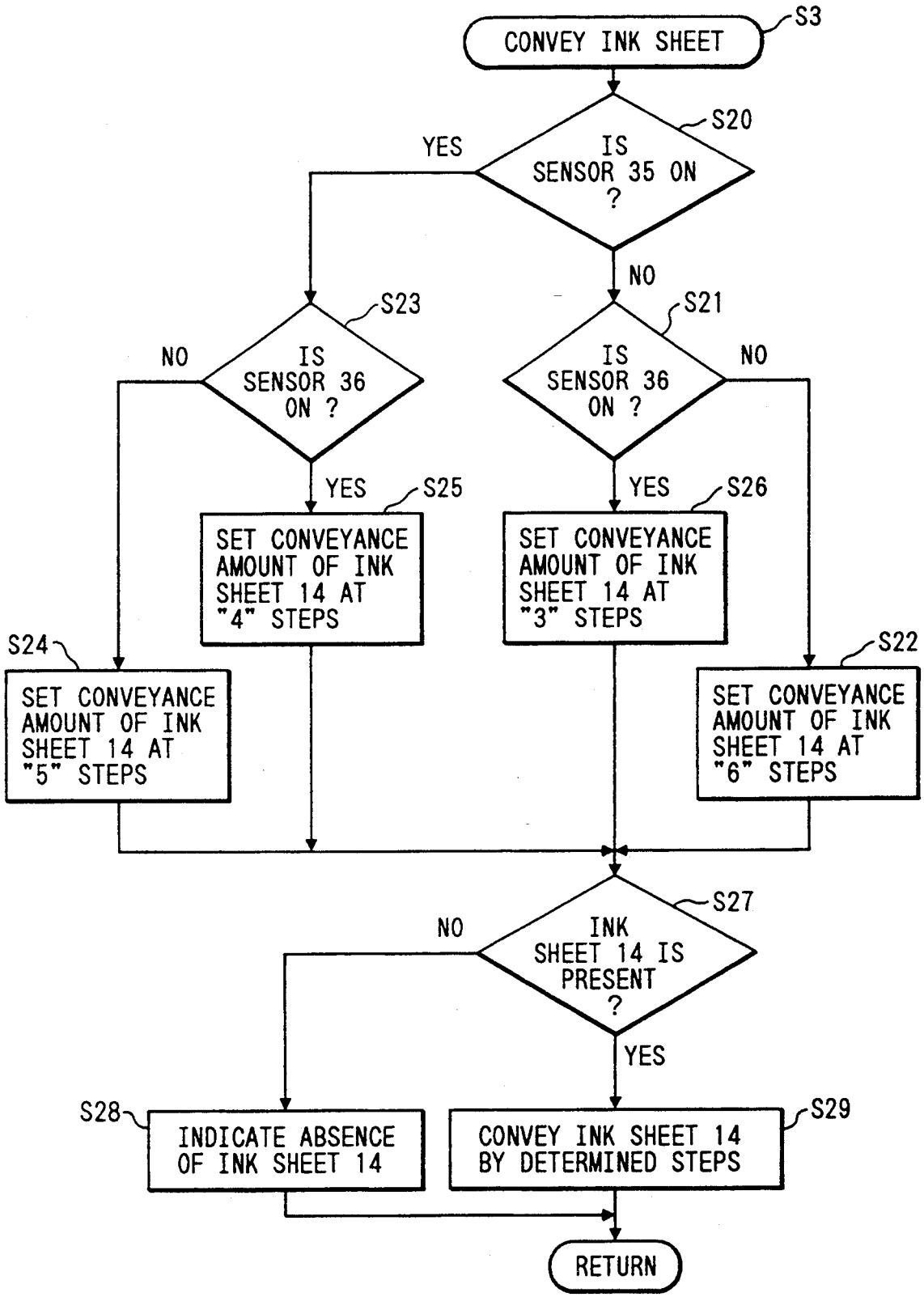

FIGS. 7A and 7B are flow charts of image recording processing for one page in the facsimile apparatus of this embodiment. The control program for executing this processing is stored in the ROM 114 of the control unit 101.

This processing is started when one-line image data is stored in the line memory 110 and the image recording operation is ready. In step S1, recording data for one line is serially output to the shift register 130. Upon completion of transportation of one-line recording data, the latch signal 44 is output in step S2, so that the one-line recording data is stored in the latch circuit 131. In step S3, the number of steps of the motor 25 is calculated on the basis of the rotating amount of the disc 34, and the ink sheet 14 is conveyed by a (1/n) line of the recording paper 11 in the direction of the arrow a in FIG. 2. The conveying processing of the ink sheet 14 will be described later with reference to the flow chart of FIG. 7B.

In step S4, the motor 24 is driven to convey the recording paper 11 by one line in the direction of the arrow b. The one-line length corresponds to a length of one dot recorded by the thermal head 13. The flow advances to step S5, and blocks of the heat generating elements 132 of the thermal head 13 are energized. It is checked in step S6 if all the m blocks are energized. If YES in step S6, i.e., if it is determined that all the blocks of the heat generating elements 13 are energized and one-line image recording is completed, the flow advances to step S7 to check if one-page image recording is completed. If NO in step S7, i.e., if it is determined that one-page image recording is not completed, the flow advances to step S8, and recording data for the next line is transported to the thermal head 13. The flow then returns to step S2.

If YES in step S7, i.e., if it is determined that one-page image recording is completed, the flow advances to step S9, and the recording paper 11 is conveyed by a predetermined amount in the direction of the discharge rollers 16*a* and 16*b*. In step S10, the cutters 15*a* and 15*b* are driven to be engaged, so that the recording paper 11 is cut to a page length. In step S11, the cut recording paper 11 is discharged by the discharge rollers 16*a* and 16*b* to the outside of the apparatus. In step S12, the remaining recording paper 11 is returned by a distance corresponding to an interval between the thermal head 13 and the cutters 15*a* and 15*b*, thus completing one-page recording processing.

As shown in steps S3 and S4, the conveyance drive operation of the motor 25 is preferably performed prior to that of the motor 24. Even if the motor 25 is driven, a delay time is caused by characteristics of the motor or the characteristics of the drive transmission system until the conveying operation of the ink sheet 14 is actually started. If the motor 24 is driven first, the same effect can be obtained. However, if a time interval between the beginning of the conveying operation of the recording paper 11 and the beginning of the drive operation of the thermal head 13 (recording operation in step S4) becomes too much, a gap may be undesirably formed between recorded dots.

In the cutting processing of the recording paper 11 by the cutters 15*a* and 15*b* in steps S9 to S12, the ink sheet 14 may be conveyed at the speed $V_P/n$ in the direction opposite to the recording paper 11 when the recording paper 11 is conveyed, or may be conveyed with an increased n value. Furthermore, the ink sheet may be conveyed in the same manner as in the recording paper 11 or may be stopped in position.

FIG. 7B is a flow chart showing ink sheet conveying processing in step S3 of FIG. 7A.

It is checked in step S20 if the sensor 35 is ON. If NO in step S20, the flow advances to step S21 to check if the sensor 36 is ON. If both the sensors 35 and 36 are OFF, this indicates that the rotational angle R falls within the range of 0° to 60° (FIG. 6A), and the flow advances to step S22. In step S22, the number of drive steps of the motor 25 with respect to a one-line conveying operation of the recording paper 11 is set to be "6". On the other hand, if YES in step S21, i.e., it is determined that the sensor 36 is ON, this indicates that the rotational angle R exceeds 300°, as shown in FIG. 6D, the number of drive steps of the motor 25 is set to be "3".

If YES in step S20, i.e., if it is determined that the sensor 35 is ON, the flow advances to step S23 to check if the sensor 36 is ON. If NO in step S23, since the rotational angle R falls within the range of 60° to 150°, the flow advances to step S24, and the number of drive steps of the motor 25 is set to be "5". On the other hand, if it is determined in step S23 that the sensor 36 is ON, since the rotational angle falls within the range of 150° to 300°, as shown in FIGS. 6C and 6D, the flow advances to step S25, and the number of steps of the motor 25 is set to be "4".

In this manner, the flow advances to step S27 to detect the presence/absence of the ink sheet 14 by the ink sheet sensor 19. If the ink sheet 14 is absent, the flow advances to step S28, and the indicating unit 104 is caused to indicate the absence of the ink sheet. However, if the ink sheet 14 is present, the flow advances to step S29, the motor 25 is rotated by the number of steps set in step S22 or in one of steps S24 to S26 to convey the ink sheet 14 by a 1/n line with respect to the one-line conveying operation of the recording paper 11.

In this manner, according to this embodiment, the ink sheet can be conveyed with on almost constant n value regardless of a change in diameter of the ink sheet take-up roller 18.

(Description of Second Embodiment (FIGS. 8 to 10B))

Figure 8:
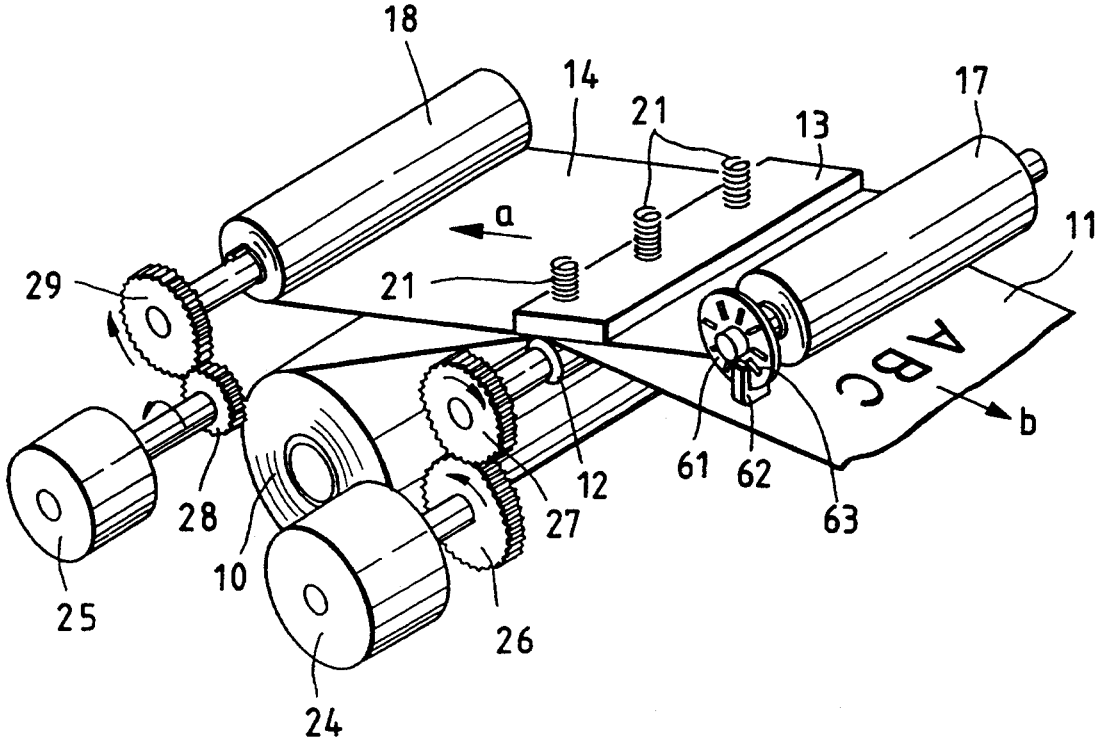
FIG. 8 is a perspective view showing a conveying system of an ink sheet and recording paper according to a second embodiment.

FIG. 8 is a perspective view showing an arrangement of a conveying mechanism system of recording paper and an ink sheet according to a second embodiment. The same reference numerals in the second embodiment denote the same parts as in the first embodiment.

In this embodiment, an encode disc 61 having slits is arranged at a rotating shaft of a supply roller 17 for an ink sheet 14, and its rotation is detected by a photointerrupter 62 to detect rotation of the supply roller 17. Assume that the core diameter of both a take-up roller 18 and the supply roller 17 is represented by $r_0$, the present diameter of the take-up roller 18 is represented by $r_i$, and the roll diameter of the supply roller 17 is represented by $r_a$. In this case, if the total length of the ink sheet 14 wound around the take-up roller 18 is represented by l, the thickness of the ink sheet 14 is represented by t, and the total length of the ink sheet 14 is represented by L, $r_i$ and $r_a$ are respectively given by:

$$r_i = \sqrt{(lt/\pi) + r_0^2}$$

$$r_a = \sqrt{\{(L - l)t/\pi\} + r_0^2}$$

From these equations, $r_i^2+r_a^2=(Lt/\pi)+2r_0^2$ is established, and rewritten as:

$$r_a = \sqrt{(Lt/\pi) + 2r_0^2 - r_i^2} \quad (2)$$

If a rotational angle per unit step of the ink sheet take-up roller 18 is represented by $\theta_0$, and a rotational angle per unit step of the ink sheet supply roller 17 is represented by $\theta_1$, since the feed and take-up amounts of the ink sheet 14 are equal to each other, $r_i\theta_0=r_a\theta_1$, and therefore, $$\begin{aligned}\theta_1 &= r_i \cdot \theta_0/r_a \\ &= r_i \cdot \theta_0/\sqrt{(Lt/\pi) + 2r_0^2 - r_i^2}\end{aligned}$$

A conveyance amount $\Delta l_P$ of the recording paper 11 per line is expressed by $\Delta l_P=N.S.r_0.\theta_0$. N is the rate of the conveying distance of the ink sheet 14 with respect to the one-line conveying distance of the recording paper 11, as described above, and N=5 in this embodiment. S is the number of drive steps of a motor 25 for conveying the ink sheet, which is required for conveying the ink sheet 14 by a 1/N line.

Figure 9:
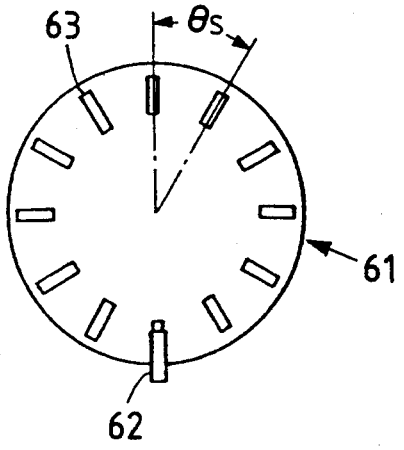
FIG. 9 is a view showing an outer appearance of an encode disc.

As shown in FIG. 9, if an angle corresponding to two adjacent ones of a plurality of slits 63 formed in the encode disc 61 is represented by $\theta_s$, the number s of steps required for $\theta_s$ revolution of the supply roller 17 is given by:

$$\begin{aligned}s &= \theta_s/\theta_1 \\ &= \sqrt{(Lt/\pi) + 2r_0^2 - r_i^2} \times \theta_s/r_i\theta_0\end{aligned}$$

$\theta_0=\Delta l_P/N.S.r_0$ is substituted in this equation:

$$s = (\sqrt{(Lt/\pi) + 2r_0^2 - r_i^2/r_i}) \times \theta_s \cdot N \cdot S \cdot r_0/\Delta l_p$$

Since $r_i=S.r_0/(S-i)$, $$s = (\sqrt{(Lt/\pi) + 2r_0^2 - (S \cdot r_0/(S - i))^2} \times \theta_s \cdot N \cdot (S - i)/\Delta l_p$$

If $\theta_s=\pi/6$, $\Delta l_P=1/15.4$ mm, $r_0=9.5$ mm, L=100 m, t=11 μm, N=5, and S=6, (1) If i=1, s=4035. In this case, the number S of steps is changed from 6 to 5. Thus, n is changed from 25/6 to 5.

(2) If i=2, s=2918. In this case, the number S of steps is changed from 5 to 4. Thus, n is changed from 4 to 5.

(3) If i=3, s=1575. In this case, the number S of steps is changed from 4 to 3. Thus, n is changed from 15/3 to 5.

A description will be made with reference to the perspective view of FIG. 8. The ink sheet 14 is fed from the supply roller 17, and is taken up by the take-up roller 18. The take-up roller 18 is driven by the motor 25. In this case, the number of steps of the motor 25 necessary for rotating the encode disc 61 by $\theta_s$(e.g., 30°) by rotating the take-up roller 18 is checked, and when this value becomes equal to or smaller than "4035" the motor 25 is driven by five steps with respect to the one-line conveying operation of the recording paper, thus conveying the ink sheet 14.

Similarly, when the number of steps necessary for rotating the encode disc 61 by $\theta_s$ becomes equal to or smaller than "2918" the number s of drive steps of the motor 25 with respect to one line of the recording paper 11 is set to be "4". When the number of steps becomes equal to or smaller than "1575" the number s of drive steps of the motor 25 with respect to one line of the recording paper 11 is set to be "3".

Figure 10A:
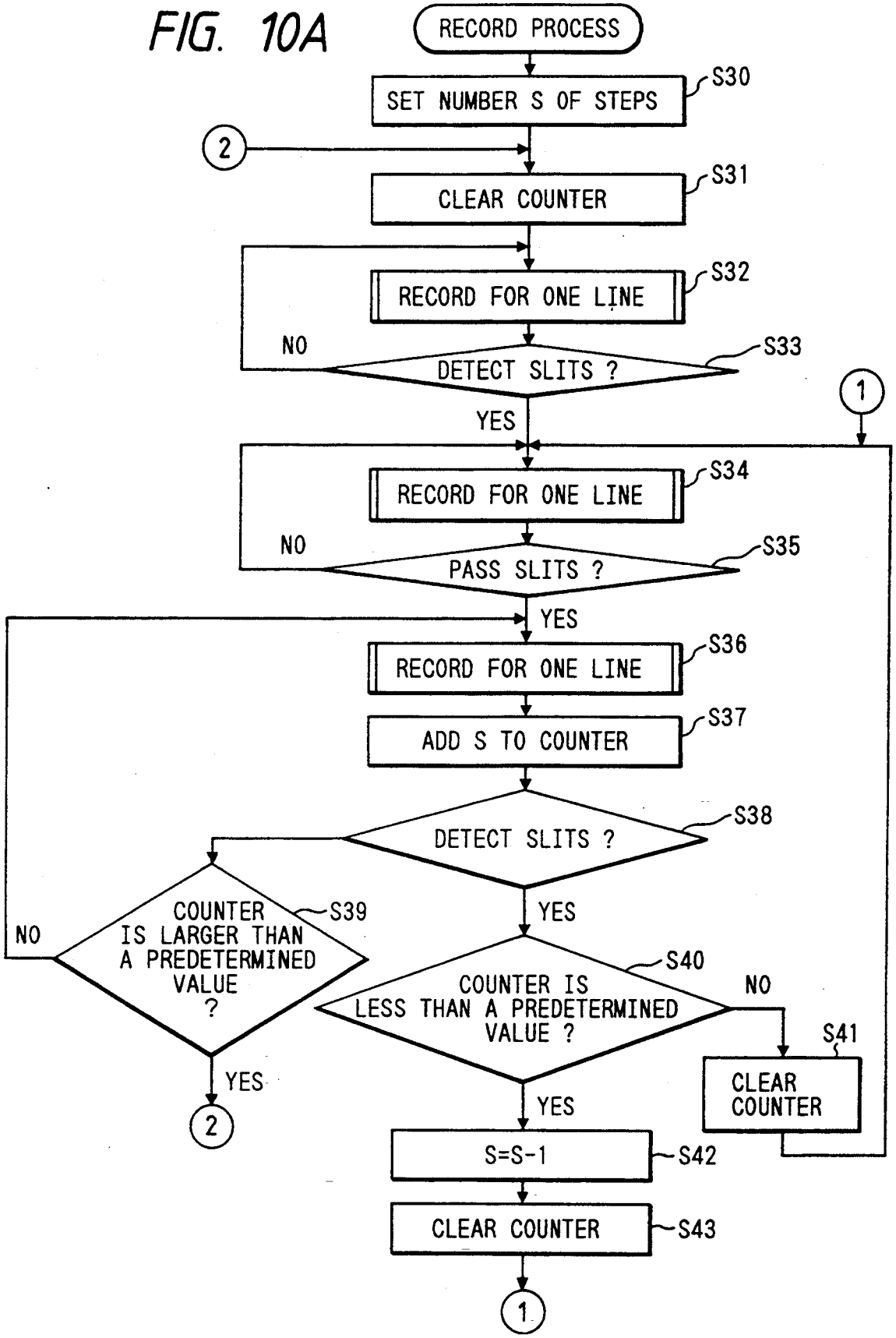
FIGS. 10A and 10B are flow charts showing recording processing of the second embodiment.
Figure 10B:
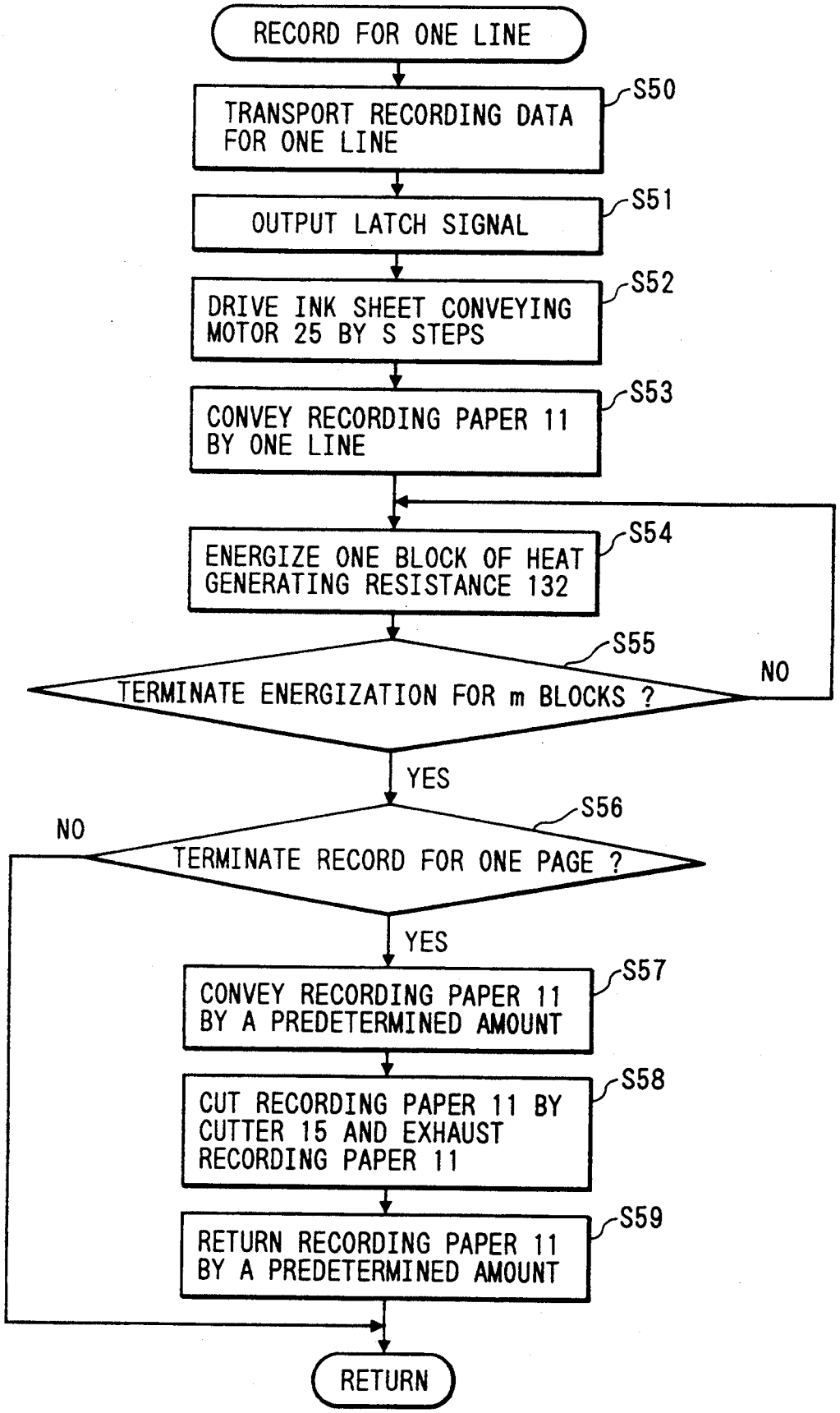

FIGS. 10A and 10B are flow charts showing a recording operation of the second embodiment. This operation is continuously executed from when the ink sheet 14 is loaded until all the ink sheet is fed from the ink sheet supply roller 17.

In step S30, the number S of steps of the motor 25 which is driven for one line of the recording paper 11 is set to be, e.g., "6". In step S31, a counter allocated in a RAM 115 of a control unit 101 is cleared. In step S32, an image for one line is recorded on the recording paper 11. The one-line image recording processing is shown in the flow chart of FIG. 10B. It is checked in step S33 if the slits 63 of the encode disc 61 are detected by the photosensor 62. Steps S32 and S33 are repeated until the slits 63 are detected. In step S34, one-line image recording processing is executed. It is then checked if the slits 63 are completely passed. In these steps S32 to S35, when the ink sheet 14 is loaded, since the positions of the slits 63 with respect to the photosensor 62 are indefinite, the positions of the slits 63 and the photosensor 62 are aligned at the beginning of use.

In this manner, if passage of the slits 63 is detected, the flow advances to step S36, and one-line image recording processing is performed. In step S37, S is added to the content of the counter. It is checked in step S38 if the slits 63 are detected. If NO in step S38, the flow advances to step S39 to check if the content of the counter is equal to or larger than a predetermined value. If NO in step S39, the flow returns to step S36; otherwise, the flow returns to step S31, and the above-mentioned operation is executed. The predetermined value is set to be "4035" when the number S of steps is "6"; it is set to be "1575" when S="5".

If it is determined in step S38 that the slits 63 are detected, the flow advances to step S40 to check if the count value of the counter is equal to or smaller than a predetermined value. If NO in step S40, the flow advances to step S41, and the counter is cleared. Thereafter, the flow returns to step S34. However, if YES in step S40, the flow advances to step S42, and the number S of steps is decremented by 1. In step S43, the counter is cleared, and processing is ended.

FIG. 10B is a flow chart showing one-line recording processing in FIG. 10A.

In this processing, recording data for one line is transported to and latched by a thermal head 13 (steps S50 and S51). In step S52, the motor 25 is driven by the number of steps indicated by S set in step S30 or S42 in FIG. 10A. In step S53, the recording paper 11 is conveyed by one line. In steps S54 and S55, heat generating resistors 132 of the thermal head 13 are energized in units of blocks to perform image recording. In step S56, it is checked if an image recording operation for one page is completed. If NO in step S56, the flow returns to the main routine. However, if YES in step S56, the flow advances to step S57, and the recording paper 11 is conveyed by a predetermined amount. In step S58, the recording paper 11 is cut by cutters 15*a* and 15*b*, and the cut recorded paper 11 is discharged from the apparatus. In step S59, the start portion of the recording paper 11 is returned to the recording position of the thermal head 13 in step S59, thus completing one-line image recording processing.

When the recording paper 11 is conveyed in steps S57 to S59 in this flow chart, the ink sheet 14 may be stopped in position or may be conveyed together with the recording paper 11 as described in the flow chart of FIG. 7B. Thus, the movement of the ink sheet 14 in this case is not particularly limited.

According to the second embodiment, the number of steps of the motor 25 required for rotating the ink sheet supply roller 17 by a predetermined angle is obtained. When the number of steps becomes equal to or smaller than, e.g., 4035, 2918, or 1575, the number of steps for driving the motor 25 is changed from 6 to 5, from 5 to 4, or from 4 to 3. Thus, a variation in feed amount of the ink sheet 14 caused by changes in diameters of the ink sheet take-up roller 18 and the supply roller 17 can be minimized. Since control can be made to regulate the feed amount of the ink sheet 14 with respect to the predetermined feed amount of the recording paper 11, an image can always be recorded at a uniform recording density, and the ink sheet 14 can be efficiently used. In this embodiment, when the ink sheet 14 is exchanged, the number S of steps is set to be an initial value, e.g., "6", and the counter is cleared to "0".

(Description of Third Embodiment (FIGS. 11 to 14))

Figure 11:
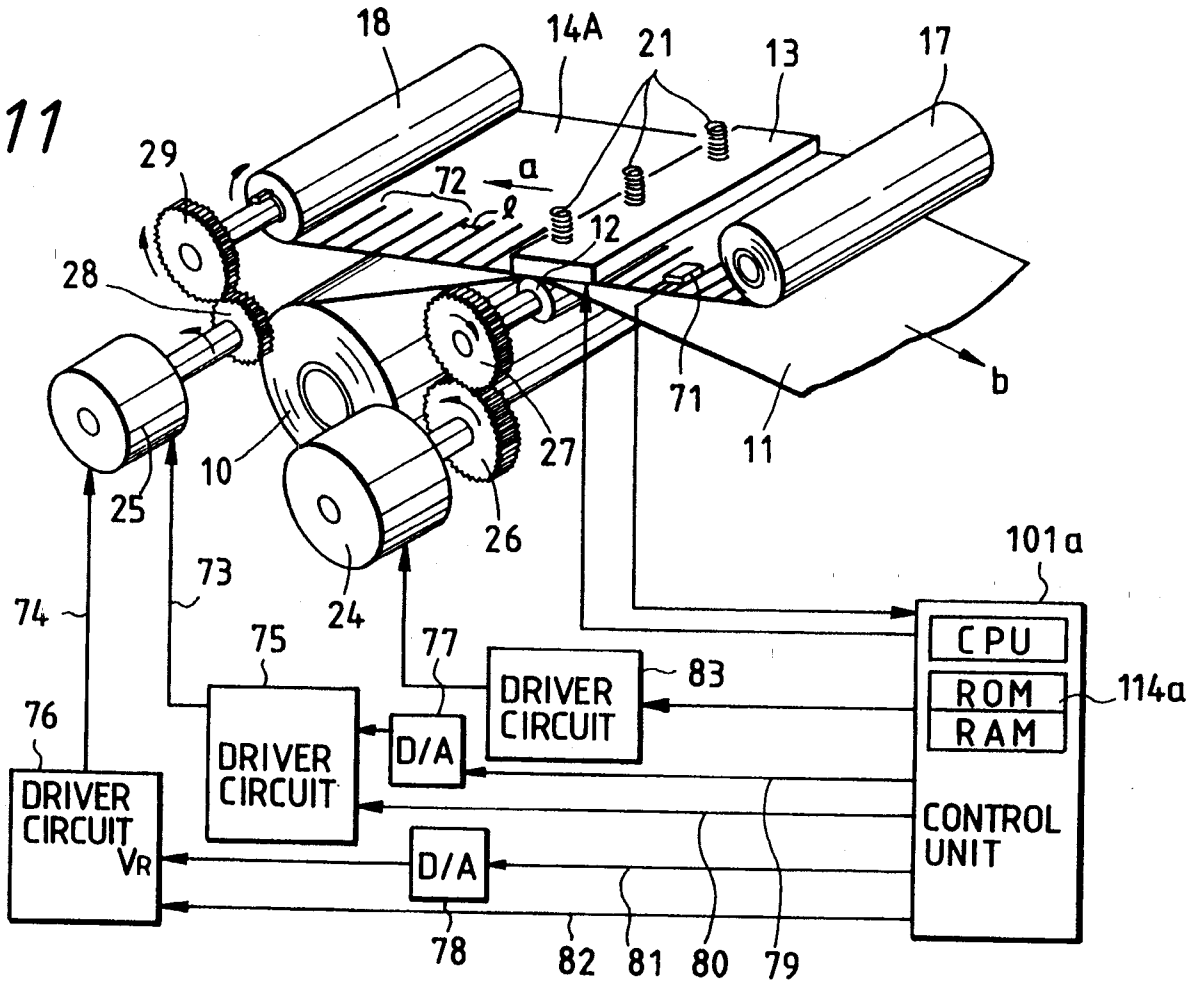
FIG. 11 is a block diagram showing an arrangement of an ink sheet conveying system according to a third embodiment.

FIG. 11 shows an arrangement of a conveying mechanism of recording paper and an ink sheet according to a third embodiment, and the same reference numerals in the third embodiment denote the same parts as in the above embodiments.

Scales 72 are printed at given intervals l over the total length of an ink sheet 14A on a surface, i.e., a lower surface (upper surface in FIG. 11) opposite to an ink-coated surface of the ink sheet 14A. The interval l is sufficiently shorter than the length of A5-sized standard paper, and the scales 72 are read by a photosensor 71. The apparatus shown in FIG. 11 includes a driver circuit 83 for driving a motor 24 for conveying recording paper, a driver circuit 75 for exciting a phase A of a motor 25 for conveying an ink sheet, and a driver circuit 76 for exciting a phase B of the motor 25. D/A converters 77 and 78 respectively receive control signals 79 and 81 from a control unit 101*a* to change drive voltages of the corresponding driver circuits, thus microstep-controlling the motor 25. The control unit 101*a* outputs phase excitation signals 80 and 82 for the phases A and B of the motor 25. In response to the signals 80 and 82, the driver circuits 75 and 76 output signals 73 and 74 for exciting the phases A and B of the motor 25.

Figure 12A:
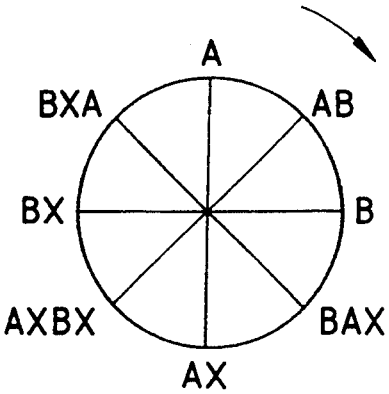
FIGS. 12A and 12B are respectively a vector chart of a two-phase/four-pole motor and a view showing its excitation order.
Figure 12B:
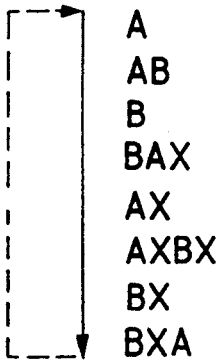

FIG. 12A shows an excitation vector of a two-phase/four-pole stepping motor as the motor 24 or 25. FIG. 12B shows the phase excitation order when this motor is driven by 1–2 phase excitation. In FIG. 12B, an opposite phase of each phase is shown by X. The motor 24 is driven by 1–2 phase excitation shown in FIG. 12B, so that the recording paper 11 is conveyed by one line in response to one excitation pulse.

Figure 13A:
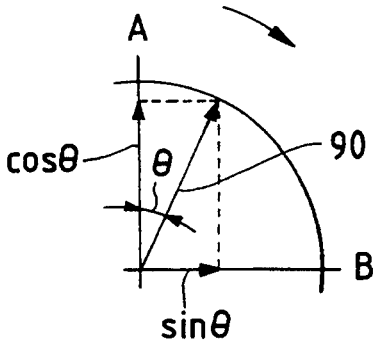
FIG. 13A is a vector chart in a microstep driving mode.

In contrast to this, FIG. 13A shows microstep control used in the drive operation of the motor 25. In order to hold a position 90 of a rotational angle $\theta$, the phase A is obtained upon excitation by a current corresponding to $\cos\theta$, and the phase B is obtained upon excitation by a current corresponding to $\sin\theta$. For example, assuming microsteps for diving one revolution of the motor 25 into 256 sections, a unit angle is $(90/64=360/256)°$. FIG. 13B shows a table of 256 stages in this case.

As in the above-mentioned embodiments, control is made to convey the ink sheet 14A by a (1/n) line with respect to a one-line conveying operation of the recording paper, and an initial value of n at the beginning of use of the ink sheet 14A is set to be "5". As the used amount of the ink sheet 14 is increased with the recording operation, the core diameter of the take-up roller 18 is increased. Even if the take-up roller is rotated by the same amount, the conveying distance of the ink sheet 14A is gradually prolonged, and the n value is gradually decreased. For this reason, processing for restoring n to 5 is required as in the above embodiments. In this embodiment, this processing is performed three times for one roll of the ink sheet.

Control of the motor 25 is made such that 256 stages per revolution are selected while skipping m stages (m is an integer sufficiently larger than the number of control times for restoring n to a predetermined value). An initial value of m is set to be "6" and is decremented to m=5, 4, 3 at a proper timing to obtain a constant n value, so that a rotational angle of the motor 25 per excitation trigger is decreased. In this embodiment, the gear ratios of transmission gears 26 and 27 and gears 28 and 29 are set to satisfy n=5 in the initial state with m=6.

The moving amount of the ink sheet 14A is obtained by detecting the scales 72 by the reflection type photosensor 71. The photosensor 71 is turned on when it detects the scale 72, and is turned off when the motor 25 is driven by one step. The number J of steps for driving the motor 25 is counted from a given scale until the next scale is detected. When the number J becomes smaller than a predetermined value, correction control is performed.

For example, n=5 and the number m of skipped steps=6 are initially set, and J=100 is required for conveying the ink sheet 14A by one scale. As the used amount of the ink sheet 14A is increased, the diameter of the take-up roller 18 is increased. If the rotational angle of the motor 25 remains the same, the conveyance amount of the ink sheet 14A by single excitation operation of the motor 25 is increased. Such an increase appears as a decrease in the number J of steps for conveying the ink sheet 14A by a length corresponding to an interval between adjacent scales. Therefore, when the J value becomes smaller than a predetermined value K (e.g., 80 steps), the m value is decremented by one to decrease the minimum step angle of the motor 25. Thus, since the conveyance amount of the ink sheet 14A by one-step excitation of the motor 25 is decreased, the J value is increased to be approximate to an initial value (e.g., 100), and the n value is restored to a value near "5". In this manner, n can be maintained in a predetermined range.

Figure 14:
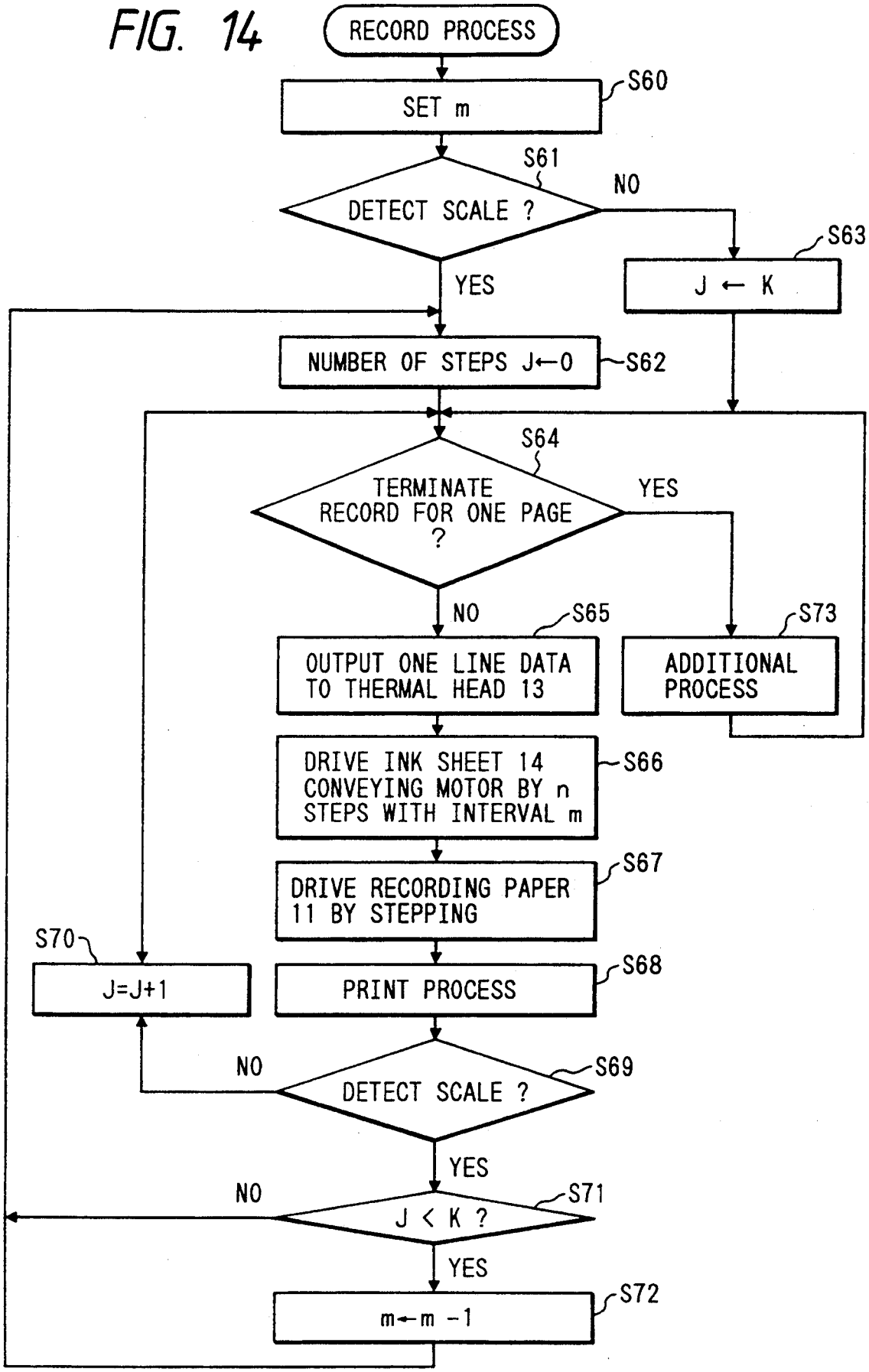
FIG. 14 is a flow chart showing recording processing of the third embodiment.

FIG. 14 is a flow chart showing image recording processing of the third embodiment. A control program for executing this control is stored in a ROM 114*a* of the control unit 101*a*.

In step S60, the number m of skipped steps is set to be a maximum value. This setup operation is performed by outputting predetermined digital values as the control signals 79 and 81 to the D/A converters 77 and 78 and outputting appropriate control voltages from the D/A converters 77 and 78 to the driver circuits 75 and 76. It is checked in step S61 if the scale 72 is detected. If YES in step S61, the flow advances to step S62, and the number J of steps is set to be "0". However, if NO in step S61, the flow advances to step S63, and the K value is set in J. Thereafter, the flow advances to step S64.

It is checked in step S64 if image recording processing for one page is completed. If NO in step S64, the flow advances to step S65, and recording data for one line is transported to the thermal head 13. In step S66, the excitation signals 80 and 82 are output to excite the motor 25 by n steps while skipping m steps. In step S67, the motor 24 is excited by one step to convey the recording paper 11 by one line. The flow advances to step S68, and the thermal head 13 is energized in units of blocks to perform image recording for one line.

In step S69, it is checked if the photosensor 71 detects the scale 72. If NO in step S69, the flow advances to step S70, and J is incremented by one. If YES in step S69, the flow advances to step S71 to check if the J value is smaller than K (=80). If YES in step S71, the output voltages of the D/A converters 77 and 78 are changed to decrement the number m of skipped steps by one in step S72. The flow then returns to step S62. In this manner, when the m value is decreased, the rotational angle per step of the motor 25 is decreased. When the motor 25 is driven by n steps in step S66, the ink sheet 14A is conveyed by a distance shorter than before. When one-page image recording is completed, the flow advances to step S73, additional processing such as cutting, discharging, and the like of recording paper is performed, and the flow returns to step S64.

Note that the m value (output voltage of the D/A converter) is set to be an initial maximum value when the ink sheet 14A is exchanged. The m value will not be restored to an initial value unless the ink sheet 14A is exchanged. The J value is also preset to the K value upon exchange of the ink sheet 14A.

In this embodiment, scales are printed on the lower surface of the ink sheet 14A, and are detected by the photosensor. However, the present invention is not limited to this. For example, the scales may be formed by grooves, and the grooves may be detected by a photointerrupter, a microswitch, or the like. In this embodiment, the motors 25 and 24 comprise the two-phase/-four-pole stepping motors. However, the present invention is not limited to this. For example, the motors may comprise DC motors or servo motors.

In each of the above embodiments, the n value is controlled to be equal to or smaller than the predetermined value. However, the n value may be controlled to fall within the range of $n \pm \alpha$ ($n >> \alpha$) having n as the central value.

In the flow charts shown in FIGS. 7A and 7B, FIGS. 10A and 10B, and FIG. 14, the number of steps or the step angle of the motor 25 is changed regardless of divisions of pages. When a change timing of the number of steps or step angle occurs during image recording of a given page, the number of steps or step angle may be changed after the image recording of the given page is completed. An image on the given page can be recorded at an almost uniform image density.

In the first and second embodiments, the number of drive steps of the motor 25 for conveying the ink sheet is decreased to change the conveyance amount of the ink sheet 14 (14A). In these first and second embodiments, the step angle of the motor 25 may be decreased by microstep driving like in the third embodiment.

(Description of Recording Principle (FIG. 15))

Figure 15:
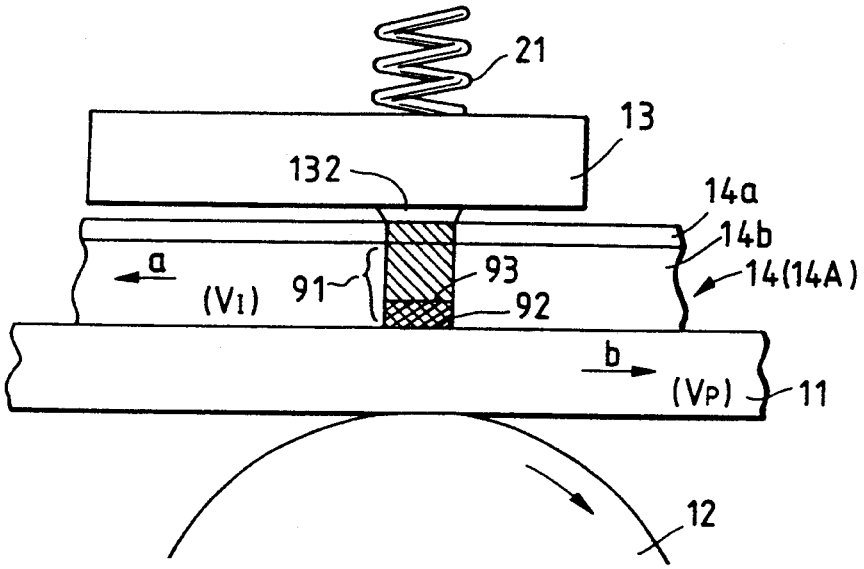
FIG. 15 is a view showing states of recording paper and an ink sheet in a recording mode of the third embodiment.

FIG. 15 shows an image recording state when an image is recorded while the recording paper 11 and the ink sheet 14 (14A) are conveyed in opposite directions.

As shown in FIG. 15, the recording paper 11 and the ink sheet 14 (14A) are clamped between the platen roller 12 and the thermal head 13, and the thermal head 13 is pressed against the platen roller 12 by the springs 21 at a predetermined pressure. The recording paper 11 is conveyed at a speed $V_P$ in a direction of an arrow b upon rotation of the platen roller 12. On the other hand, the ink sheet 14 (14A) is conveyed at a speed $V_I$ in a direction of an arrow a upon rotation of the motor 25 for conveying the ink sheet.

When the heat generating resistors 132 of the thermal head 13 are energized by the voltage source 105 to generate heat, a portion indicated by a hatched portion 91 of the ink sheet 14 is heated. In FIG. 15, the ink sheet 14 (14A) is constituted by a base film 14*a* and an ink layer 14*b*. A portion 92 of an ink of the ink layer portion 91 heated upon energization of the heat generating resistors 132 is transferred onto the recording paper 11. The transferred ink layer portion 92 corresponds to almost 1/n of the thickness of the ink layer.

In the transfer operation, a shearing force with respect to an ink must be generated at a boundary 93 of the ink layer 14*b* to transfer only the portion 92 onto the recording paper 11. However, this shearing force varies depending on the temperature of the ink layer. As the temperature of the ink layer increases, the shearing force tends to decrease. When the heating time of the ink sheet 14 (14A) is shortened, the shearing force in the ink layer is increased. Therefore, if a relative speed between the ink sheet 14 (14A) and the recording paper 11 is increased, an ink layer portion to be transferred can be reliably peeled from the ink sheet 14 (14A).

According to this embodiment, since the heating time of the thermal head 13 in the facsimile apparatus is as short as about 0.6 ms, the ink sheet 14 (14A) and the recording paper 11 are conveyed in the opposite directions to increase the relative speed between the ink sheet 14 (14A) and the recording paper 11.

(Description of Ink Sheet (FIG. 16))

Figure 16:
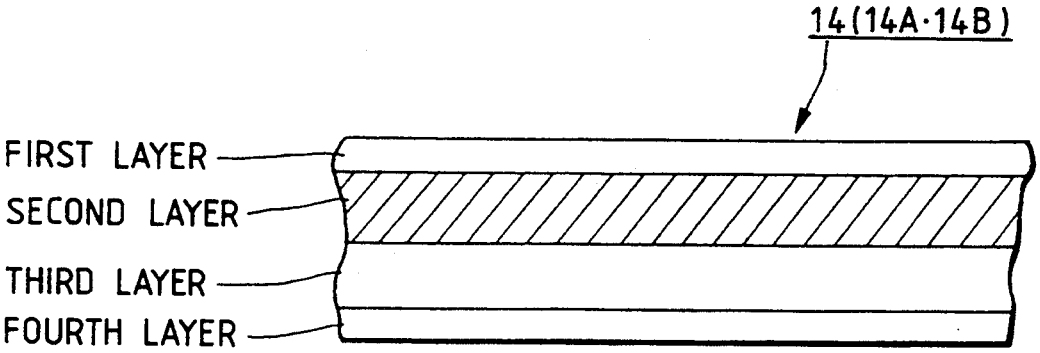
FIG. 16 is a sectional view showing the ink sheet used in the third embodiment.

FIG. 16 is a sectional view of the ink sheet used in a multi-print mode of this embodiment (including embodiments to be described later). The ink sheet has a four-layered structure.

A second layer is a base film as a support member of the ink sheet 14 (14A, 14B). In the multi-print mode, since a heat energy is repeatedly applied to an identical portion, an aromatic polyamide film or capacitor paper having a high heat resistance are advantageously used. However, a conventional polyester film can be satisfactorily used. The thickness of this layer is decreased as much as possible in favor of printing quality since it serves as a medium. However, the thickness preferably falls within the range of 3 to 8 μm in terms of a mechanical strength.

A third layer is an ink layer containing an ink capable of performing n transfer operations to the recording paper 11 (recording sheet). The ink layer contains the following components. That is., a resin such as EVA as an adhesive, carbon black or Nigrosine dye for coloring, a carnauba wax or paraffin wax as a binding material, and the like are mixed as major components to withstand n times of use at a given portion. A coating amount of this mixture preferably falls within the range of 4 to 8 $g/m^2$. A sensitivity or density can vary depending on the coating amount, and the coating amount can be desirably selected.

A fourth layer is a top coating layer for preventing ink in the third layer from being transferred under pressure onto recording paper at a non-printing portion. The top coating layer contains a transparent wax, and the like. Thus, only the fourth layer is transferred under pressure, and background contamination of the recording paper can be prevented. A first layer is a heat-resistant coating layer for protecting the base film as the second layer from heat of the thermal head 13. This layer is suitable for the multi-print mode in which a heat energy for n lines may be repeatedly applied to a given portion (when black data continues). However, it can be selected that this layer may or may not be used. This layer is effective for a base film having a relatively low heat resistance such as a polyester film.

The structure of the ink sheet 14 is not limited to this embodiment. For example, the ink sheet may comprise a base layer and a porous ink holding layer arranged on one surface of the base layer and containing an ink. Alternatively, a heat-resistant ink layer having a microporous net structure may be formed on a base film, and may contain an ink. The example of the material of the base film includes paper or a film consisting of polyimide, polyethylene, polyester, polyvinyl chloride, triacetyl cellulose, nylon, or the like. The heat-resistant coating layer need not always be arranged. The example of the material of this layer includes a silicone resin, an epoxy resin, a fluoroplastic, ethrocellulose, or the like.

An example of an ink sheet having a heat-sublimate ink includes an ink sheet in which a color material layer containing spacer particles formed of a guanamine resin and a fluoroplastic and a dye is formed on a base formed of a polyethylene telephthalate, polyethylene naphthalate, or aromatic polyamide film.

As described above, according to this embodiment, rotation of the ink sheet take-up roller 18 is controlled to obtain an almost constant conveyance amount of the ink sheet 14 with respect to the predetermined conveyance amount of the recording paper 11. Therefore, conveyance control of the ink sheet 14 by the capstan roller and the pinch roller can be omitted, and the mechanism portion of the printer can be simplified.

According to this embodiment, when the ink sheet 14 is exchanged during an operation, the conveyance amount of the ink sheet with respect to the predetermined conveyance amount of the recording paper 11 can still be kept almost constant.

Still another embodiment of the present invention will now be described with reference to FIGS. 17 to 25.

An embodiment to be described below provides a thermal transfer recording apparatus which detects a conveyance amount of an ink sheet corresponding to a predetermined conveyance drive amount of an ink sheet, and when the conveyance amount is different from the drive amount, adjusts the conveyance drive amount of the ink sheet to maintain a constant conveyance amount of the ink sheet, and a facsimile apparatus using the recording apparatus. In embodiments to be described hereinafter, the same reference numerals denote the same parts as the above embodiments, and a detailed description thereof will be omitted.

Figure 17:
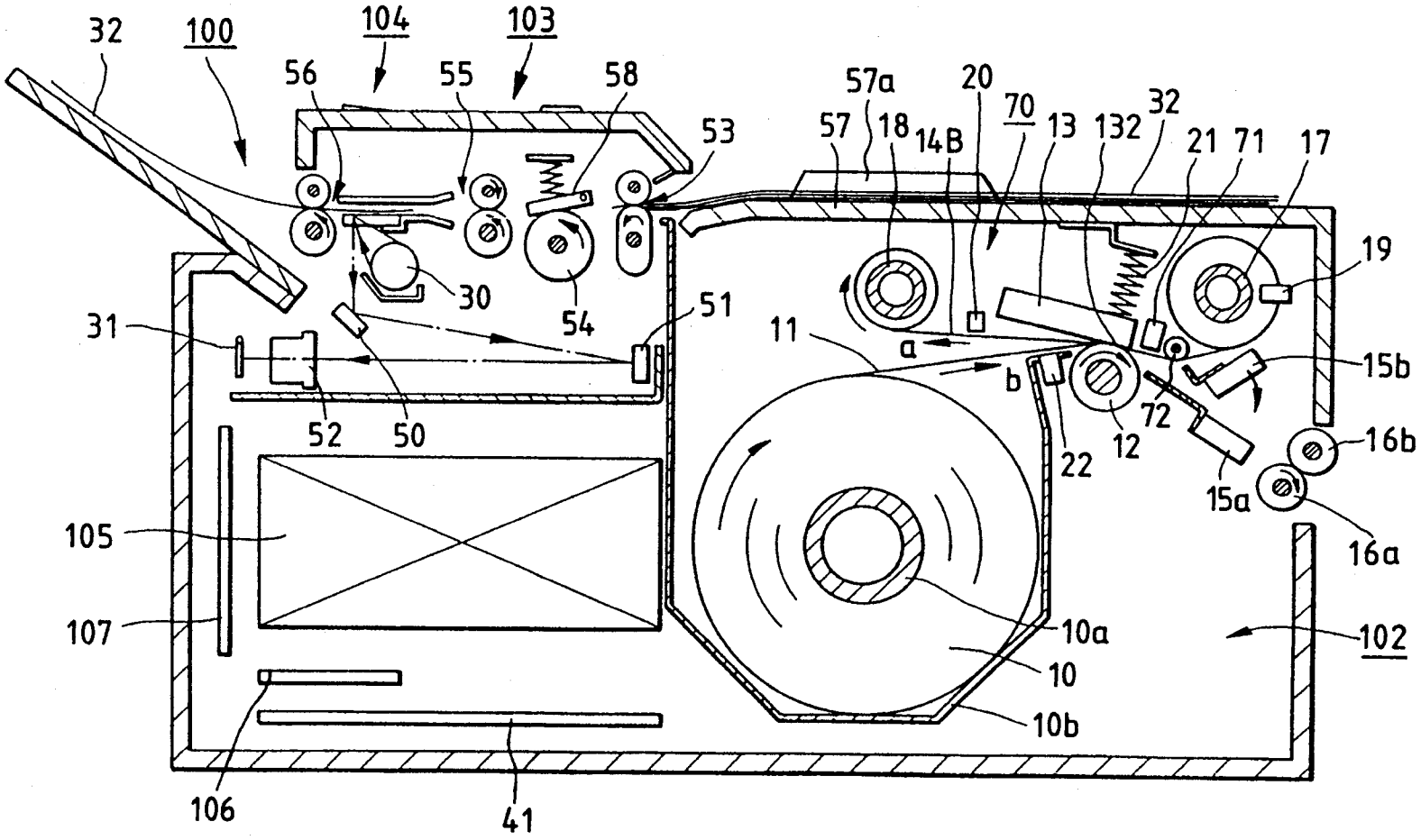
FIG. 17 is a side sectional view showing a mechanism portion of another embodiment of a facsimile apparatus to which the present invention is applied.

FIG. 17 is a side sectional view of a facsimile apparatus to which the embodiment of the present invention is applied. In FIG. 17, a photosensor 71 (to be described later) reads stripes printed on an ink sheet 14B to detect a conveying length of the ink sheet 14B.

This embodiment will be described in detail below with reference to FIG. 18.

Figure 18:
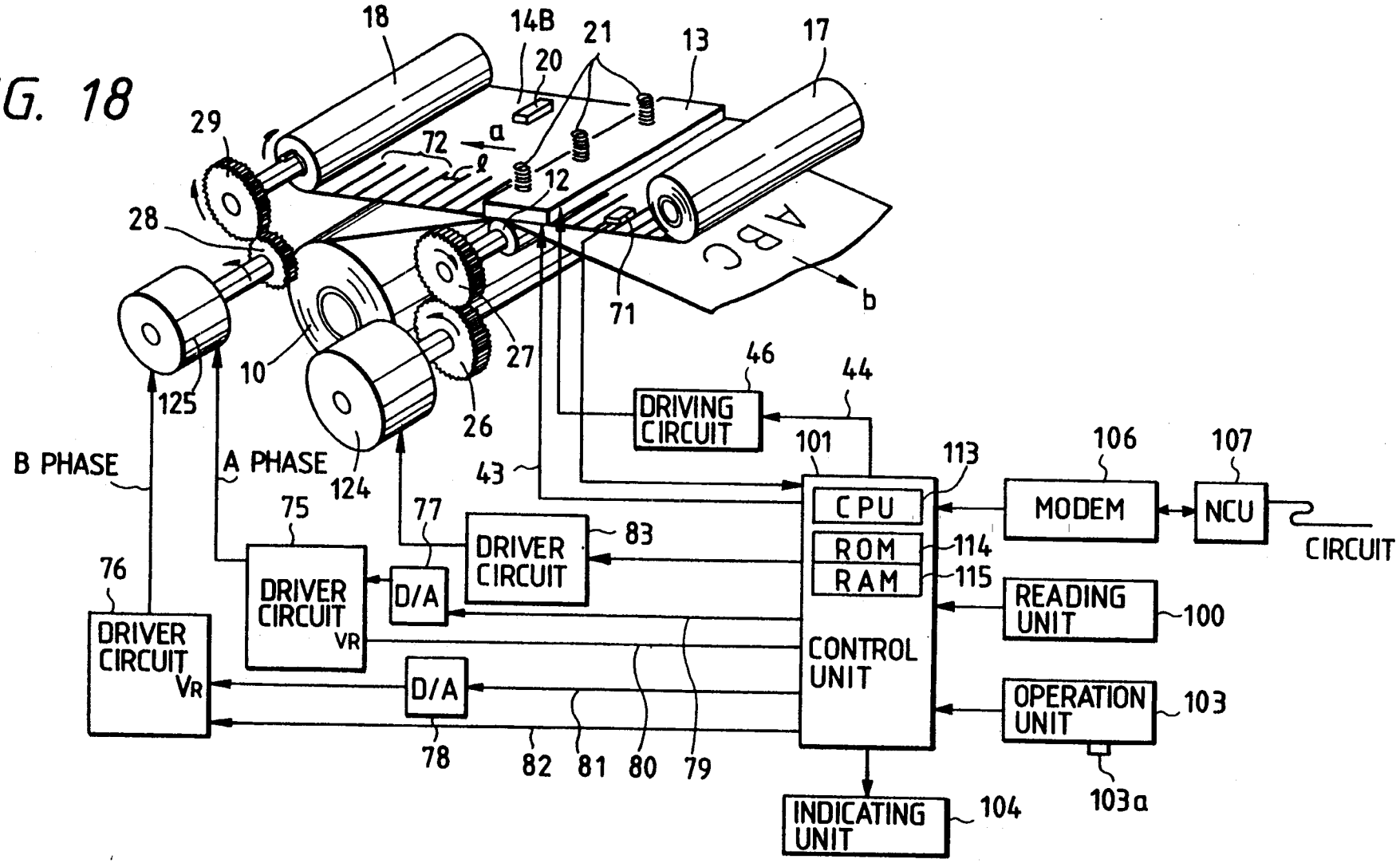
FIG. 18 is a block diagram showing a schematic arrangement of the facsimile apparatus of the embodiment shown in FIG. 17, and a structure of a conveyance drive system of recording paper and an ink sheet.

FIG. 18 shows in detail a conveying system of recording paper 11 and the ink sheet 14B in a recording unit.

In FIG. 18, a thermal head 13 comprises a line head. The thermal head 13 receives serial recording data for one line and a latch signal from a signal line 43, and drives heat generating elements consisting of heat generating resistors 132 in units of a plurality of blocks to perform recording for one line. A driving circuit 46 receives a drive signal for the thermal head 13, and outputs a strobe signal 44 for driving the thermal head 13 in units of blocks.

The photosensor 71 detects stripes 72 printed at predetermined intervals l on a surface (lower surface) opposite to an ink-coated surface of the ink sheet 14B to detect the conveyance amount of the ink sheet 14B. D/A converters 77 and 78 receive digital data from a control unit 101, perform digital-to-analog conversion of the digital data, and output analog data to driver circuits 75 and 76, respectively. A motor 124 for conveying recording paper comprises a stepping motor. A motor 125 for conveying an ink sheet comprises a two-phase/bipolar stepping motor for driving a take-up roller 18 for the ink sheet 14B. A driver circuit 75 excites a phase A of the motor 125, and a driver circuit 76 excites a phase B of the motor 125. These driver circuits 75 and 76 receive reference voltage signals from the corresponding D/A converters 77 and 78, and supply currents corresponding to the input voltages to the corresponding phases of the motor 125 to rotate the motor 125 in a microstep driving mode.

A driver circuit 83 drives the motor 124. Transmission gears 26 and 27 transmit rotation of the motor 124 to a platen roller 12, and transmission gears 28 and 29 transmit rotation of the motor 125 to the take-up roller 18. The motors 124 and 125 comprise stepping motors in this embodiment. However, the present invention is not limited to this. For example, these motors may comprise, e.g., DC motors.

(Description of Motor Driving Method (FIGS. 19 to 21))

FIG. 19 shows the concept of a two-phase/four-pole stepping motor.

When a stepping motor is rotated at a small angle, e.g., in a 1-2 phase excitation mode (half-step control), phases are excited in the order of A→AB→B→BAX→AXBX→BXA→A . . . . In this case, X indicates an opposite phase. In the 1-2 phase excitation mode, the stop positions of a rotor 300 are limited, and rotation control with a further smaller step angle is difficult to achieve.

In contrast to this, FIG. 20 is a view for explaining the principle of a microstep driving mode capable of rotating a stepping motor at a further smaller angle.

When a current corresponding to $i\cos\theta$ is supplied to a phase A and a current corresponding to $i\sin\theta$ is supplied to a phase B, a rotor can be stopped at an arbitrary angle $\theta$, as shown in FIG. 20.

In this embodiment, one cycle (360°) from initial excitation of the phase A until the next excitation of the phase A is divided into 256 stages, and a table representing current values of the phases A and B (digital values to be output to the D/A converters 77 and 78) used when the motor is stopped at stop positions corresponding to the stages is created. FIG. 21 shows this table. When the current value of the phase A is $a_0$ and the current value of the phase B is $b_0$, the rotor 300 is located at the position shown in FIG. 19. When the current value of the phase A is set to be $a_1$ and the current value of the phase B is set to be $b_1$, the rotor 300 is rotated clockwise by (360/256)°. Similarly, when the current value of the phase A is set to be $a_2$ and the current value of the phase B is set to be $b_2$, the rotor 300 is rotated by (360/256)×2°. Similarly, when the current values of the phases are output, the stop position of the rotor 300 can be controlled in units of (360/256)°.

Therefore, the table shown in FIG. 21 is created, and current values are sequentially indicated by a pointer P to convey the ink sheet 14B. In this case, the pointer P is updated by P=P+m. Therefore, when the m value is increased, a step angle rotated by each excitation is increased; otherwise, it is decreased. In this manner, the conveyance amount of the ink sheet 14B can be finely controlled by increasing/decreasing the m value.

The operation of this embodiment will be described below with reference to FIGS. 17 to 24.

Figure 22:
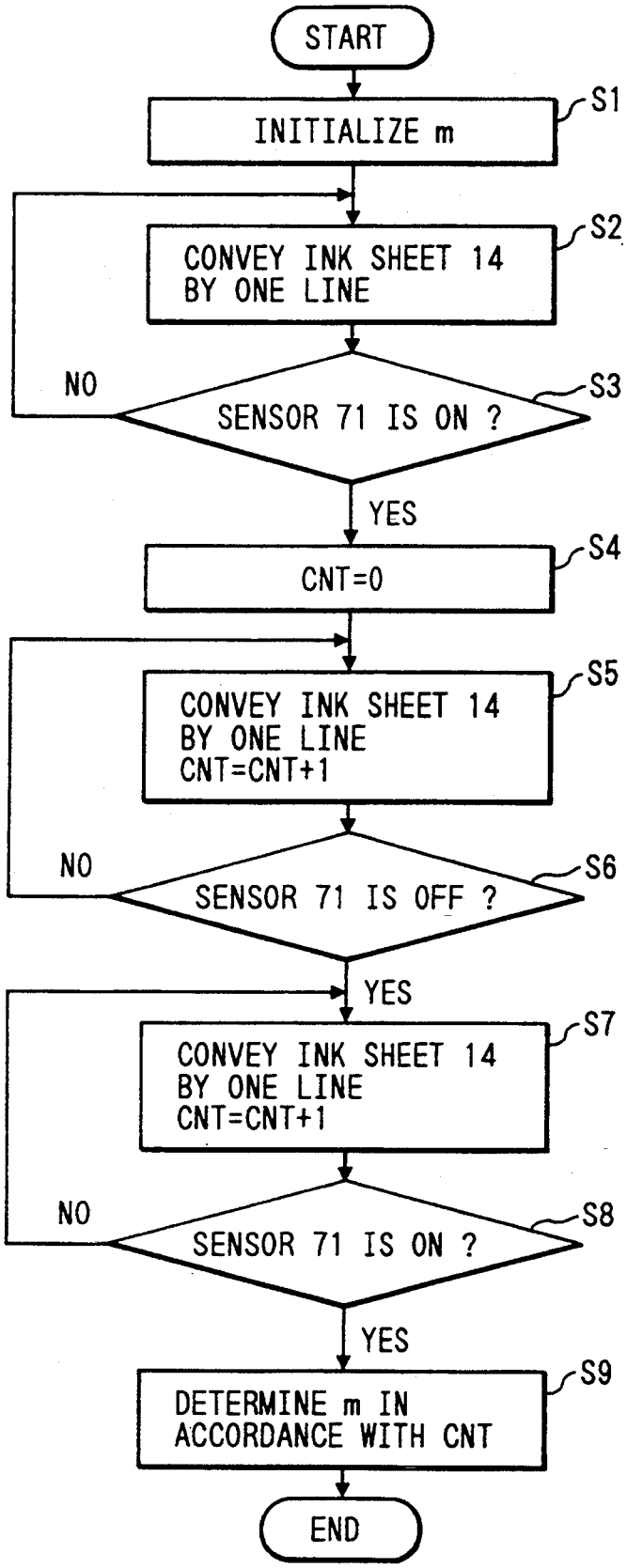
FIG. 22 is a flow chart showing m initialization processing of the embodiment shown in FIG. 17.

FIG. 22 is a flow chart showing an initialization routine for determining the m value in the facsimile apparatus of this embodiment. A control program for executing this program is stored in a ROM 114. This processing is started when a power switch of the apparatus is turned on or when an ink sheet sensor 20 detects loading of the ink sheet 14B.

In step S1, an initial value of m as a skip value indicating the number of skipped current values shown in FIG. 21 is set to be, e.g., "127". The gear ratio of the transmission gears 28 and 29 are set so that a conveying speed of the ink sheet 14B reaches a predetermined value upon excitation of the motor 125. In step S2, the motor 125 is rotated based on the m value set in step S1 to convey the ink sheet 14B by one line in a subscan direction (a direction). It is then checked in step S3 if the photosensor 71 detects the stripe 72. Steps S2 and S3 are repetitively executed until the photosensor 71 detects the stripe. This operation is performed to detect the first stripe of the ink sheet 14B. When the stripe is detected, the flow advances to step S4, and a counter CNT of a RAM 115 is set to be "0".

When a new ink sheet 14B is loaded, this processing can be performed. However, when a used ink sheet 14B is loaded, it is checked after step S1 if the photosensor 71 detects the stripe. If no stripe is detected, processing from step S2 is executed. When the photosensor 71 is located immediately above the stripe and detects the stripe, the ink sheet 14B is conveyed until the photosensor 71 does not detect the stripe. Thereafter, the flow may advance to step S2.

In step S5, the ink sheet 14B is conveyed by one line in the same manner as in step S2, and the counter CNT is incremented by one. It is checked in step S6 if the stripe detected in step S3 is passed. If YES in step S6, the flow advances to step S7. In step S7, the ink sheet 14B is conveyed by one line in the same manner as in step S5, and the counter CNT is incremented by one each time. It is checked in step S8 if the photosensor 71 is ON (the next stripe is detected). Steps S7 and S8 are repetitively executed until the stripe is detected.

The counter CNT counts the number of excitation steps for driving the motor 125 from when the end portion of the first stripe is detected until the end portion of the next stripe is detected. When the end portion of the next stripe is detected, the flow advances to step S9, and the m value is determined on the basis of the content of the counter CNT.

In this embodiment, a rotational angle $\theta_0$ of the support shaft of the ink sheet take-up roller 18 for m=127 is set to be 0.39°. If the interval of the stripes is 4 mm and the radius $r_0$ of the take-up roller 18 is 9.5 mm, a value $C_s$ of the counter CNT when no ink sheet 14B is wound around the take-up roller 18 is given by:

$$C_s = l/r_0 \cdot \theta_0 \simeq 201$$

The value $C_s$ is determined as the number S of reference lines between adjacent stripes. When the ink sheet 14B is wound around the take-up roller 18 to some extent, $C_s < S$ Therefore, the m value which is calculated by $m = (C_s/S) \times 127$ in step S9 is initially set, so that the ink sheet 14B can be conveyed at a predetermined speed regardless of a change in diameter of the take-up roller 18.

Figure 23:
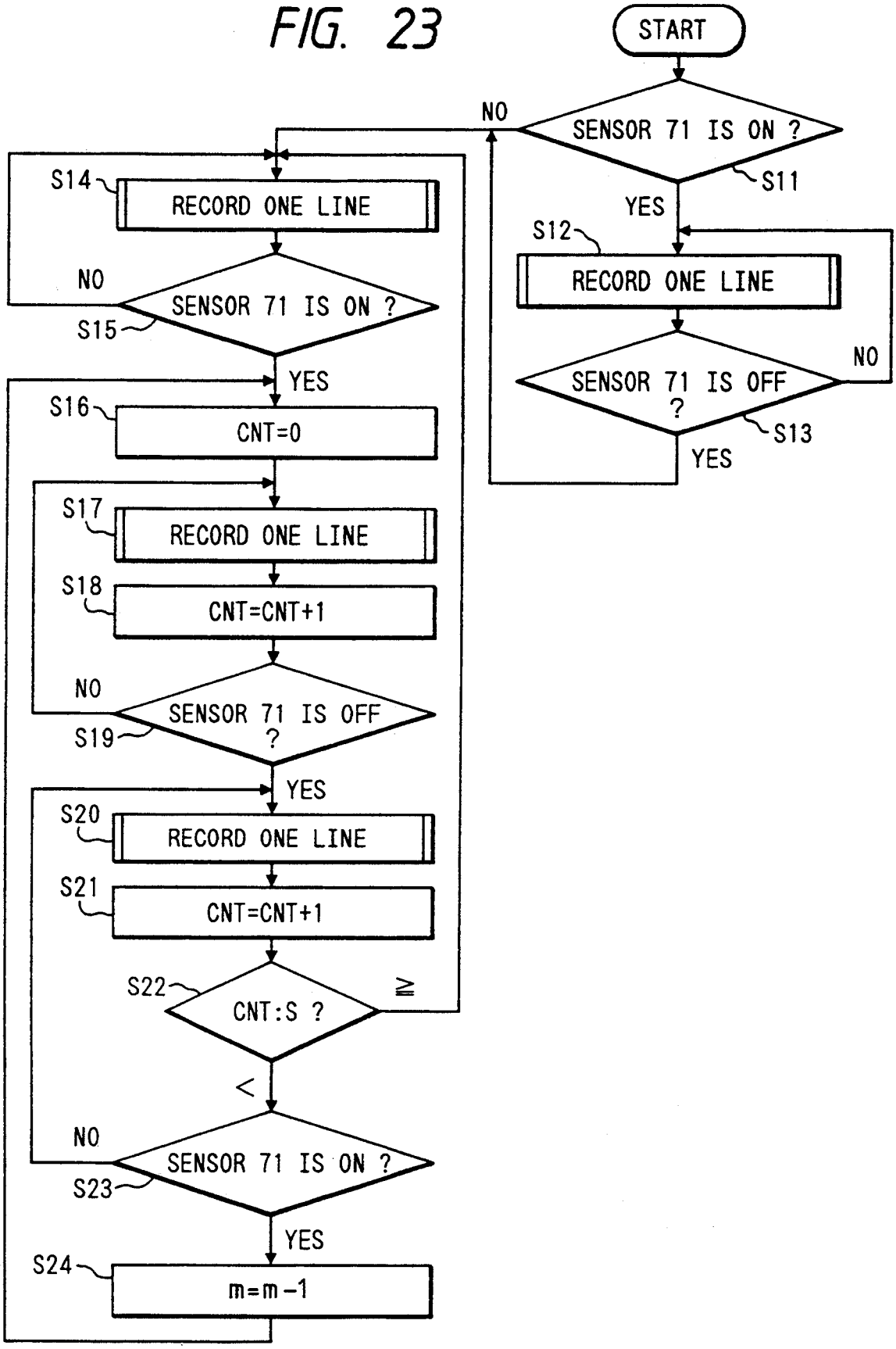
FIGS. 23 and 24 are flow charts showing recording processing of the embodiment shown in FIG. 17.

FIG. 23 is a flow chart showing m changing processing during image recording processing in the facsimile apparatus of this embodiment. A control program for executing this processing is stored in the ROM 114. This processing is executed simultaneously with image recording upon reception of a facsimile image or a copying operation.

It is checked in step S11 if the photosensor 71 detects the stripe. If NO in step S11, the flow advances to step S14. If the photosensor 71 is ON, image recording for one line is performed in step S12, and steps S12 and S13 are executed until the photosensor 71 does not detect the stripe in step S13. When the photosensor 71 does not detect the stripe, the flow advances to step S14. With this processing, since the start position of image recording on the ink sheet 14B is indefinite, the count value of the counter CNT is caused to correspond to the interval between the adjacent stripes.

In step S14, image recording processing for one line is executed. It is then checked in step S15 if the photosensor 71 detects the stripe. Steps S14 and S15 are repetitively executed until the stripe is detected. When the first stripe is detected, the flow advances to step S16, and the counter CNT is set to be "0". In steps S17 to S19, image recording is performed until the stripe cannot be detected. The counter CNT is incremented by one every image recording for one line.

In step S20, image recording for the next line is performed, and in step S21, the counter CNT is incremented by one. In step S22, the value $C_s$ of the counter CNT is compared with S. If $C_s \geqq S$, the flow returns to step S14. However, if $C_s < S$, the flow advances to step S23 to check if the photosensor 71 detects the stripe 72. If the photosensor 71 detects the stripe, the flow advances to step S24, and m is decremented by one. The flow then returns to step S16.

In this manner, when the photosensor 71 detects the stripe 72 before the value of the counter CNT reaches the predetermined value S (the ink sheet 14 is conveyed by a length $(l+\Delta l)$; where $\Delta l$ is the line width of each stripe), if the motor 125 is driven by one line, the length of the ink sheet 14B actually conveyed exceeds one line. For this reason, the skip value m when the table shown in FIG. 21 is referred is decreased to decrease the step angle of the motor 125, thereby adjusting the conveyance amount of the ink sheet 14B.

Figure 24:
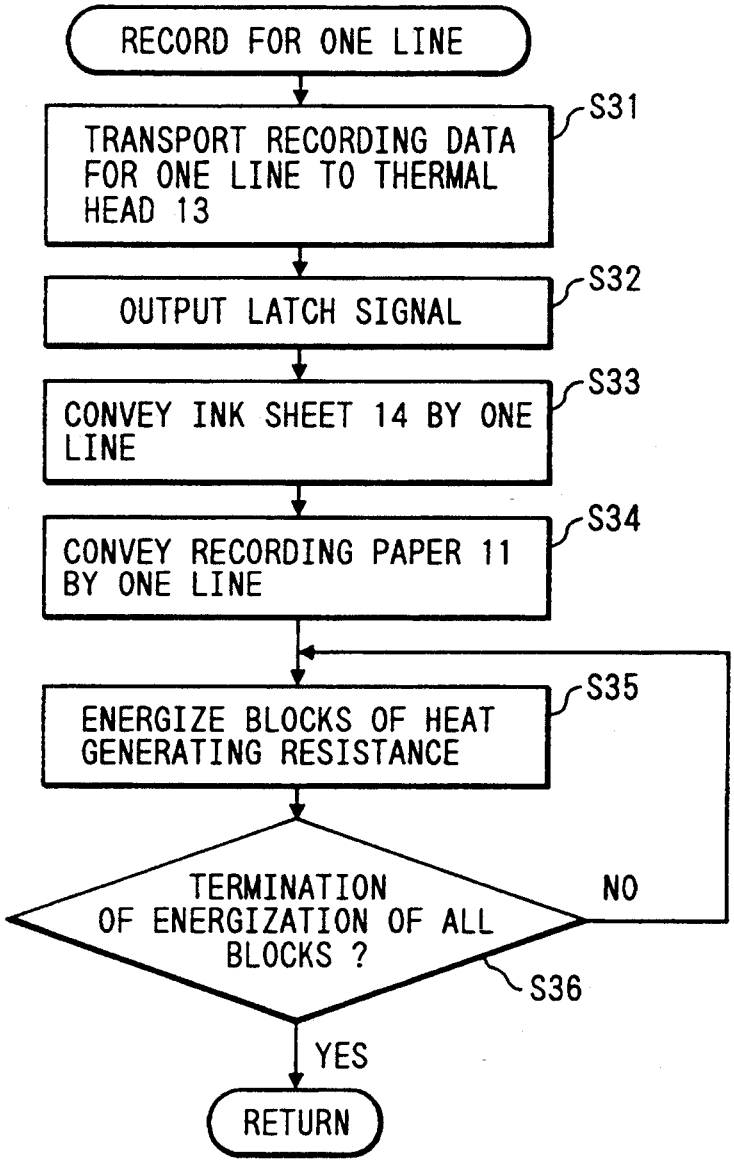

FIG. 24 is a flow chart showing one-line recording processing in steps S12, S14, S17, and S20 in FIG. 23.

When one-line image data is prepared, it is transported to the thermal head 13 in step S31, and is latched in the thermal head in response to a latch signal in step S32. In step S33, the motor 125 is excited to convey the ink sheet 14B by one line.

In this conveying processing, the current values of the phases A and B of the motor 125 are determined with reference to the current values indicated by the pointer P and its skip value m of the table shown in FIG. 21. Values $a_i$ and $b_i$ for indicating current values of the phases A and B indicated by the pointer P and m are output to the corresponding D/A converters 77 and 78. Thus, the motor 125 is rotated at a designated step angle.

In step S34, the motor 124 is rotated to convey the recording paper by one line. In step S35, one block of the heat generating resistors 132 is energized. It is checked in step S36 if all the blocks are energized (one-line image recording is completed). If YES in step S36, the flow returns to the main routine.

A modification of this embodiment will be described below.

The arrangement of a conveying mechanism system of recording paper 11 and an ink sheet 14 in a facsimile apparatus of this modification is the same as that shown in FIG. 8, and will be described below with reference to FIG. 8.

In this modification, a rotary disc 61 formed with radial slits for detecting a rotational angle of an ink sheet supply roller 17, and a photointerrupter 62 for detecting light passing through the slit are arranged.

In this case, the initial value of m is set to be "127" after a new ink sheet is loaded or a power switch is turned on to convey the ink sheet 14 as in the embodiment (FIG. 18). A count value $C_s$ of a counter CNT in an interval between adjacent slits of the rotary disc 61 is obtained. If a rotational angle of the ink sheet supply roller 17 for m=127 is represented by $\theta_1$, m for conveying the ink sheet 14 at a predetermined speed is given by:

$$m = \frac{127}{\theta_1} \times \frac{\Delta l}{\sqrt{\dfrac{(Lt/\pi + 2r_0^2)\theta_s/C_s}{\theta_0^2 + \theta_s/C_s}}}$$

where $\Delta l$ is the length for one line of the ink sheet 14 to be originally conveyed, $\theta_s$ is the relative angle between adjacent slits of the rotary disc 61, and L is the total length of the ink sheet 14. t is the thickness of the ink sheet 14, and $r_0$ is the radius of the core of each of the ink sheet take-up roller 18 and the ink sheet supply roller 17.

Image recording processing in this case will be described below. The image recording processing is substantially the same as the flow chart of the embodiment shown in FIG. 23. However, in this modification, the slits of the rotary disc 61 are detected by the photointerrupter 62 in place of detecting the stripes by the photosensor 71, and the count value of the counter CNT between adjacent slits is compared with S.

In the flow chart shown in FIG. 23, the S value to be compared with the count value of the counter CNT in step S21 is always constant. In this modification, as the amount of the ink sheet 14 used increases, the diameter of the take-up roller 18 is increased. For this reason, the number of steps for the motor 125 for conveying the ink sheet 14 is decreased as the amount of the ink sheet used increases. On the contrary, the diameter of the ink sheet supply roller 17 is decreased as the amount of the ink sheet 14 used is increased. Therefore, the number of excitation steps of the motor 125 driven between adjacent slits of the disc 61 is decreased.

Therefore, in processing corresponding to step S24 of the flow chart shown in FIG. 23, the m value is decremented by one, and the S value must be changed.

The relationship between S and m in this modification is expressed by the following equation:

$$S = \frac{\theta_s\sqrt{\dfrac{Lt}{\pi} - \dfrac{127\Delta l^2}{\theta_0 m} + 2r_0^2}}{\Delta l}$$

Therefore, in step S24, m is decremented by one, and the S value is calculated in correspondence with the m value. The count value $C_s$ of the counter CNT and S are compared on the basis of the S value changed in step S22, so that the conveying speed of the ink sheet 14 can be kept almost constant regardless of changes in diameters of the rollers 18 and 17.

In the embodiment shown in FIG. 18 and its modification, the ink sheet 14 is conveyed by one line to perform recording while the recording paper 11 is conveyed by one line. However, the embodiment and the modification can be applied to recording using a so-called multi-print sheet capable of repeatedly performing image recording operations for a plurality of times.

When image recording of a recording length L is performed, a conveying length of an ink sheet conveyed after completion of each image recording operation or during image recording is set to be smaller than the recording length L (L/n: n>1) to perform image recording. The multi-print operation will be described below.

First, initialization processing of corresponding m when the ink sheet 14 is a multi-print sheet in the embodiment shown in FIG. 18 will be described.

In the flow chart of FIG. 22, the m value is initialized to, e.g., "30" in step S1 In step S2, the ink sheet 14 is conveyed by a 1/n line. In steps S2 and S3, it is checked if the photosensor 71 is turned on to detect a stripe. If the stripe is detected, the flow advances to step S4, and the counter CNT is set to be "0". The initial value of m is determined on the basis of the value of the counter CNT corresponding to an interval between adjacent stripes in substantially the same manner as in the embodiment shown in FIG. 18, except that the ink sheet 14 is conveyed by a 1/n line in steps S5 and S7.

As shown in the flow chart shown in FIG. 23, the m value is changed during the recording operation. In this case, the ink sheet 14 is conveyed by a 1/n line (step S33 in FIG. 24) in one-line image recording processing.

As described above, according to the embodiment shown in FIGS. 17 to 24, the conveyance amount of the ink sheet corresponding to the conveyance drive amount of the ink sheet is detected. When the conveyance amount is different from the drive amount, the conveyance drive amount of the ink sheet is adjusted to keep the conveyance amount of the ink sheet constant.

Still another embodiment of the present invention will now be described below with reference to FIGS. 25 to 29. Note that FIGS. 4, 8, 9, 10B, and 11 described above will be quoted.

An embodiment to be described below provides a thermal transfer recording apparatus which can detect and control a rotating amount of a supply roller with respect to a drive amount of a take-up roller, and can record a high-quality image, and a facsimile apparatus using the recording apparatus.

The embodiment to be described below provides a thermal transfer recording apparatus which detects a rotating amount of a supply roller with respect to a drive amount of a take-up roller, and obtains a conveying length of an ink sheet on the basis of this drive amount and rotating amount to change the conveyance amount of the ink sheet, thus controlling the conveyance amount of the ink sheet, and a facsimile apparatus using the recording apparatus.

More specifically, according to the embodiment to be described below, a drive amount of the take-up roller corresponding to a predetermined rotating amount of the supply roller is detected. When this drive amount is equal to or smaller than a predetermined value, the drive amount of the take-up roller is changed.

Furthermore, according to the embodiment to be described below, the conveying length of the ink sheet with respect to a predetermined rotating amount of the supply roller is calculated, and when the conveying length exceeds a predetermined value, the conveyance amount of the ink sheet is changed.

Figure 25:
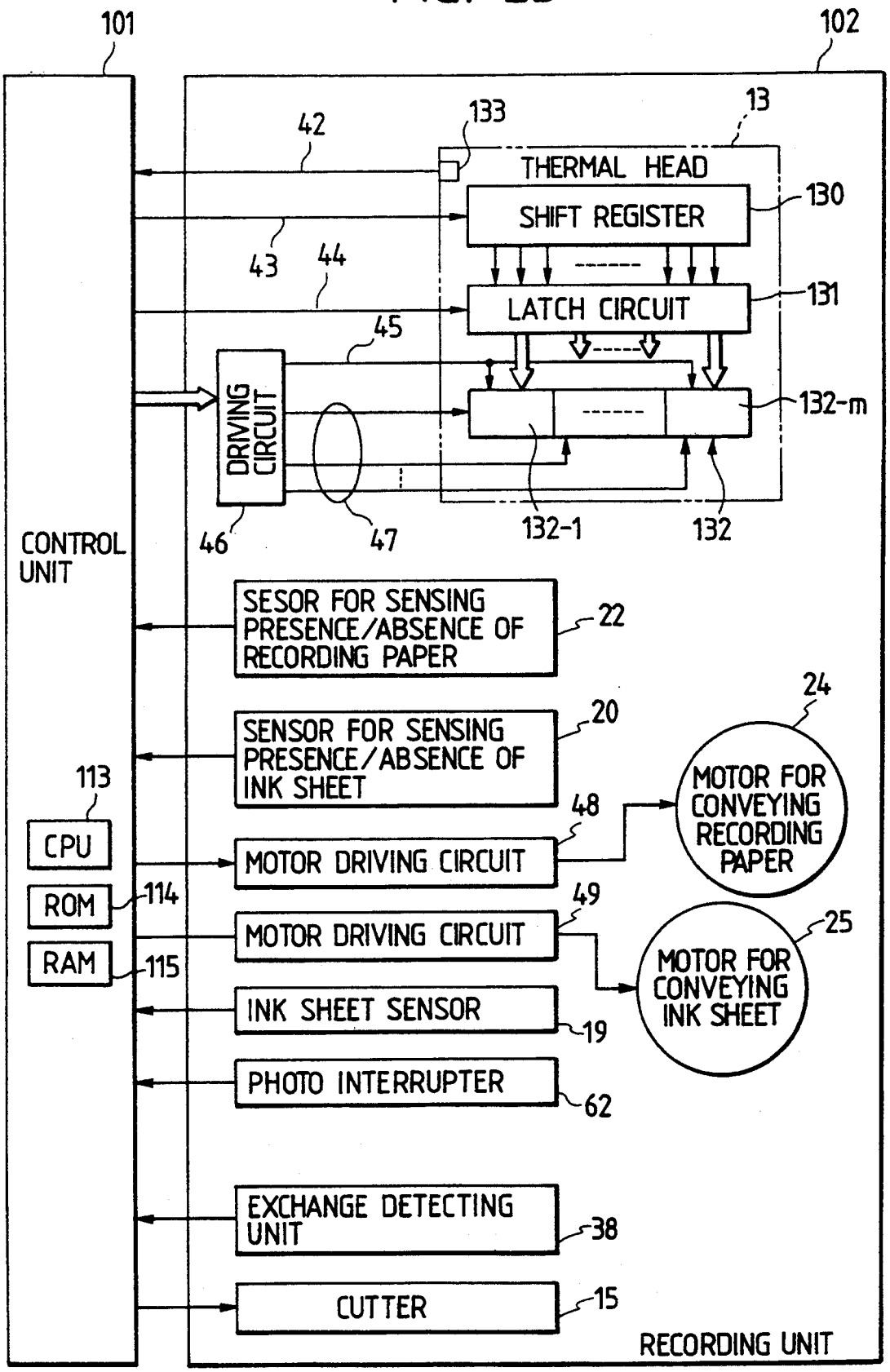
FIG. 25 a block diagram showing electrical connections between a control unit and a recording unit in a facsimile apparatus according to still another embodiment of the present invention.
Figure 26:
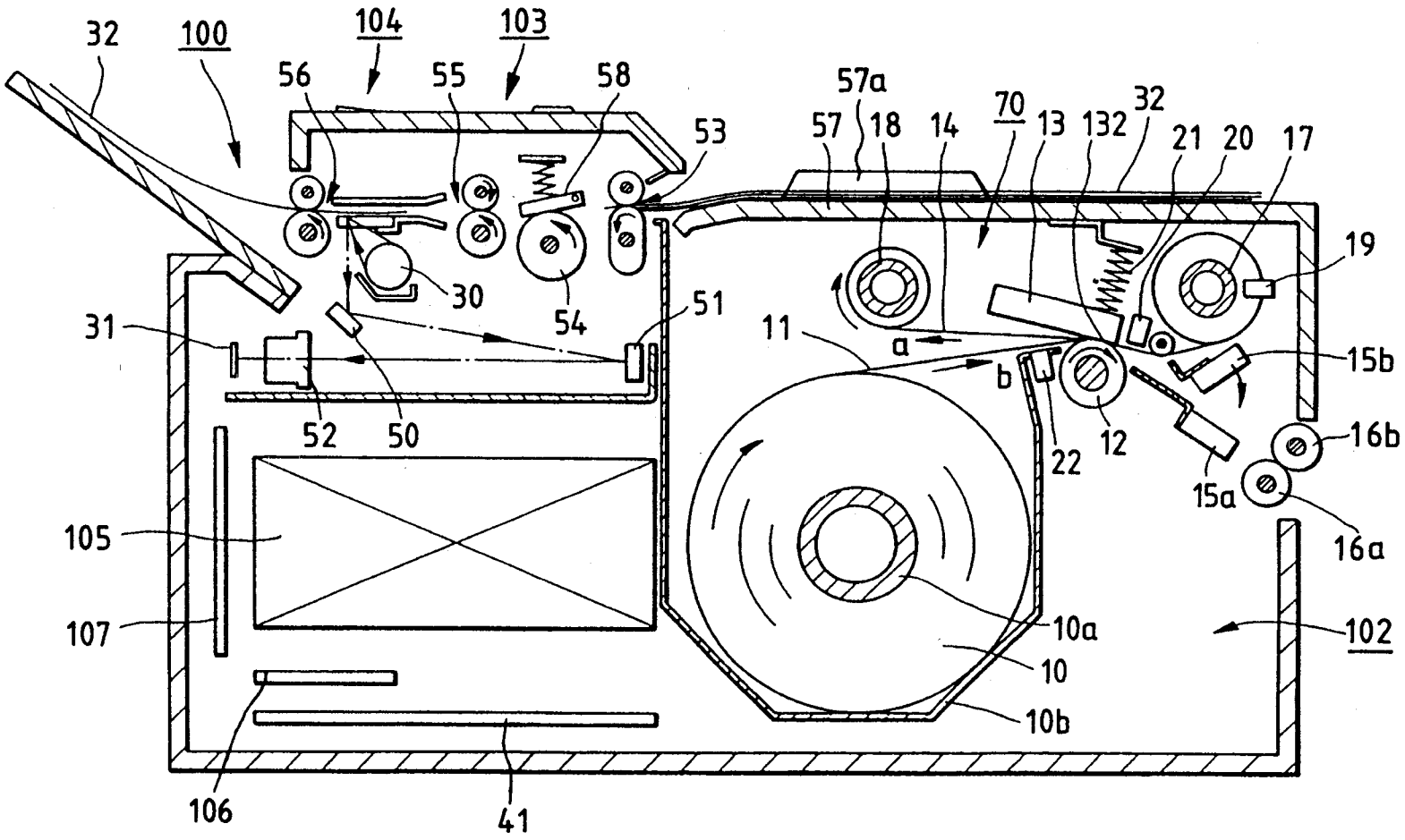
FIG. 26 is a side sectional view of a mechanism portion of the facsimile apparatus of the embodiment shown in FIG. 25.

FIG. 25 shows electrical connections between a control unit 101 and a recording unit 102 in the facsimile apparatus of this embodiment. FIG. 26 shows an arrangement of the facsimile apparatus of this embodiment. As can be seen from FIG. 25, a difference from the arrangement shown in FIG. 1 is that the photosensors 35 and 36 are omitted in this embodiment, and a photointerrupter 62 for detecting a rotating amount of an ink sheet supply roller 17 is arranged. A difference between FIGS. 26 and 3A is that the sensor 23 for detecting the take-up diameter of the ink sheet 14 is omitted from this embodiment. Therefore, the description associated with FIGS. 1 and 3A will be quoted for other arrangements.

The operation of this embodiment will be described below.

Upon description of this embodiment, FIGS. 2, 4, and 9 will be quoted in addition to FIGS. 25 and 26.

In this facsimile apparatus, assume that a minimum recordable paper size is an A5 size, and is determined as a minimum recording size since recording is performed using a longitudinal direction of this paper as the main scan direction. The length in a subscan direction in this case is about 148 mm. In this facsimile apparatus, recording paper 11 is conveyed by (1/15.4) mm when a motor 24 for conveying recording paper is driven by one step.

Assume that the core diameter of an ink sheet supply roller 17 is represented by $r_0$ and a roller diameter when all the ink sheet 14 is wound around the supply roller 17 is represented by $r_1$. In this case, the diameter $r_1$ is given by:

$$r_1 = \sqrt{(Lt/\pi) + r_0^2}$$

where t is the thickness of the ink sheet 14, and L is the total length of the ink sheet 14.

With this outer diameter, when the ink sheet supply roller 17 is rotated by a predetermined angle $\theta_s$ (angle defined by adjacent slits 63; see FIG. 9), an actual recording length is set to be equal to or smaller than (148/2) mm. When an image is recorded on recording paper of a minimum size, the slit 63 is detected at least twice by the photointerrupter 62. If a ratio n of the conveying length of the ink sheet 14 to the one-line conveying length of the recording paper 11 is 5, when the supply roller 17 is rotated by the angle $\theta_s$, the conveying length of the ink sheet 14 is $\{148/(2\times5)\}$ mm or less.

If the total length L of the ink sheet 14 is 100 m, the thickness t is 11 μm, and $r_0=9.5$ mm, then $r_1=21.0$ mm. Thus, $$r_1\theta_s=148/(2\times5)=14.8$$

Therefore, $\theta_s=14.8\div21=0.705$ (rad) or less can be set.

As a general formula for obtaining a minimum value of $\theta_s$, if the shortest subscan length is represented by l, $$\text{then } \sqrt{(Lt/\pi) + r_0^2 \cdot \theta_s} = l/2n$$

$$\text{therefore } \theta_s = l/2n \sqrt{(Lt/\pi) + r_0^2}$$

The slits can be provided at smaller angular intervals than $\theta_s$.

A case will be described below wherein $\theta_s=\pi/t$ ($\approx$0.623 rad) which satisfies the above-mentioned condition for $\theta_s$.

Assume that the core diameter of each of the ink sheet supply roller 17 and the take-up roller 18 is represented by $r_0$, the present diameter of the take-up roller 18 is represented by $r_i$, and the present diameter of the supply roller 17 is represented by $r_a$. In this case, if the total length of the ink sheet 14 wound around the take-up roller 18 is represented by l, $$r_i = \sqrt{(lt/\pi) + r_0^2}$$

-continued $$r_a = \sqrt{\{(L - l)t/\pi\} + r_0^2}$$

From these equations, $$r_i^2 + r_a^2 = (Lt/\pi) + 2r_0^2$$

$$r_a = \sqrt{(Lt/\pi) + 2r_0^2 - r_i^2}$$

If the rotational angle per unit step of the ink sheet take-up roller 18 is represented by $\theta_0$ and the rotational angle per unit step of the ink sheet supply roller 17 is represented by $\theta_1$, since the feed amount and take-up amount of the ink sheet 14 are equal to each other, $r_i\theta_0 = r_a\theta_1$.

$$\begin{aligned}\theta_1 &= r_i \cdot \theta_0 / r_a \\ &= r_i \cdot \theta_0 / \sqrt{(Lt/\pi) + 2r_0^2 - r_i^2}\end{aligned}$$

A conveyance amount $\Delta l_P$ per line of the recording paper 11 is expressed by $\Delta l_P = n.S.r_0.\theta_0$. In this case, n indicates the ratio of the conveying length of the ink sheet 14 to the one-line conveying length of the recording paper 11, as described above. S indicates the number of steps of the motor 25 required for conveying the ink sheet 14 by a 1/n line.

The number s of steps required for rotating the ink sheet supply roller 17 by $\theta_s$ is given by:

$$\begin{aligned}s &= \theta_s/\theta_1 \\ &= \sqrt{(Lt/\pi) + 2r_0^2 - r_i^2 \times \theta_s} / r_i\theta_0\end{aligned}$$

When this equation is substituted with $\theta_0 = \Delta l_P / n.S.r_0$, it can be rewritten as:

$$s = (\sqrt{(Lt/\pi) + 2r_0^2 - r_i}) \times \theta_s \cdot n \cdot S \cdot r_0 / \Delta l_p$$

Since $r_1 = S.r_0/(S-i)$, $$s = (\sqrt{(Lt/\pi) + 2r_0^2 - (S \cdot r_0/(S-i)^2} \times \theta_s \cdot n \cdot (S-i)/\Delta l_p$$

If $\theta_s = \pi/6$, $\Delta l_P = 1/15.4$ mm, $r_0 = 9.5$ mm, L=100 m, t=11 μm, n=5, and S=6, (1) if i=1, since s=4035, the number S of steps is changed from 6 to 5. Thus, n is changed from 25/6 to 5.

(2) if i=2, since s=2918, the number S of steps is changed from 5 to 4. Thus, n is changed from 4 to 5.

(3) if i=3, since s=1575, the number S of steps is changed from 4 to 3. Thus, n is changed from 15/3 to 5.

A description will be made with reference to the perspective view of FIG. 8. The ink sheet 14 is fed from the supply roller 17, and is taken up by the take-up roller 18. The take-up roller 18 is driven by the motor 25. In this case, the step count of the motor 25 necessary for rotating the encode disc 61 by $\theta_s$ (e.g., 30° ($\pi/6$)) by rotating the take-up roller 18 is checked, and when this value becomes equal to or smaller than "4035", the motor 25 is driven by five steps with respect to the one-line conveying operation of the recording paper, thus conveying the ink sheet 14.

Similarly, when the number of steps necessary for rotating the encode disc 61 by $\theta_s$ becomes equal to or smaller than "2918", the number S of drive steps of the motor 25 with respect to one line of the recording paper is set to be "4". When the number of steps becomes equal to or smaller than "1575", the number S drive steps of the motor 25 with respect to one line of the recording paper 11 is set to be "3".

The image recording processing of this embodiment will be described below.

Figure 27:
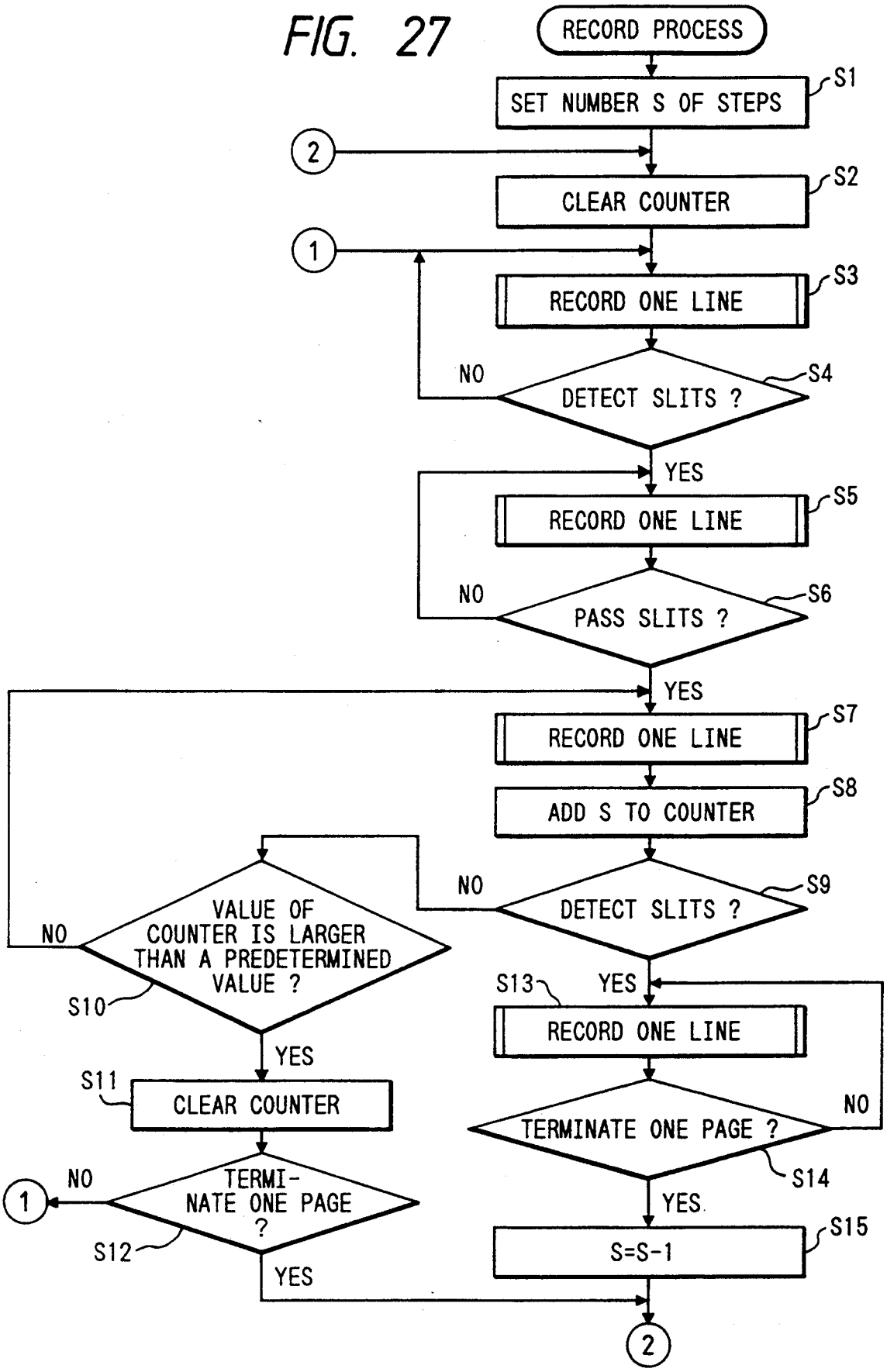
FIG. 27 is a flow chart showing recording processing of the embodiment shown in FIG. 25.

FIG. 27 is flow chart showing a recording operation of this embodiment. This operation is continuously executed from when the ink sheet 14 is loaded until all the ink sheet is fed from the ink sheet supply roller 17 and runs out.

In step S1, the number S of steps of the motor 25 which is driven for one line of the recording paper 11 is set to be, e.g., "6". In step S2, a counter allocated in a RAM 115 of a control unit 101 is cleared. In step S3, an image for one line is recorded on the recording paper 11. Note that the one-line image recording processing is shown in the flow chart of FIG. 10B. It is checked in step S4 if the slit 63 of the encode plate 61 is detected by the photosensor 62. Steps S3 and S4 are repeated until the slit 63 is detected. In step S5, one-line image recording processing is executed. It is then checked in step S6 if the slit 63 detected in step S4 is completely passed. In these steps S3 to S6, when the ink sheet 14 is loaded, since the positions of the slits 63 with respect to the photosensor 62 are indefinite, the positions of the slits 63 and the photosensor 62 are aligned at the beginning of use.

In this manner, if passage of the slit 63 is detected, the flow advances to step S7, and one-line image recording processing is performed. In step S8, the number S of steps is added to the content of the counter. It is checked in step S9 if the slit 63 is detected. If NO in step S9, the flow advances to step S10 to check if the content of the counter is equal to or larger than a predetermined value. If NO in step S10, the flow returns to step S7; otherwise, the flow advances to step S11 to clear the counter value. The flow then advances to step S12. In step S12, it is checked if one page is terminated. If NO in step S12, the flow returns to step S3, and the above-mentioned operation is executed. If YES in step S12, the flow returns to step S2. Note that the predetermined value in step S10 is "4035" when the number S of steps is "6"; and it is "1575" when S="5".

If the slit 63 is detected in step S9, the flow advances to step S13, and one-page image recording is executed in steps S13 and S14. When one-page image recording is completed, the flow advances to step S15. In this case, since the value of the counter is equal to or smaller than the predetermined value, the number S of steps is decremented by one, and the flow returns to step S2 to execute the above-mentioned operation.

According to this embodiment, even for a minimum recording paper size of image recording, the slit can be detected at least twice. Therefore, sensor data for correcting the number of drive steps of the motor 25 can be reliably detected.

Thus, the number of steps of the motor 25 required for rotating the ink sheet supply roller 17 by a predetermined angle is obtained. When the number of steps becomes equal to or smaller than, e.g., 4035, 2918, or 1575, the number of steps for driving the motor 25 is changed from 6 to 5, from 5 to 4, or from 4 to 3. Thus, a variation in feed amount of the ink sheet 14 caused by changes in diameters of the ink sheet take-up roller 18 and the supply roller 17 can be minimized.

Since the feed amount of the ink sheet 14 can be regulated with respect to the predetermined feed amount of the recording paper, an image can always be recorded at a constant recording density, and the ink sheet 14 can be efficiently used. In this embodiment, when the ink sheet 14 is exchanged, the number S of steps is set to be an initial value, e.g., "6", and the counter is cleared to "0".

A modification of the embodiment shown in FIGS. 25 to 27 will be described below.

Figure 28:
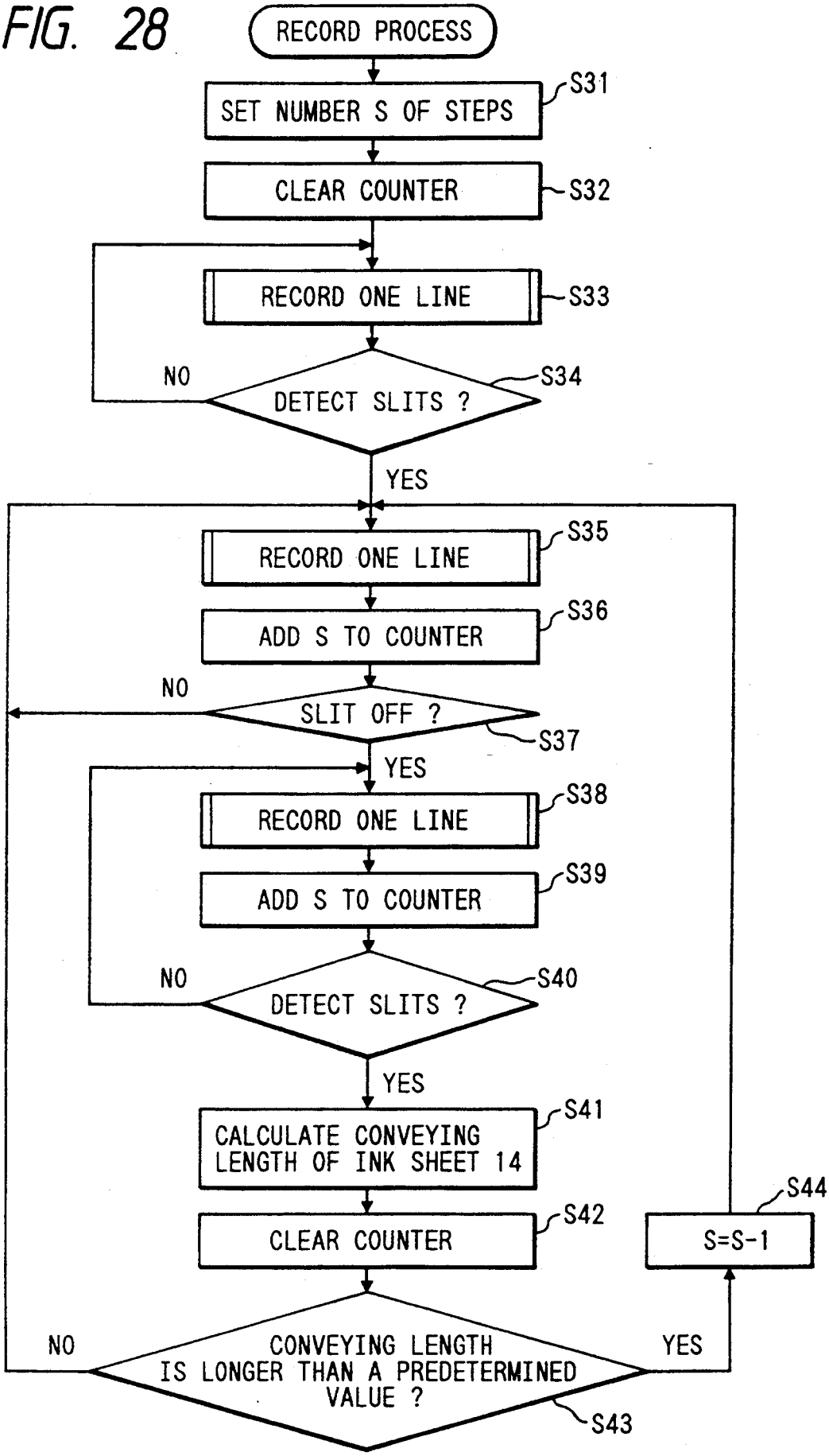
FIG. 28 is a flow chart showing a modification of the recording processing.

FIG. 28 is a flow chart showing a modification of recording processing of this embodiment.

This processing is substantially the same as the flow chart shown in FIG. 27, and one-line recording processing is shown in FIG. 10B. Therefore, a description will be made with reference to FIG. 27. Steps S31 to S34 in FIG. 27 are the same as steps S1 to S4 in FIG. 27. When the slit 63 is detected in step S34, the flow advances to step S35, and one-line recording processing is executed. In step S36, the number s of steps is added to the content of the counter. In this manner, every time one-line recording processing is executed, the number of steps of the motor 25 for conveying the ink sheet 14 is added, and it is checked in step S40 if the slit 63 is detected again.

If the slit 63 is detected, the flow advances to step S41, and the conveying length of the ink sheet 14 is calculated on the basis of the number of drive steps stored in this counter and the relative angle $\theta_s$ of the slits 63.

A method of calculating the conveying length will be described below.

Assume that the core diameter of each of the ink sheet supply roller 17 and the take-up roller 18 is represented by $r_0$, the total length of the ink sheet 14 is represented by L, and its thickness is represented by t as in the embodiment shown in FIGS. 25 to 27. Assuming that the ink sheet 14 having a length l is taken up by the take-up roller 18, if the diameter of the ink sheet take-up roller 18 is represented by $r_1$ and the length of the ink sheet 14 conveyed when the take-up roller 18 is rotated by an angle $\theta$ is represented by $\Delta l$, $$\Delta l = r_1\theta = 0\sqrt{(lt/\pi) + r_0^2}$$

If the diameter of the supply roller 17 in this case is represented by $r_2$ and the rotational angle of the supply roller 17 is represented by $\psi$, $$\Delta l = r_2\psi = \psi\sqrt{\{(L - l)t/\pi)\} + r_0^2}$$

When L is eliminated from these equations to obtain $\Delta l$, $$\Delta l = \sqrt{\frac{\theta^2\psi^2(2r_0^2 + Lt/\pi)}{\theta^2 + {}^2\psi}}$$

where $\theta$ can be calculated as a product of the rotational angle of the take-up roller 18 per step of the motor 25 and the number of drive steps of the motor 25, and the conveying length $\Delta l$ can be calculated while $\psi$ is given by the relative angle $\theta_s$ of the slits 63.

When the conveying length is calculated in this manner, the counter is cleared in step S42. It is then checked in step S43 if the conveying length calculated in step S41 is larger than a predetermined length. If NO in step S43, the flow returns to step S35 to execute the above-mentioned operation. However, if YES in step S43, i.e., if the conveying length calculated in step S41 is larger than the predetermined length, the flow advances to step S44, and the number s of steps is decremented by one. Thereafter, the flow returns to step S35.

Even when the diameter of the take-up roller 18 is increased and the conveying length of the ink sheet 14 with respect to a predetermined step drive operation of the motor 25 is increased accordingly, image recording can be performed while maintaining an almost constant conveyance amount of the ink sheet 14 in one-line recording.

Another modification will be described below with reference to FIG. 11.

Scales 72 are printed at given intervals l over the total length of an ink sheet 14A on a surface, i.e., a lower surface (upper surface in FIG. 11) opposite to an ink-coated surface of the ink sheet 14A. The interval l is sufficiently shorter than the length of A5-sized standard paper ($l<(w/2n)$; w is the subscan length (i.e., sheet width) of smallest-sized data), and the scales 72 are read by a photosensor 71. The apparatus shown in FIG. 11 includes the driver circuit 83 for driving the motor 24 for conveying recording paper, the driver circuit 75 for exciting the phase A of the motor 25 for conveying an ink sheet, and the driver circuit 76 for exciting the phase B of the motor 25. The D/A converters 77 and 78 respectively receive the control signals 79 and 81 from the control unit **101*a* to change drive voltages of the corresponding driver circuits, thus microstep controlling the motor 25. The control unit 101*a* outputs the phase excitation signals 80 and 82 for the phases A and B of the motor 25. In response to the signals 80 and 82, the driver circuits 75 and 76 output signals 73 and 74 for exciting the phases A and B of the motor 25**.

The moving amount of the ink sheet 14A is obtained by detecting the scales 72 by the reflection type photosensor 71. The photosensor 71 is turned on when it detects the scale 72, and is turned off when the motor 25 is driven by one step. The number J of steps of driving the motor 25 is counted from a given scale until the next scale is detected. When the number J becomes smaller than a predetermined value, correction control is performed to decrease the drive step angle of the motor 25.

In the flow charts shown in FIGS. 27 and 28, the number of steps is changed to keep almost constant n. However, the step angle of the motor may be decreased. The number of drive steps or step angle of the motor 25 is performed regardless of divisions of pages. However, when a change timing of the number of drive steps or step angle is generated during image recording of a given page, the number of drive steps or step angle may be changed after completion of the image recording of the given page. Thus, an image can be repeatedly recorded on a given page at an almost uniform density.

As described above, according to this embodiment, rotation of the support shaft of the ink sheet take-up roller 18 is controlled to almost uniform a conveyance amount of the ink sheet 14 with respect to the predetermined conveyance amount of the recording paper 11. Therefore, conveyance control of the ink sheet 14 by a capstan roller and a pinch roller can be omitted, and the mechanism portion of the printer can be simplified.

Still another embodiment of the present invention will be described below with reference to FIGS. 29 and 30. Note that FIG. 4 is quoted as the block diagram showing the schematic arrangement of the facsimile apparatus of this embodiment, FIG. 26 is quoted as the side sectional view showing a mechanism portion of the facsimile apparatus of this embodiment (however, the sensor 19 shown in FIG. 26 is omitted), FIG. 8 is quoted as the perspective view showing a conveying mechanism of recording paper and an ink sheet, FIG. 9 is quoted as a schematic view of an encode disc, FIG. 7A is quoted as the flow chart showing recording processing, and FIG. 11 is quoted as the view showing the arrangement of a conveying system of an ink sheet and recording paper.

In a thermal transfer recording apparatus and a facsimile apparatus according to an embodiment to be described below, an ink sheet fed from a supply means for feeding an ink sheet is taken up by a take-up means. An amount of an ink sheet fed from the supply means is detected in correspondence with a drive amount of the take-up means. On the basis of the amount of the ink sheet fed in correspondence with the drive amount, the remaining amount of the ink sheet in the feeding means is detected.

Electrical connections between a control unit 101 and a recording unit 102 in the facsimile apparatus of this embodiment will be described below with reference to FIG. 29. Note that the same reference numerals in FIG. 29 denote the same parts as in other drawings, and a detailed description thereof will be omitted.

Figure 29:
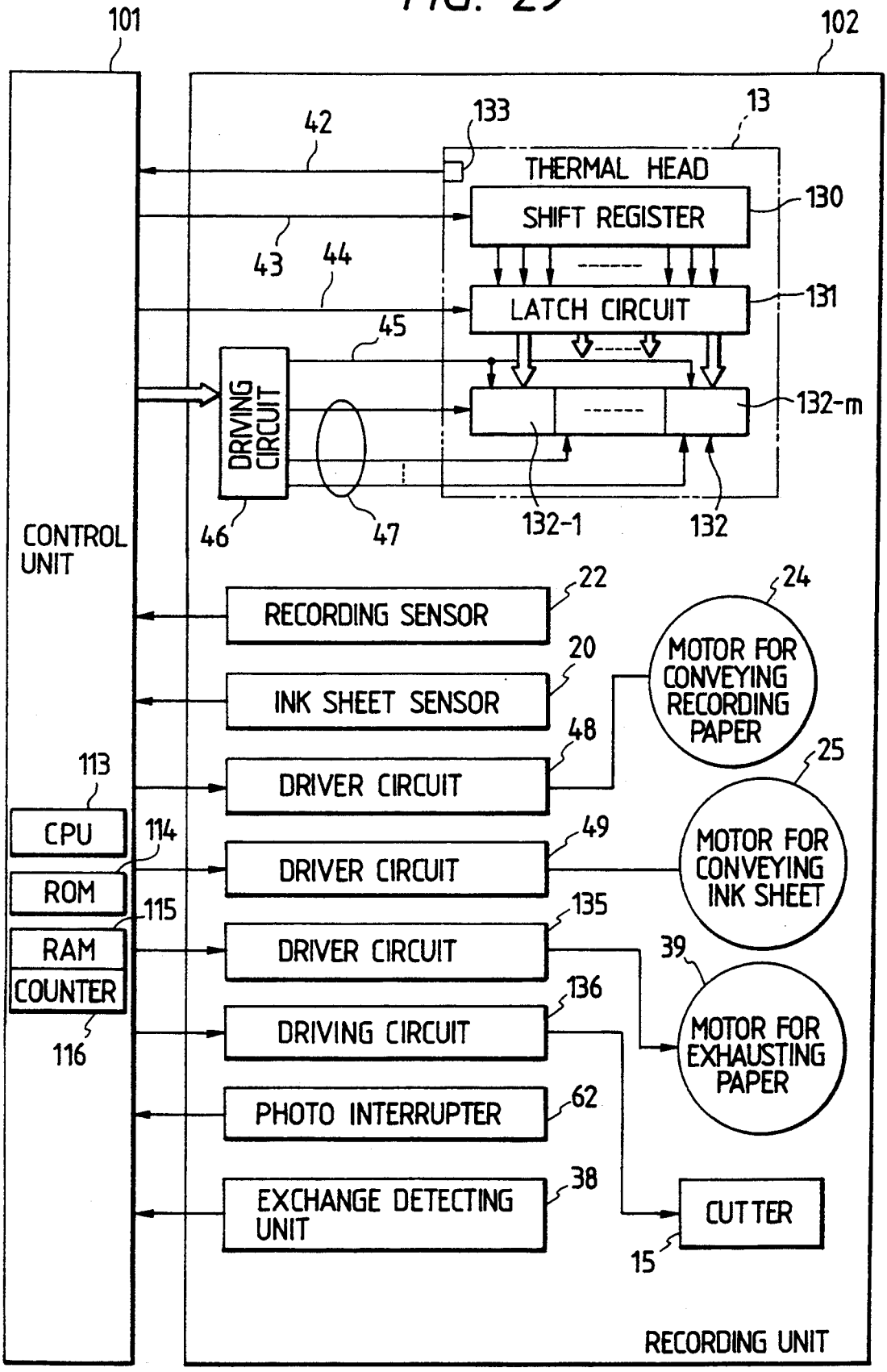
FIG. 29 is a block diagram showing electrical connections between a control unit and a recording unit in a facsimile apparatus of still another embodiment of the present invention.

In FIG. 29, the recording unit 102 includes driver circuits 48, 49, and 135 for respectively driving a motor 24 for conveying recording paper, a motor 25 for conveying an ink sheet, and a motor 39 for discharging paper. In this embodiment, the motors 24, 25, and 39 comprise stepping motors. However, the present invention is not limited to this. For example, these motors may comprises, e.g., DC motors. The recording unit also includes a photointerrupter 62, a counter 116, and a driving circuit 136 for driving cutters 15 (15*a* and 15*b*).

Ink sheet remain detection in the thermal transfer printer will be described below with reference to the perspective view of FIG. 8.

An ink sheet 14 is fed from an ink sheet supply roller 17, and is taken up by a take-up roller 18. The take-up roller 18 is driven by the motor 25. When the take-up roller 18 is driven in a direction of an arrow, the supply roller 17 and an encode disc 61 are rotated in the direction of the arrow. Note that slits 63 of the encode disc 61 are formed to define an angle $\theta_s$, as shown in FIG. 9.

Since the motor 25 drives the support shaft of the take-up roller 18, even if the motor 25 is driven by a given step, the rotational angle of the ink sheet supply roller 17 changes in correspondence with a change in diameter of each of the supply roller 17 and the take-up roller 18. Therefore, in this embodiment, this change is detected by the photointerrupter 62 to obtain a remain of the ink sheet 14. More specifically, the number of steps of the motor 25 necessary for rotating the encode disc 61 by $\theta_s$ is checked to obtain the remain of the ink sheet 14. The principle of this operation will be described below.

Assume that the core diameter of each of the take-up roller 18 and the supply roller 17 of the ink sheet 14 is represented by $r_0$, the diameter of the supply roller 17 when a predetermined amount of ink sheet is wound around the take-up roller 18 is represented by $r_i$, and the diameter of the take-up roller 18 is represented by $r_a$. If the length of the ink sheet 14 wound around the ink sheet supply roller 17 is represented by x, the total length of the ink sheet 14 is represented by L, and the thickness of the ink sheet 14 is represented by t, $$\text{from } \pi r_i^2 - \pi r_0^2 = xt \tag{1}$$

$$r_i = \sqrt{(xt/\pi) + r_0^2}$$

$$\text{from } \pi r_a^2 - \pi r_0^2 = (L - x)t \tag{2}$$

$$r_a = \sqrt{((L - x)t/\pi) + r_0^2}$$

Assume that a rotational angle obtained when the diameter of the ink sheet take-up roller 18 is $r_a$ is represented by $\theta_1$ (this rotational angle is uniquely determined by the number of rotation steps of the motor 25), and a rotational angle of the supply roller 17 having the diameter $r_i$ in this case is represented by $\theta_0$. Since the length of the ink sheet 14 fed from the ink sheet supply roller 17 is equal to that of the ink sheet 14 taken up by the take-up roller 18, the following relationship is established:

$$r_i\theta_0 = r_a\theta_1 \tag{3}$$

Using equations (1) to (3), $$\{(xt/\pi) + r_0^2\}\theta_0^2 = \{(L - x)t/\pi + r_0^2\}\theta_1^2 \text{ therefore,} \tag{4}$$

$$x = \frac{L\theta_1^2}{\theta_0^2 + \theta_1^2} + \frac{\pi r_0^2(\theta_1^2 - \theta_0^2)}{(\theta_0^2 + \theta_1^2)}$$

If the angle $\theta_s$ of the slits 63 of the encode disc 61 is given by $\theta_0$, since the total length L, the thickness t, the core diameter $r_0$, and $\theta_1$ of the ink sheet 14 have already been known, the remain x of the ink sheet 14 can be obtained using equation (4).

Recording processing of this embodiment will be described below with reference to FIG. 7A described above and FIG. 30.

One-page image recording processing in the facsimile apparatus of this embodiment is the same as that shown in FIG. 7A, and a description thereof is quoted here.

In step S3 in FIG. 7A, the motor 25 is driven to convey the ink sheet 14. In this case, if a multi-print mode is instructed by a switch 103*a*, the ink sheet 14 is conveyed by a (1/n) line of the recording paper 11 in a direction of an arrow a in FIG. 8. The conveying processing of the ink sheet 14 will be described below with reference to a flow chart of FIG. 30.

Figure 30:
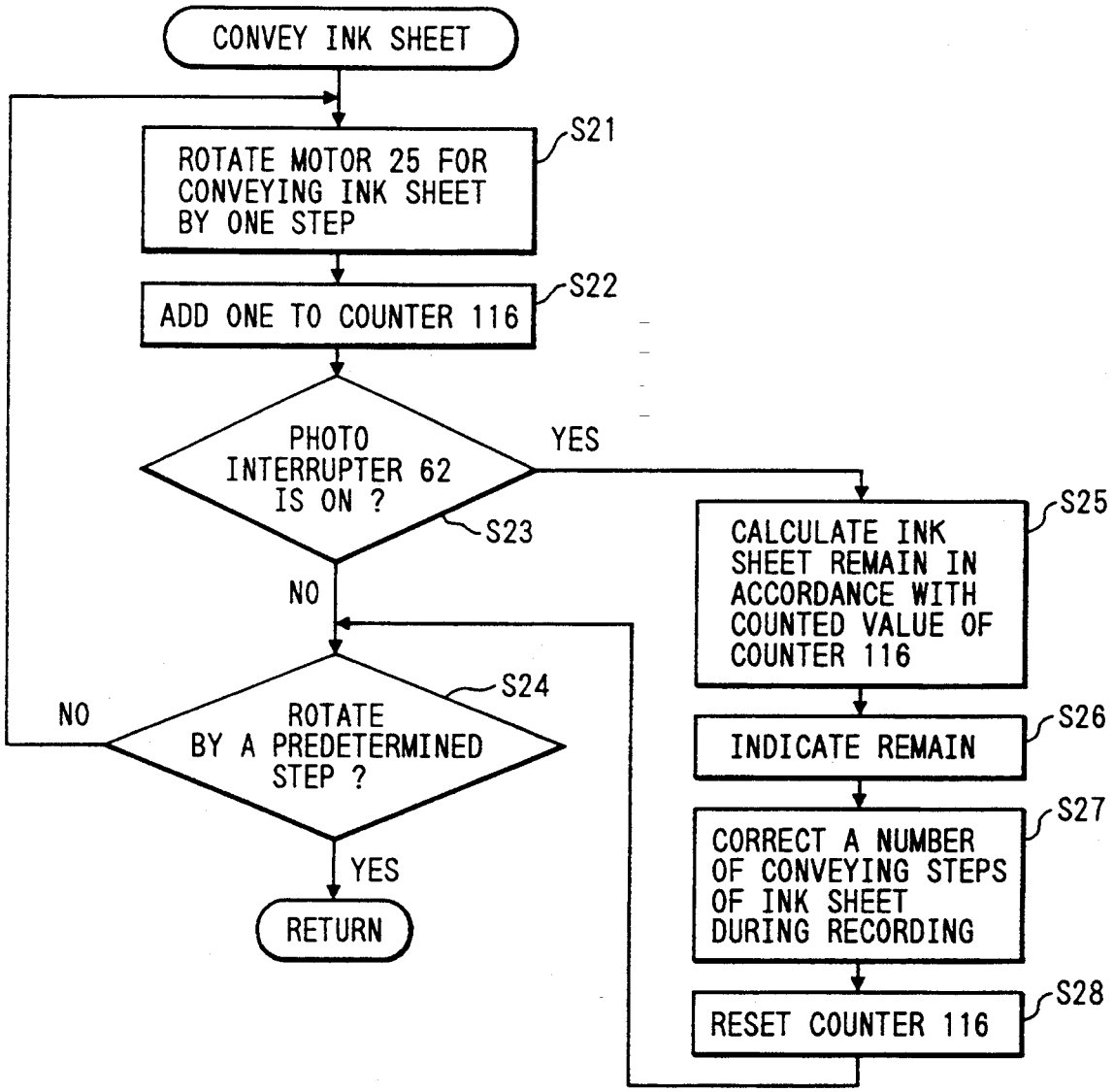
FIG. 30 is a flow chart showing recording processing.

FIG. 30 is a flow chart showing ink sheet conveying processing in step S3 of FIG. 7A.

In step S21, the motor 25 is driven by one step. In step S22, the counter 116 allocated in a RAM 115 is incremented by one in correspondence with the number of drive steps of the motor 25. The counter 116 has been reset to "0" upon initialization of this facsimile apparatus. The flow advances to step S23 to check if the photointerrupter 62 detects the slit 63 of the encode disc 61. If NO in step S23, the flow advances to step S24 to check if the motor 25 is driven by a predetermined number of steps. If YES in step S24, the flow returns to the main routine. However, if NO in step S24, the flow returns to step S21, and the motor 25 is driven by one step. The predetermined number of steps is one necessary for conveying the ink sheet 14 by a (1/n) line in the multi-print mode, and is one necessary for conveying the ink sheet by one line in a printing mode using a one-time ink sheet.

If YES in step S23, that is, if the photointerrupter 62 detects the slit 63, the flow advances to step S25, the remain of the ink sheet 14 is calculated using equation (4) described above on the basis of the count value of the counter 116. In step S26, the remaining amount of the ink sheet 14 is indicated on an indicating unit 104. The remaining amount indication may be made such that a remain length of the ink sheet 14 is digitally displayed or may be indicated stepwise by, e.g., % or a ratio. Remain detection in step S25 may be made by referring to a table or the like storing remain data in correspondence with the number of steps (the count value of the counter 116) for driving the motor 25.

When the remaining (or used length) of the ink sheet 14 is obtained, the flow advances to step S27. The number of steps for determining the conveying length of the ink sheet 14 conveyed in correspondence with one line of the recording paper 11 during image recording is corrected based on this value in correspondence with the diameters of the ink sheet supply roller 17 and the take-up roller 18. In this manner, the number of drive steps of the motor 25 to be compared in step S24 is changed. The flow then advances to step S28, and the counter 116 of the RAM 115 is reset to "0". The flow then advances to step S24. The counter 116 is cleared when a signal indicating that the ink sheet 14 is exchanged is input from an exchange detecting unit 38 after the remaining amount of the ink sheet 14 is small.

Thus, the ink sheet 14 can be accurately conveyed by driving the support shaft of the ink sheet take-up roller 18, and its remaining amount can be accurately detected.

Still another embodiment will be described below by quoting FIG. 11.

FIG. 11 shows an arrangement of a conveying mechanism of recording paper and an ink sheet according to still another embodiment of the present invention.

Scales 72 are printed at given intervals l over the total length of an ink sheet 14A on a surface, i.e., a lower surface (upper surface in FIG. 11) opposite to an ink-coated surface of the ink sheet 14A. The interval l is sufficiently shorter than the length of A5-sized standard paper, and the scales 72 are read by a photosensor 71. The apparatus shown in FIG. 11 includes a driver circuit 83 for driving a motor 24 for conveying recording paper, a driver circuit 75 for exciting a phase A of the motor 25 for conveying an ink sheet, and a driver circuit 76 for exciting a phase B of the motor 25. D/A converters 77 and 78 respectively receive control signals 79 and 81 from a control unit 101*a* to change drive voltages of the corresponding driver circuits, thus microstep controlling the motor 25. The control unit 101*a* outputs phase excitation signals 80 and 82 for the phases A and B of the motor 25. In response to the signals 80 and 82, the driver circuits 75 and 76 output signals 73 and 74 for exciting the phases A and B of the motor 25.

If the present diameter of the take-up roller 18 is represented by $r_a$, the core diameter of the take-up roller 18 is represented by $r_0$, the thickness of the ink sheet 14A is represented by t, and its total length is represented by L, the relationship between the diameter of the take-up roller 18 and the remain when the ink sheet 14A is used by a length x is expressed by:

$$r_a = \sqrt{r_0^2 + (L - x)t/\pi}$$

If a rotational angle of the ink sheet take-up roller 18 when the ink sheet 14A is conveyed by the interval l of the scales 72 is represented by $\theta_3$, $$r_a\theta_3 = l \tag{5}$$

Therefore, $$x = L - (\pi/t)\{(l/\theta_3)^2 - r_0^2\}$$

When $\theta_3$ is calculated based on the number of drive steps of the motor 25, the remain x can be uniquely determined. This processing is performed in the same manner as in the flow chart shown in FIG. 30 by checking in step S23 in the flow chart of FIG. 6B if the photointerrupter 71 detects the scale 72. In place of correction processing of the number of steps in step S27, the motor 25 may be microstep-driven using the D/A converters 77 and 78 to decrease the minimum step angle of the motor 25.

In this embodiment, scales 72 are printed on the lower surface of the ink sheet 14A, and are detected by the photosensor 71. However, the present invention is not limited to this. For example, the scales 72 may be formed by grooves, and the grooves may be detected by a photointerrupter, a microswitch, or the like. In this embodiment, the motors 25 and 24 comprise the two-phase/four-pole stepping motors. However, the present invention is not limited to this. For example, the motors may comprise DC motors or servo motors.

As described above, according to this embodiment, rotation of the ink sheet take-up roller 18 is controlled, and the remaining amount of the ink sheet can be detected by a sensor for detecting a conveyance amount of the ink sheet.

According to this embodiment, as described above, a sensor for detecting a remaining amount of the ink sheet can be omitted.

Note that a heating system is not limited to a thermal head system using a thermal head. For example, an electrothermosensitive system or a laser transfer system may be employed.

The recording medium is not limited to recording paper. For example, the recording medium may be a fabric, a plastic sheet, or the like as long as ink can be transferred thereto. The structure of the ink sheet is not limited to the roll structure shown in the above embodiments. For example, the ink sheet may be of a so-called ink sheet cassette type, which is incorporated in a detachable cassette and is attached/detached to/from the recording apparatus main body together with the cassette.

In the above embodiments, facsimile apparatuses have been exemplified. However, the present invention is not limited to this. For example, the present invention is applicable to a wordprocessor, a typewriter, a copying machine, or the like.

In the above embodiments, full-line type apparatuses have been exemplified. However, the present invention is not limited to this. For example, the present invention may be applied to a so-called serial type apparatus in which a thermal head is reciprocally moved.

As described above, according to the present invention, there is provided a thermal transfer recording method and a recording apparatus using the method, with which consumption of an ink sheet is reduced and high-quality recording can be performed.

What is claimed is:

1. A recording apparatus for transferring an ink contained in an ink sheet moved in a first direction onto a recording medium moved in a second direction, said first direction being opposite to said second direction at a position where said ink is transferred to the recording medium to record an image on the recording medium, comprising:

a roller for taking up the ink sheet;

driving means for driving said roller to take up the ink sheet, a diameter of said ink sheet wound on said take-up roller increasing as additional said ink sheet is wound thereon; and controlling means for controlling a drive amount of said driving means wherein a conveyance ratio of the ink sheet to the recording medium is kept substantially constant.

2. A recording apparatus according to claim 1, wherein said controlling means comprises detecting means for detecting a diameter of a take-up roller of said take-up means, and the drive amount of said driving means is changed in correspondence with a roller diameter detected by said detecting means.

3. A recording apparatus according to claim 1, wherein said controlling means comprises detecting means for detecting a used length of the ink sheet in cooperation with said driving means, and the drive amount of said driving means is changed in correspondence with the used length of the ink sheet.

4. A recording apparatus according to claim 1, wherein the ink sheet has marks printed at predetermined intervals, said apparatus further comprises:

conveyance amount detecting means for detecting a conveyance amount of the ink sheet on a basis of said marks; and counting means for counting the drive amount of said driving means with respect to a predetermined conveyance amount of the ink sheet, and the drive amount of said driving means is changed when a count value of said counting means is not more or smaller than a predetermined value.

5. A recording apparatus according to claim 1, wherein a conveying speed of the ink sheet is lower than a conveying speed of the recording medium.

6. A recording apparatus for transferring an ink contained in an ink sheet moved in a first direction onto a recording medium moved in a second direction, said first direction being opposite to said second direction at a position where said ink is transferred to the recording medium to record an image on the recording medium, comprising:

ink sheet conveying means for conveying the ink sheet, said ink sheet conveying means comprising a take-up roller on which said ink sheet is wound;

detecting means for detecting a conveyance amount of the ink sheet conveyed upon a driving operation of said ink sheet conveying means; and controlling means for controlling a drive amount of said ink sheet conveying means on a basis of the drive amount of said ink sheet conveying means and the conveyance amount of the ink sheet by said ink sheet conveying means, a diameter of said ink sheet wound on said take-up roller increasing as additional said ink sheet is wound thereon, wherein a conveyance ratio of said ink sheet to said recording medium is kept substantially constant.

7. A recording apparatus according to claim 6, wherein said ink sheet conveying means comprises a stepping motor, and said controlling means changes a step angle of said stepping motor on a basis of a number of steps of said stepping motor and a conveying length of the ink sheet.

8. A recording apparatus according to claim 6, wherein a conveying speed of the ink sheet is set to be $1/n$ ($n>1$) with respect to a conveying speed of the recording medium.

9. A recording apparatus according to claim 6, wherein said detecting means reads passage of marks printed on the ink sheet at predetermined intervals to detect the conveyance amount of the ink sheet.

10. A recording apparatus according to claim 6, wherein said detecting means detects a rotating amount of a roller for winding the ink sheet therearound to detect the conveyance amount of the ink sheet.

11. A recording apparatus for transferring an ink contained in an ink sheet moved in a first direction onto a recording medium moved in a second direction to record an image on the recording medium, comprising:

a take-up roller for taking up the ink sheet;

driving means for driving said take-up roller to convey the ink sheet, said first direction being opposite to said second direction;

rotating amount detecting means for detecting a predetermined rotating amount of a supply roller during image recording;

detecting means for detecting a drive amount of said driving means in correspondence with the predetermined rotating amount; and controlling means for, when the drive amount detected by said detecting means is not more than a predetermined value, controlling to change the drive amount of said driving means, wherein a conveyance ratio of said ink sheet to said recording medium is kept substantially constant.

12. A recording apparatus according to claim 11, wherein a conveying speed of the ink sheet is lower than a conveying speed of the recording medium.

13. A recording apparatus for transferring an ink contained in an ink sheet moved in a first direction onto a recording medium moved in a second direction, said first direction being opposite to said second direction at a position where said ink is transferred to the recording medium to record an image on the recording medium, comprising:

a take-up roller for taking up the ink sheet, the ink sheet being wound on said take-up roller;

driving means for driving said take-up roller by a drive amount to convey the ink sheet, a diameter of said ink sheet wound on said take-up roller increasing as additional said ink sheet is wound thereon;

rotating amount detecting means for detecting a predetermined rotating amount of a supply roller;

calculating means for calculating a conveying length of the ink sheet on a basis of the drive amount and the rotating amount; and controlling means for, when the conveying length is not less than a predetermined value, controlling to change the drive amount of said driving means, wherein a conveyance ratio of said ink sheet to said recording medium is kept substantially constant.

14. An apparatus according to claim 13, wherein a conveying speed of the ink sheet is lower than a conveying speed of the recording medium.

15. A recording method for maintaining substantially constant a conveyance ratio between an ink sheet and a recording medium which are conveyed in opposite directions at a transfer position where ink is transferred from said ink sheet to said recording medium, comprising the steps of:

conveying said ink sheet by driving a take-up roller, said take-up roller taking up said ink sheet, a diameter of said ink sheet wound on said take-up roller increasing as additional said ink sheet is wound thereon;

detecting a driving amount of said take-up roller required to convey said ink sheet by a predetermined length; and maintaining substantially constant a conveyance ratio at said transfer position between said ink sheet and said recording medium by changing the driving amount of said take-up roller when in said detecting step the driving amount of said take-up roller is detected to be less than a predetermined amount.

16. A recording method according to claim 15, wherein a conveying speed of the ink sheet is lower than a conveying speed of the recording medium.

17. A recording apparatus for transferring an ink contained in an ink sheet onto a recording medium to record an image on the recording medium, comprising:

take-up means for taking up the ink sheet;

driving means for driving said take-up means to take up the ink sheet; and controlling means for controlling a drive amount of said driving means to maintain a substantially constant conveyance ratio of the ink sheet to the recording medium in correspondence with a change in take-up amount by said take-up means, said controlling means further comprising;

rotating amount detecting means for detecting a rotating amount of a supply roller for supplying the ink sheet conveyed by a take-up roller of said take-up means; and counting means for counting the drive amount of said driving means in correspondence with a predetermined rotating amount of said supply roller, and the drive amount of said driving means is changed when a count value of said counting means is not more than a predetermined value.

18. An image recording apparatus for transferring an ink contained in an ink sheet moved in a first direction onto a recording medium moved in a second direction, said first direction being opposite to said second direction at a position where said ink is transferred to the recording medium to record an image on the recording medium, comprising:

reading means for reading an original image;

a roller for taking up the ink sheet;

driving means for driving said roller to take up the ink sheet, a diameter of said ink sheet wound on said take-up roller increasing as additional said ink sheet is wound thereon; and controlling means for controlling a drive amount of said driving means;

wherein a conveyance ratio of the ink sheet to the recording medium is kept substantially constant, and the image read by said reading means is recorded on the recording medium by transferring said ink from said ink sheet.

19. An apparatus according to claim 18, wherein said controlling means comprises detecting means for detecting a diameter of a take-up roller of said take-up means, and the drive amount of said driving means is changed in correspondence with a roller diameter detected by said detecting means.

20. An apparatus according to claim 18, wherein said controlling means comprises detecting means for detecting a used length of the ink sheet in cooperation with said driving means, and the drive amount of said driving means is changed in correspondence with the used length of the ink sheet.

21. An apparatus according to claim 18, wherein the ink sheet has marks printed at predetermined intervals, said apparatus further comprising:

conveyance amount detecting means for detecting a conveyance amount of the ink sheet based on said marks; and counting means for counting the drive amount of said driving means with respect to a predetermined conveyance amount of the ink sheet, and the drive amount of said driving means is changed when a count value of said counting means is one of not more and smaller than a predetermined value.

22. An apparatus according to claim 18, wherein a conveying speed of the ink sheet is lower than a conveying speed of the recording medium.

23. An image recording apparatus according to claim 18, further comprising communicating means for communicating by at least one of transmitting a first image signal generated by said reading means which corresponds to the image which is recorded on the recording medium by transferring said ink from said ink sheet and receiving a second image signal which is externally generated.

24. An image recording apparatus for transferring an ink contained in an ink sheet moved in a first direction onto a recording medium moved in a second direction, said first direction being opposite to said second direction at a position where said ink is transferred to the recording medium to record an image on the recording medium, comprising:

reading means for reading an original image;

ink sheet conveying means for conveying the ink sheet, said ink sheet conveying means comprising a take-up roller on which said ink sheet is wound;

detecting means for detecting a conveyance amount of the ink sheet conveyed upon a driving operation of said ink sheet conveying means; and controlling means for controlling a drive amount of said ink sheet conveying means on a basis of the drive amount of said ink sheet conveying means and the conveyance amount of the ink sheet by said ink sheet conveying means, a diameter of said ink sheet wound on said take-up roller increasing as additional said ink sheet is wound thereon;

wherein a conveyance ratio of said ink sheet to said recording medium is kept substantially constant, and the image read by said reading means is recorded on the recording medium by transferring said ink from said ink sheet.

25. An apparatus according to claim 24, wherein said ink sheet conveying means comprises a stepping motor, and said controlling means changes a step angle of said stepping motor based on a number of steps of said stepping motor and a conveying length of the ink sheet.

26. An apparatus according to claim 24, wherein a conveying speed of the ink sheet is set to be $1/n$ ($n>1$) with respect to a conveying speed of the recording medium.

27. An apparatus according to claim 24, wherein said detecting means reads passage of marks printed on the ink sheet at predetermined intervals to detect the conveyance amount of the ink sheet.

28. An apparatus according to claim 24, wherein said detecting means detects a rotating amount of a roller for winding the ink sheet therearound to detect the conveyance amount of the ink sheet.

29. An image recording apparatus according to claim 24, further comprising communicating means for communicating by at least one of transmitting a first image signal generated by said reading means which corresponds to the image which is recorded on the recording medium by transferring said ink from said ink sheet and receiving a second image signal which is externally generated.

30. An image recording apparatus for transferring an ink contained in an ink sheet moved in a first direction onto a recording medium moved in a second direction to record an image on the recording medium, comprising:

reading means for reading an original image;

a take-up roller for taking up the ink sheet;

driving means for driving said take-up roller to convey the ink sheet, said first direction being opposite to said second direction;

rotating amount detecting means for detecting a predetermined rotating amount of a supply roller during image recording;

detecting means for detecting a drive amount of said driving means in correspondence with the predetermined rotating amount; and controlling means for, when the drive amount detected by said detecting means is not more than a predetermined value, controlling to change the drive amount of said driving means;

wherein a conveyance ratio of said ink sheet to said recording medium is kept substantially constant, and the image read by said reading means is recorded on the recording medium by transferring said ink from said ink sheet.

31. An apparatus according to claim 30, wherein a conveying speed of the ink sheet is lower than a conveying speed of the recording medium.

32. An image recording apparatus according to claim 30, further comprising communicating means for communicating by at least one of transmitting a first image signal generated by said reading means which corresponds to the image which is recorded on the recording medium by transferring said ink from said ink sheet and receiving a second image signal which is externally generated.

33. An image recording apparatus for transferring an ink contained in an ink sheet moved in a first direction onto a recording medium moved in a second direction, said first direction being opposite to said second direction at a position where said ink is transferred to the recording medium to record an image on the recording medium, comprising:

reading means for reading an original image;

a take-up roller for taking up the ink sheet, the ink sheet being wound on said take-up roller;

driving means for driving said take-up roller by a drive amount to convey the ink sheet, a diameter of said ink sheet wound on said take-up roller increasing as additional said ink sheet is wound thereon;

rotating amount detecting means for detecting a predetermined rotating amount of a supply roller;

calculating means for calculating a conveying length of the ink sheet on a basis of the drive amount and the rotating amount; and controlling means for, when the conveying length is not less than a predetermined value, controlling to change the drive amount of said driving means;

wherein a conveyance ratio of said ink sheet to said recording medium is kept substantially constant, and the image read by said reading means is recorded on the recording medium by transferring said ink from said ink sheet.

34. An apparatus according to claim 33, wherein a conveying speed of the ink sheet is lower than a conveying speed of the recording medium.

35. An image recording apparatus according to claim 32, further comprising communicating means for communicating by at least one of transmitting a first image signal generated by said reading means which corresponds to the image which is recorded on the recording medium by transferring said ink from said ink sheet and receiving a second image signal which is externally generated.

36. An image recording method for maintaining substantially constant a conveyance ratio between an ink sheet and a recording medium which are conveyed in opposite directions at a transfer position where ink is transferred from said ink sheet to said recording medium, comprising the steps of:

reading an original image;

conveying said ink sheet by driving a take-up roller, said take-up roller taking up said ink sheet, a diameter of said ink sheet wound on said take-up roller increasing as additional said ink sheet is wound thereon;

detecting a driving amount of said take-up roller required to convey said ink sheet by a predetermined length; and maintaining substantially constant a conveyance ratio at said transfer position between said ink sheet and said recording medium by changing the driving amount of said take-up roller when in said detecting step the driving amount of said take-up roller is detected to be less than a predetermined amount;

wherein said ink is transferred from said ink sheet to said recording medium to record on said recording medium the image read in said reading step.

37. A method according to claim 36, wherein a conveying speed of the ink sheet is lower than a conveying speed of the recording medium.

38. A method according to claim 36, further comprising the step of communicating by at least one of transmitting a first image signal generated in said reading step and receiving a second image signal which is externally generated.

39. An image recording apparatus for transferring an ink contained in an ink sheet onto a recording medium to record an image on the recording medium, comprising:

reading means for reading an original image;

take-up means for taking up the ink sheet;

driving means for driving said take-up means to take up the ink sheet; and controlling means for controlling a drive amount of said driving means to maintain a substantially constant conveyance ratio of the ink sheet to the recording medium in correspondence with a change in take-up amount by said take-up means, said controlling means further comprising rotating amount detecting means for detecting a rotating amount of a supply roller for supplying the ink sheet conveyed by a take-up roller of said take-up means and counting means for counting the drive amount of said driving means in correspondence with a predetermined rotating amount of said supply roller;

wherein the drive amount of said driving means is changed when a count value of said counting means is not more than a predetermined value, and the image read by said reading means is recorded on the recording medium by transferring said ink from said ink sheet.

40. An image recording apparatus according to claim 39, further comprising communicating means for communicating by at least one of transmitting a first image signal generated by said reading means which corresponds to the image which is recorded on the recording medium by transferring said ink from said ink sheet and receiving a second image signal which is externally generated.

41. An image recording apparatus for transferring an ink contained in an ink sheet moved in a first direction onto a recording medium moved in a second direction, said first direction being opposite to said second direction at a position where said ink is transferred to the recording medium to record an image on the recording medium, comprising:

communicating means for communicating by at least one of transmitting a first image signal generated by said reading means which corresponds to the image which is recorded on the recording medium by transferring said ink from said ink sheet and receiving a second image signal which is externally generated;

a roller for taking up the ink sheet;

driving means for driving said roller to take up the ink sheet, a diameter of said ink sheet wound on said take-up roller increasing as additional said ink sheet is wound thereon; and controlling means for controlling a drive amount of said driving means wherein a conveyance ratio of the ink sheet to the recording medium is kept substantially constant.

42. An image recording apparatus according to claim 41, further comprising reading means for reading an original image, wherein the image read by said reading means is recorded on the recording medium by transferring said ink from said ink sheet.

43. An image recording apparatus for transferring an ink contained in an ink sheet moved in a first direction onto a recording medium moved in a second direction, said first direction being opposite to said second direction at a position where said ink is transferred to the recording medium to record an image on the recording medium, comprising:

communicating means for communicating by at least one of transmitting a first image signal generated by said reading means which corresponds to the image which is recorded on the recording medium by transferring said ink from said ink sheet and receiving a second image signal which is externally generated;

ink sheet conveying means for conveying the ink sheet, said ink sheet conveying means comprising a take-up roller on which said ink sheet is wound;

detecting means for detecting a conveyance amount of the ink sheet conveyed upon a driving operation of said ink sheet conveying means; and controlling means for controlling a drive amount of said ink sheet conveying means on a basis of the drive amount of said ink sheet conveying means and the conveyance amount of the ink sheet by said ink sheet conveying means, a diameter of said ink sheet wound on said take-up roller increasing as additional said ink sheet is wound thereon, wherein a conveyance ratio of said ink sheet to said recording medium is kept substantially constant.

44. An image recording apparatus according to claim 43, further comprising reading means for reading an original image, wherein the image read by said reading means is recorded on the recording medium by transferring said ink from said ink sheet.

45. An image recording apparatus for transferring an ink contained in an ink sheet moved in a first direction onto a recording medium moved in a second direction to record an image on the recording medium, comprising:

communicating means for communicating by at least one of transmitting a first image signal generated by said reading means which corresponds to the image which is recorded on the recording medium by transferring said ink from said ink sheet and receiving a second image signal which is externally generated;

a take-up roller for taking up the ink sheet;

driving means for driving said take-up roller to convey the ink sheet, said first direction being opposite to said second direction;

rotating amount detecting means for detecting a predetermined rotating amount of a supply roller during image recording;

detecting means for detecting a drive amount of said driving means in correspondence with the predetermined rotating amount; and controlling means for, when the drive amount detected by said detecting means is not more than a predetermined value, controlling to change the drive amount of said driving means, wherein a conveyance ratio of said ink sheet to said recording medium is kept substantially constant.

46. An image recording apparatus according to claim 45, further comprising reading means for reading an original image, wherein the image read by said reading means is recorded on the recording medium by transferring said ink from said ink sheet.

47. An image recording apparatus for transferring an ink contained in an ink sheet moved in a first direction onto a recording medium moved in a second direction, said first direction being opposite to said second direction at a position where said ink is transferred to the recording medium to record an image on the recording medium, comprising:

communicating means for communicating by at least one of transmitting a first image signal generated by said reading means which corresponds to the image which is recorded on the recording medium by transferring said ink from said ink sheet and receiving a second image signal which is externally generated;

a take-up roller for taking up the ink sheet, the ink sheet being wound on said take-up roller;

driving means for driving said take-up roller by a drive amount to convey the ink sheet, a diameter of said ink sheet wound on said take-up roller increasing as additional said ink sheet is wound thereon;

rotating amount detecting means for detecting a predetermined rotating amount of a supply roller;

calculating means for calculating a conveying length of the ink sheet on a basis of the drive amount and the rotating amount; and controlling means for, when the conveying length is not less than a predetermined value, controlling to change the drive amount of said driving means, wherein a conveyance ratio of said ink sheet to said recording medium is kept substantially constant.

48. An image recording apparatus according to claim 47, further comprising reading means for reading an original image, wherein the image read by said reading means is recorded on the recording medium by transferring said ink from said ink sheet.

49. An image recording method for maintaining substantially constant a conveyance ratio between an ink sheet and a recording medium which are conveyed in opposite directions at a transfer position where ink is transferred from said ink sheet to said recording medium, comprising the steps of:

communicating by at least one of transmitting a first image signal generated in said reading step and receiving a second image signal which is externally generated;

conveying said ink sheet by driving a take-up roller, said take-up roller taking up said ink sheet, a diameter of said ink sheet wound on said take-up roller increasing as additional said ink sheet is wound thereon;

detecting a driving amount of said take-up roller required to convey said ink sheet by a predetermined length; and maintaining substantially constant a conveyance ratio at said transfer position between said ink sheet and said recording medium by changing the driving amount of said take-up roller when in said detecting step the driving amount of said take-up roller is detected to be less than a predetermined amount.

50. An image recording method according to claim 49, further comprising the step of reading an original image, wherein said ink is transferred from said ink sheet to said recording medium to record on said recording medium the image read in said reading step.

51. An image recording apparatus for transferring an ink contained in an ink sheet onto a recording medium to record an image on the recording medium, comprising:

communicating means for communicating by at least one of transmitting a first image signal generated by said reading means which corresponds to the image which is recorded on the recording medium by transferring said ink from said ink sheet and receiving a second image signal which is externally generated;

take-up means for taking up the ink sheet;

driving means for driving said take-up means to take up the ink sheet; and controlling means for controlling a drive amount of said driving means to maintain a substantially constant conveyance ratio of the ink sheet to the recording medium in correspondence with a change in take-up amount by said take-up means, said controlling means further comprising;

rotating amount detecting means for detecting a rotating amount of a supply roller for supplying the ink sheet conveyed by a take-up roller of said take-up means; and counting means for counting the drive amount of said driving means in correspondence with a predetermined rotating amount of said supply roller, and the drive amount of said driving means is changed when a count value of said counting means is not more than a predetermined value.

52. An image recording apparatus according to claim 51, further comprising reading means for reading an original image, wherein the image read by said reading means is recorded on the recording medium by transferring said ink from said ink sheet.

* * * * *

UNITED STATES PATENT AND TRADEMARK OFFICE

CERTIFICATE OF CORRECTION

PATENT NO. : 5,384,584

DATED : January 24, 1995

INVENTOR(S) : TAKEHIRO YOSHIDA, ET AL.

It is certified that error appears in the above-identified patent and that said Letters Patent is hereby corrected as shown below:

COLUMN 1

Line 26, "a" should be deleted.
Line 53, "a length" should read --be-- and "be" should read --a length--.

COLUMN 2

Line 37, "minimal" should read --minimal,--.

COLUMN 6

Line 1, "remain" should read --remaining amount--.
Line 56, "in" should be deleted.

COLUMN 7

Line 59, "25." should read --25, respectively.--.
Line 60, "25, respectively" should read --25--.

COLUMN 8

Line 31, "$P_1:P_2=r_2:r_1$." should read --$p_1:p_2=r_2:r_1$.--.

COLUMN 9

Line 60, "sheet 34" should read --sheet 14--.

COLUMN 10

Line 47, "60°" should read --60°,--.

UNITED STATES PATENT AND TRADEMARK OFFICE

CERTIFICATE OF CORRECTION

PATENT NO. : 5,384,584

DATED : January 24, 1995

INVENTOR(S) : TAKEHIRO YOSHIDA, ET AL.

It is certified that error appears in the above-identified patent and that said Letters Patent is hereby corrected as shown below:

COLUMN 12

Line 63, "on" should read --an--.

COLUMN 14

Line 23, ""4035"" should read --"4035",--.
Line 32, ""1575"" should read --"1575",--.

COLUMN 19

Line 53, "ethrocellulose" should read --ethylcellulose--.
Line 59, "telephthalate," should read --terephthalate,--.

COLUMN 22

Line 39, "$C_s$<S" should read --$C_s$<S.--.

COLUMN 28

Line 9, "drive" should read --of drive--.

COLUMN 30

Line 67, "almost" should read --keep almost--.

COLUMN 31

Line 43, "comprises," should read --comprise,--.
Line 46, "remain" should read --remaining amount--.
Line 63, "remain" should read --remaining amount--.
Line 66, "remain" should read --remaining amount--.

UNITED STATES PATENT AND TRADEMARK OFFICE

CERTIFICATE OF CORRECTION

PATENT NO. : 5,384,584

DATED : January 24, 1995

INVENTOR(S) : TAKEHIRO YOSHIDA, ET AL.

It is certified that error appears in the above-identified patent and that said Letters Patent is hereby corrected as shown below:

COLUMN 32

Line 37, "$(\theta_0^2 + \theta_1^2)$" should read --$t(\theta_0^2 + \theta_1^2)$--.
Line 42, "remain x" should read --remaining amount x--.

COLUMN 33

Line 11, "remain" should read --remaining amount--.

COLUMN 34

Line 2, "remain" should read --remaining amount--.
Line 19, "remain x" should read --remaining amount x--.

COLUMN 35

Line 41, "comprises:" should read --comprising:--.

COLUMN 37

Line 4, "An" should read --A recording--.
Line 41, "comprising;" should read --comprising:--.

COLUMN 40

Line 25, "32," should read --33,--.

COLUMN 41

Line 9, "comprising" should read --comprising:--.
Line 13, "means" should read --means;--.

UNITED STATES PATENT AND TRADEMARK OFFICE

CERTIFICATE OF CORRECTION

PATENT NO. : 5,384,584

DATED : January 24, 1995

INVENTOR(S) : TAKEHIRO YOSHIDA, ET AL.

It is certified that error appears in the above-identified patent and that said Letters Patent is hereby corrected as shown below:

COLUMN 44

Line 28, "comprising;" should read --comprising:--.

Signed and Sealed this

Thirteenth Day of June, 1995

Bruce Lehman

*Attest:*

BRUCE LEHMAN

*Attesting Officer*

*Commissioner of Patents and Trademarks*